US012774593B2

(12) United States Patent
Stokes et al.

(10) Patent No.: US 12,774,593 B2
(45) Date of Patent: Oct. 27, 2026

(54) CLEAN DRAIN SYSTEMS

(71) Applicant: Kohler Co., Kohler, WI (US)

(72) Inventors: Andrew James Stokes, Mazomanie, WI (US); Andrew Smith, Sheboygan, WI (US); Erich Slothower, Mill Valley, CA (US); Michael Smith, Plymouth, WI (US); Vikas Salunke, Kohler, WI (US)

(73) Assignee: Kohler Co., Kohler, WI (US)

( * ) Notice: Subject to any disclaimer, the term of this patent is extended or adjusted under 35 U.S.C. 154(b) by 227 days.

(21) Appl. No.: 18/498,240

(22) Filed: Oct. 31, 2023

(65) Prior Publication Data

US 2024/0167259 A1 May 23, 2024

Related U.S. Application Data

(60) Provisional application No. 63/502,966, filed on May 18, 2023, provisional application No. 63/427,253, filed on Nov. 22, 2022.

(51) Int. Cl.
*E03C 1/232* (2006.01)
*E03C 1/23* (2006.01)
(Continued)

(52) U.S. Cl.
CPC ..... *E03C 1/232* (2013.01); *E03C 1/262* (2013.01); *E03C 1/30* (2013.01); *E03C 2001/2311* (2013.01); *E03C 2001/2317* (2013.01)

(58) Field of Classification Search
CPC . E03C 1/232; E03C 1/26; E03C 1/262; E03C 1/264; E03C 1/30; E03C 2001/2311; E03C 2001/2317
(Continued)

(56) References Cited

U.S. PATENT DOCUMENTS 1,224,603 A 5/1917 Clark
1,287,247 A 12/1918 Cross
(Continued)

FOREIGN PATENT DOCUMENTS

CN 109306723 A 2/2019
CN 216739890 U 6/2022
(Continued)

OTHER PUBLICATIONS

First Examination Report for IN Patent App. No. 202314077055 dated Jul. 27, 2026 (9 pages).

*Primary Examiner* — Tuan N Nguyen
(74) *Attorney, Agent, or Firm* — Foley & Lardner LLP

(57) ABSTRACT

The present disclosure is generally directed towards a clean drain system. The clean drain system includes drain stopper system, a seal, and a flange. The seal is coupled to the flange. The drain stopper system is positioned through the seal. The drain stopper system further includes a drain cover, a drain housing, and a basket. The drain cover along a vertical axis to allow or prevent the flow of water through the tailpipe. The basket includes a plurality of openings. The basket is configured to catch debris as it flows downward through the drain to prevent the drain from clogging. The clean drain system further includes an overflow cover, an overflow tube, and a collar. The collar is positioned around the drain housing. The overflow cover is coupled to the overflow tube. The collar is coupled to another end of the overflow tube.

12 Claims, 56 Drawing Sheets

(51) Int. Cl.
*E03C 1/262* (2006.01)
*E03C 1/30* (2006.01)

(58) Field of Classification Search
USPC ..... 4/679–695, 286, 293, 295
See application file for complete search history.

(56) References Cited

U.S. PATENT DOCUMENTS

| | | | | |
|---|---|---|---|---|
| 1,496,595 | A | 6/1924 | Pasman | |
| 2,113,721 | A | 4/1938 | Dame | |
| 2,295,416 | A | 9/1942 | Madison | |
| 3,927,428 | A | 12/1975 | Jette | |
| 4,077,430 | A | 3/1978 | Brown et al. | |
| 4,257,454 | A | 3/1981 | Vilen | |
| 4,797,208 | A | 1/1989 | Miller et al. | |
| 4,910,811 | A | 3/1990 | Izzi, Sr. | |
| 5,019,346 | A | 5/1991 | Richter et al. | |
| 5,208,921 | A | 5/1993 | Nicoll | |
| 5,640,724 | A | 6/1997 | Holmes | |
| 6,195,819 | B1 | 3/2001 | Wang | |
| 6,274,375 | B1 | 8/2001 | McMinn | |
| 6,282,730 | B1 | 9/2001 | Duncan | |
| 6,367,102 | B1 | 4/2002 | McMullen | |
| 7,392,658 | B1 | 7/2008 | Hardy | |
| 7,527,069 | B2 * | 5/2009 | Denike | F16K 31/084 137/527 |
| 7,814,580 | B2 | 10/2010 | Coronado et al. | |
| 8,337,627 | B2 | 12/2012 | Fitzsimmons et al. | |
| 8,590,065 | B2 | 11/2013 | Ali et al. | |
| 8,967,176 | B2 | 3/2015 | Connor | |
| 9,339,150 | B1 | 5/2016 | Risko | |
| 9,371,636 | B2 | 6/2016 | Ali et al. | |
| 9,427,114 | B2 | 8/2016 | Tong | |
| 9,518,383 | B2 | 12/2016 | Lesmeister | |
| 9,657,469 | B2 | 5/2017 | Edmonds et al. | |
| 9,869,076 | B1 | 1/2018 | Harris | |
| 9,945,106 | B2 | 4/2018 | Ali et al. | |
| 10,036,151 | B1 | 7/2018 | Dugger | |
| 10,060,109 | B2 | 8/2018 | Edmonds et al. | |
| 10,106,967 | B2 | 10/2018 | Sebolt | |
| 10,301,803 | B2 | 5/2019 | Beck et al. | |
| 10,501,917 | B2 | 12/2019 | Ali et al. | |
| 10,538,903 | B2 | 1/2020 | Franzén | |
| 10,570,595 | B2 | 2/2020 | Sebolt | |
| 10,792,708 | B1 | 10/2020 | Grimes et al. | |
| 10,808,386 | B2 | 10/2020 | Beck et al. | |
| 11,019,965 | B2 | 6/2021 | Beck et al. | |
| 11,162,251 | B2 | 11/2021 | Beck et al. | |
| 11,193,261 | B2 | 12/2021 | Beck et al. | |
| 11,287,054 | B2 | 3/2022 | Yan et al. | |
| 11,517,155 | B2 | 12/2022 | Ahuja et al. | |
| 11,519,161 | B2 | 12/2022 | Ahuja et al. | |
| 11,549,246 | B1 | 1/2023 | Mociran | |
| 11,680,397 | B2 | 6/2023 | Ahuja | |
| 11,702,829 | B2 | 7/2023 | Ahuja et al. | |
| 11,773,574 | B2 | 10/2023 | Ali | |
| 11,781,303 | B2 | 10/2023 | Ball et al. | |
| 11,788,266 | B2 | 10/2023 | Ahuja et al. | |
| 11,834,818 | B1 | 12/2023 | Osterneck | |
| 2005/0278841 | A1 | 12/2005 | Coronado et al. | |
| 2008/0098516 | A1 | 5/2008 | Cao et al. | |
| 2009/0255041 | A1 | 10/2009 | Duncan | |
| 2011/0005867 | A1 | 1/2011 | Kocher | |
| 2011/0185494 | A1 | 8/2011 | Beck et al. | |
| 2013/0031720 | A1 | 2/2013 | Homami et al. | |
| 2013/0145534 | A1 | 6/2013 | Coronado et al. | |
| 2016/0201307 | A1 | 7/2016 | Franzen | |
| 2017/0204592 | A1 | 7/2017 | Chen | |
| 2018/0112889 | A1 | 4/2018 | Barker et al. | |
| 2018/0127961 | A1 | 5/2018 | Homami et al. | |
| 2019/0119891 | A1 | 4/2019 | Strandvall | |
| 2020/0217054 | A1 | 7/2020 | Chen | |
| 2022/0010536 | A1 | 1/2022 | Ali | |
| 2022/0042292 | A1 | 2/2022 | Ahuja et al. | |
| 2022/0064922 | A1 | 3/2022 | Stefini et al. | |
| 2022/0243439 | A1 | 8/2022 | Badiger | |
| 2023/0078534 | A1 | 3/2023 | Ahuja et al. | |
| 2023/0078805 | A1 | 3/2023 | Sapp et al. | |

FOREIGN PATENT DOCUMENTS

| | | | | |
|---|---|---|---|---|
| DE | 28 13 088 | A1 | 10/1979 | |
| DE | 29 50 611 | A1 | 6/1981 | |
| DE | 92 11 521 | U1 | 12/1992 | |
| DE | 10 2010 047 647 | A1 | 4/2012 | |
| DE | 10 2011 055 116 | A1 | 5/2013 | |
| DE | 10 2013 011 807 | A1 | 2/2014 | |
| DE | 10 2013 018 470 | A1 | 5/2015 | |
| DE | 20 2016 103 243 | U1 | 8/2016 | |
| DE | 10 2016 106 183 | A1 | 7/2017 | |
| EP | 1 600 566 | A1 | 11/2005 | |
| EP | 1 961 872 | A2 | 8/2008 | |
| EP | 1 961 874 | A2 | 8/2008 | |
| EP | 2 037 050 | A1 | 3/2009 | |
| EP | 2 037 051 | A2 | 3/2009 | |
| EP | 2 281 955 | A1 | 2/2011 | |
| EP | 2 463 446 | A1 | 6/2012 | |
| EP | 3 835 499 | A2 | 6/2021 | |
| EP | 4 036 330 | A2 | 8/2022 | |
| EP | 4 112 826 | A1 | 1/2023 | |
| GB | 2 491 253 | | 11/2012 | |
| GB | 2 533 764 | | 7/2016 | |
| KR | 20080076863 | A * | 8/2008 | E03C 1/262 |
| WO | WO-2010/085079 | A2 | 7/2010 | |
| WO | WO-2011/117825 | A1 | 9/2011 | |
| WO | WO-01/2141664 | A1 | 10/2012 | |
| WO | WO-2018/212413 | A1 | 11/2018 | |
| WO | WO-02/128656 | A1 | 6/2020 | |

* cited by examiner

CLEAN DRAIN SYSTEMS

PRIORITY CLAIM

This application claims the benefit of and priority to U.S. Provisional Patent Application No. 63/427,253, filed Nov. 22, 2022, and U.S. Provisional Patent Application No. 63/502,966, filed May 18, 2023, which are hereby incorporated by reference in their entirety.

BACKGROUND

The present disclosure relates generally to clean drain systems (e.g., tub drain systems, lavatory drain, etc.

The drain outlet that receives water from the tailpipe of a drain system is often fixed and cannot be moved. When installing a new drain system or replacing an old drain system, the tailpipe of the new system may not align with the existing position of the drain outlet. For example, when replacing a tub, the new tub may have a drain opening slightly offset from the position of the tub's drain opening. The user may then be tasked with adjusting the position of the tub in order to align the new drain opening with the existing drain outlet.

Various debris, such as hair, can also obstruct the flow of water down the drain. For example, hair may get caught in the drain stopper system causing water to build up in the tub and drain slowly. The user may then be tasked with disassembling the drain to remove the debris.

The user may choose to change the drain stopper system with an existing tub. For example, a user may determine that they prefer the aesthetic of one stopper over another stopper. The user may then be tasked with replacing the entire internal drain stopper system even though the user only wants to change the exterior drain cover or the mechanics of opening and closing the drain stopper system which is both costly and time consuming.

It would be advantageous to provide an improved drain system that addresses one or more of the aforementioned issues.

SUMMARY

One embodiment of the present disclosure relates to a clean drain system. The clean drain system includes a drain stopper system, and an alignment system. The drain stopper system includes a drain cover, a first seal, a first flange, a second seal, and a second flange. The alignment system includes a seal, and a seal flange. The seal flange includes a groove. The seal is coupled to the groove.

DETAILED DESCRIPTION

A clean drain system provides a hassle-free solution to minimize or prevent the clogging of a drain. For example, drains (e.g., waste outlet pipes for a shower, tub, lavatory, etc.) are easily clogged by hair and other debris (e.g., dirt, food, etc.) such that the user must often manually remove a drain stopper or a drain cover and extract the debris to restore normal flow of fluid through the system. A system that includes various cleaning methods to reduce the burden of clearing and cleaning a cogged drain system is desirable.

Referring generally to the FIGURES, disclosed herein is a clean drain system 100. The clean drain system includes a drain stopper system 108, a seal 110, and a seal flange 112.

Figure 1:
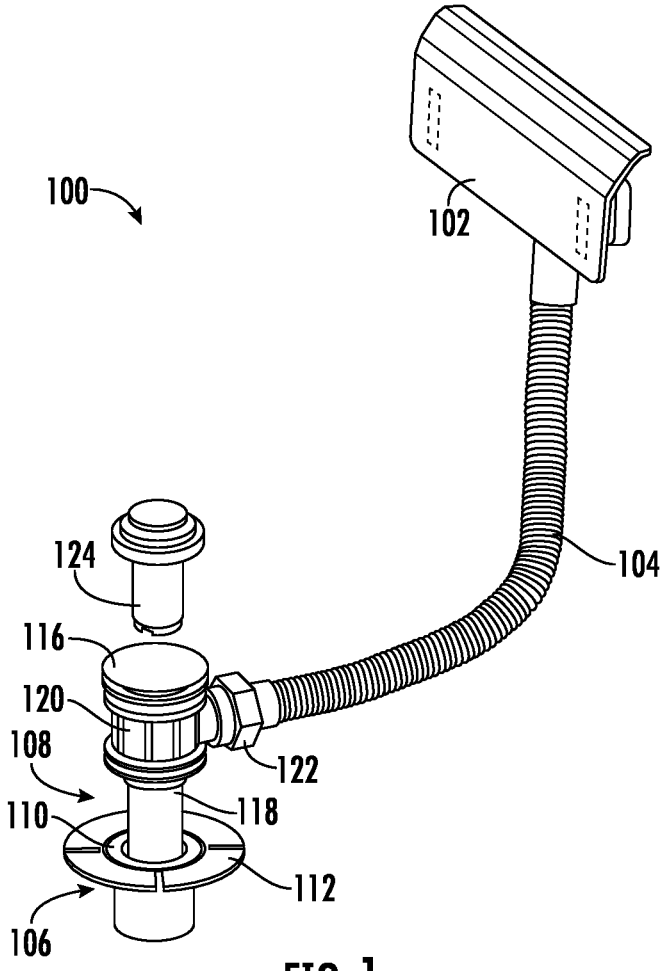
FIG. 1 a perspective view of a clean drain system according to another exemplary embodiment.

Now referring to FIG. 1 is a perspective view of a clean drain system 100 according to one exemplary embodiment. The clean drain system 100 includes an overflow cover 102, an overflow tube 104, an alignment system 106, and a drain stopper system 108. The alignment system 106 system includes a seal 110, and a seal flange 112. The overflow cover 102 may be secured to a tub wall. The overflow cover 102 is in fluid communication with the overflow tube 104. The overflow cover 102 is positioned on a wall such that there is an overflow opening 114 below the overflow cover 102 to allow water to flow through the cover and down the overflow tube 104.

The drain stopper system 108 includes a drain cover 116 and a tailpipe 118. The drain cover 116 may be raised and lower to form a seal between a drain opening and the drain cover 116. For example, the user may lower the drain cover 116 to prevent flow of water down the tailpipe 118.

The clean drain system 100 further includes a collar 120 and a nut 122. The overflow tube 104 is also in fluid communication with the collar 120. The collar 120 is positioned around the tailpipe 118 of the drain stopper system 108. The collar 120 couples an end of the overflow tube 104 to the tailpipe 118 of the drain stopper system 108. The nut 122 is configured to secure the overflow tube 104 to the collar 120. For example, water may flow through the plurality of overflow openings 114, down the overflow tube 104, through the collar 120 of the alignment system 106, and down the tailpipe 118 of the drain stopper system 108.

The overflow tube 104 may be bent or curved to fluidly couple the overflow cover to 102 to the collar 120. For example, the overflow tube 104 may be flexible and accordion like in structure. For example, the overflow tube 104 may be stretched or compressed to accommodate the varying height difference between the overflow cover 102 and the drain stopper systems 108.

The seal 110 is coupled to the seal flange 112. The seal 110 is configured to receive an end of the tailpipe 118. The seal flange 112 is configured to secure the seal 110 to a structure, such as a floorboard.

Furthermore, the clean drain system includes a hand tool 124. The hand tool 124 is configured to aid installation of the drain stopper system 108.

Figure 2A:
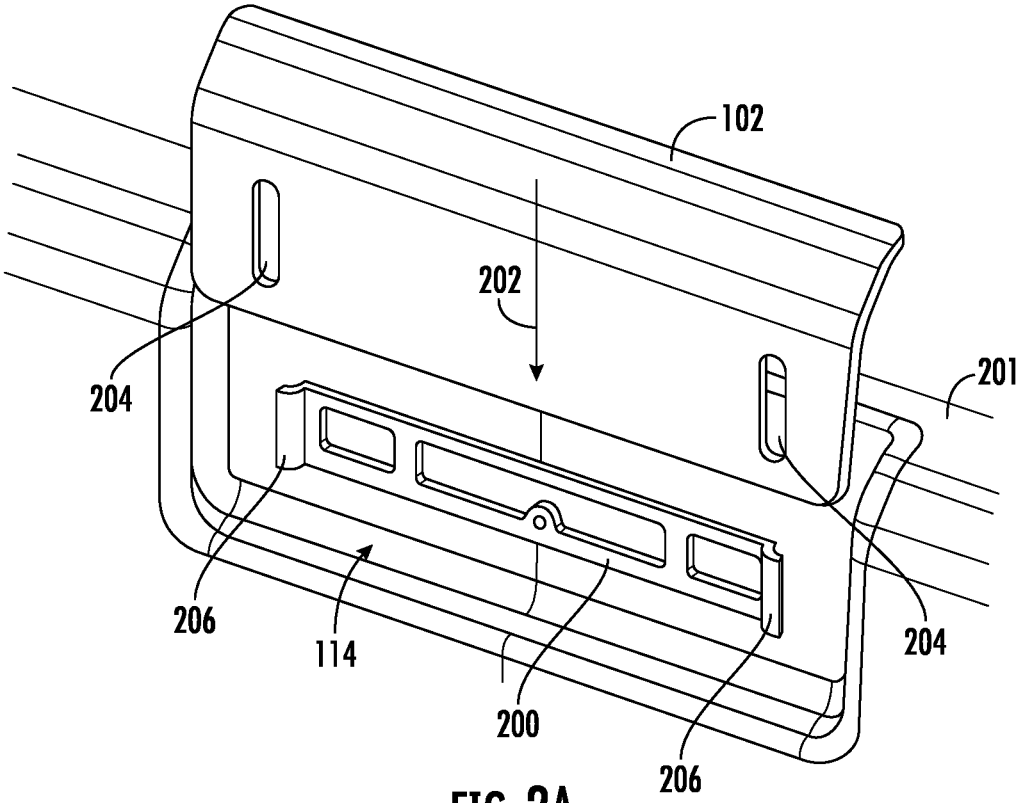
FIG. 2A is a perspective view of an overflow cover trim and assembly for a clean drain system according to another embodiment.

Referring more particularly to FIG. 2A is a perspective view of the overflow cover 102 shown in FIG. 1. The overflow cover 102 may be flat such that the overflow cover fits flush over the overflow opening 114. The overflow cover 102 may be positioned such that a portion of the overflow opening (e.g., a horizontal slot) is open. For example, the overflow cover 102 may be positioned to partially obstruct the overflow opening 114 such that water may flow underneath the overflow cover 102 and down the overflow tube 104. For example, the partially obstructed overflow opening 114 may be large enough to allow water to flow to prevent flooding, but small enough to prevent objects from flowing down the overflow tube 104.

The overflow cover 102 is coupled an overflow mount 200. The overflow mount 200 is secured (e.g., screw, fastened, etc.) to a tub wall 201. The overflow mount 200 may be coupled (e.g., screwed, snapped, etc.) to the clean drain system 100. The overflow cover 102 may slide downward 202 or snap onto the overflow mount 200. For example, the overflow cover 102 may include a plurality of slots 204. The overflow mount may further include a plurality of pins 206. For example, the user may slide the pins 206 of the overflow mount 200 into the slots 204 of the overflow cover 102 to secure the overflow cover 102 to the overflow mount 200.

Figure 2B:
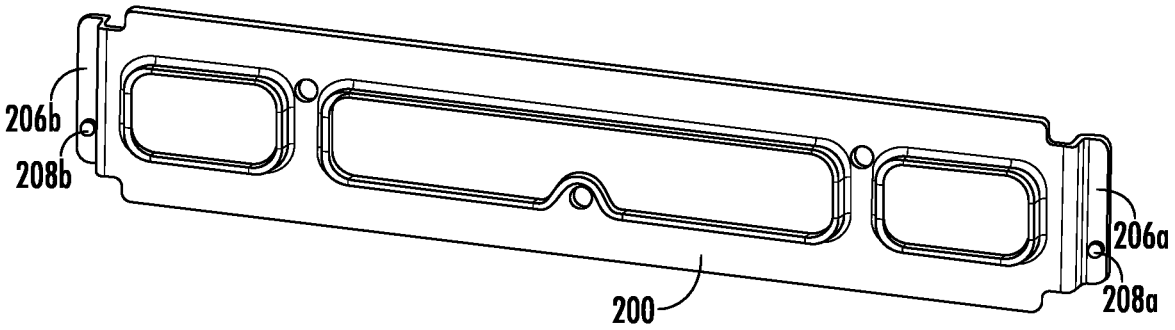
FIG. 2B is a back view of an overflow mount of FIG. 2A.

FIG. 2B is a back view of the overflow mount 200 shown in FIG. 2A. The overflow mount includes a first pin 206*a* positioned on a first side of the overflow mount 200. The overflow mount 200 further includes a second pin 206*b* positioned on a second side of the overflow mount 200 opposite the first side of the overflow mount 200.

The overflow mount 200 can further include a plurality of pin protrusions 208. For example, the overflow mount may include a first pin protrusion 208*a* and a second pin protrusion 208*b* (e.g., a bump, dimple, pin, button, etc.). The first pin protrusion 208*a* and the second pin protrusion 208*b* may be substantially circular and dome like in shape. The first pin protrusion 208*a* and the second pin protrusion 208*b* may be any shape protruding outward from the plurality of pins 206. The first pin protrusion 208*a* may be positioned on a bottom half of the first pin 206*a*, and the second pin protrusion 208*b* may be positioned on a bottom half of the second pin 206*b*. For example, the first protrusion 208*a* and the second protrusion 208*b* may be aligned along a horizontal axis of the overflow mount 200. The first protrusion 208*a* and the second protrusion 208*b* are configured to engage with the overflow cover 102. For example, the overflow cover 102 may be slid onto the overflow mount 200. Once the overflow cover 102 is secured onto the overflow mount 200, the first protrusion 208*a* and the second protrusion 208*b* will engage with the overflow cover 102. For example, the first protrusion 208*a* and the second protrusion 208*b* may provide tactic feedback when the overflow cover 102 is secured to the overflow mount 200. For example, when the overflow cover 102 is secured to the overflow mount 200, the user may hear a noise, such as a snap.

Figure 2C:
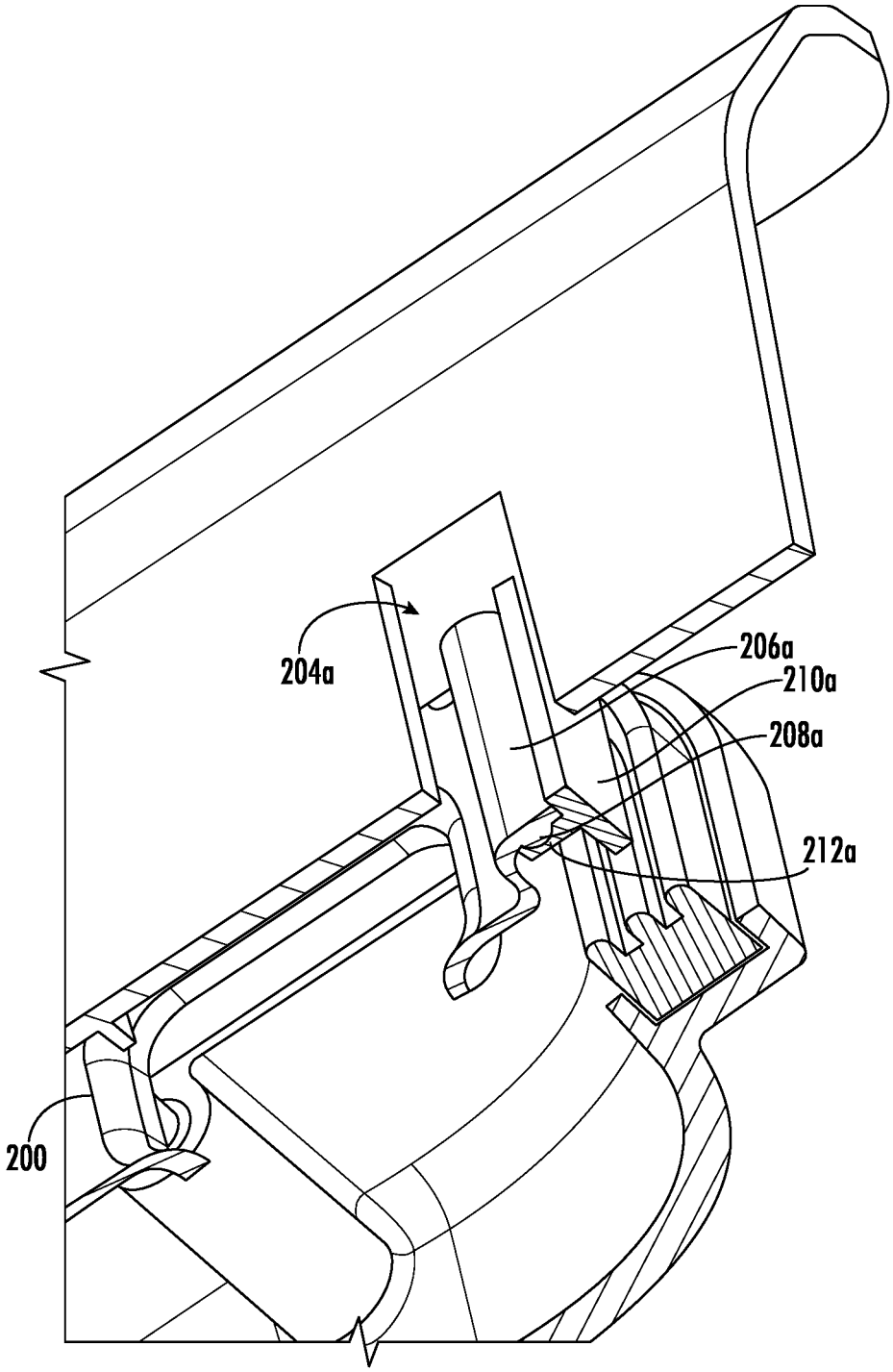
FIG. 2C is a cross-sectional view of a portion of the overflow cover trim and assembly for the clean drain system of FIG. 2A.

FIG. 2C is a cross-sectional view of a portion of overflow trim and assembly of FIG. 2A and the overflow mount of FIG. 2B. The overflow cover 102 includes a plurality of interior wings 210. The plurality of interior wings 210 are positioned within the plurality of slots 204. For example, the overflow cover may include a first slot 204*a* and a second slot (not shown) and a first interior wing 210*a* and a second interior wing (not shown) positioned in the first slot 204*a* and the second slot respectively. The plurality of wings 210 are configured to engage with a structure of the clean drain assembly. For example, the plurality of wings 210 may engage with the overflow mount 200. In some embodiments, the plurality of wings 210 may engage with a bracket or a tub wall.

The overflow cover 102 further includes a plurality of recesses 212. The plurality of recesses 212 are positioned on the plurality of wings 210. For example, the first wing 210*a* may include a first recess 212*a*. The plurality of recesses 212 may be substantially circular and bowl like in shape. The plurality of recesses 212 may be any shape that compliments the shape of the plurality of pin protrusions 208. The plurality of recesses 212 are configured to receive the plurality of pin protrusions 208. For example, the overflow cover 102 can be slid onto the overflow mount 104. As the overflow cover 102 is slid onto the overflow mount 200, the plurality of pin protrusions 208 can engage with the plurality of recesses 212. For example, when the overflow cover 102 is secured onto the overflow mount 200, the plurality of pin protrusions 208 will be positioned within the plurality of recesses 212. As the plurality of protrusions 208 slide into the plurality of recesses 212, tactic feedback, such as a snap, may be provided signaling that the overflow cover 102 is secured onto the overflow mount 200.

Figure 3:
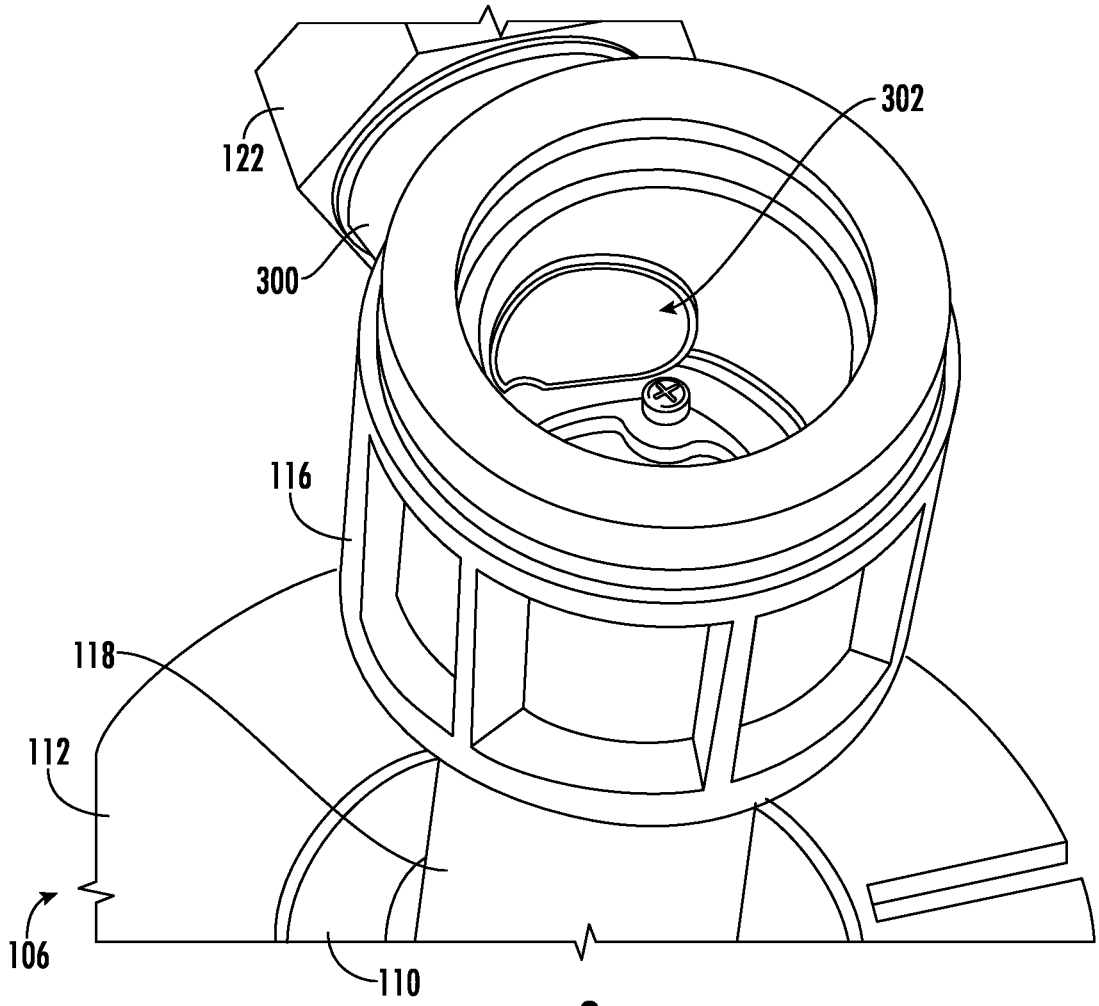
FIG. 3 is a perspective view of an alignment system portion of the clean drain system according to one exemplary embodiment.
Figure 4A:
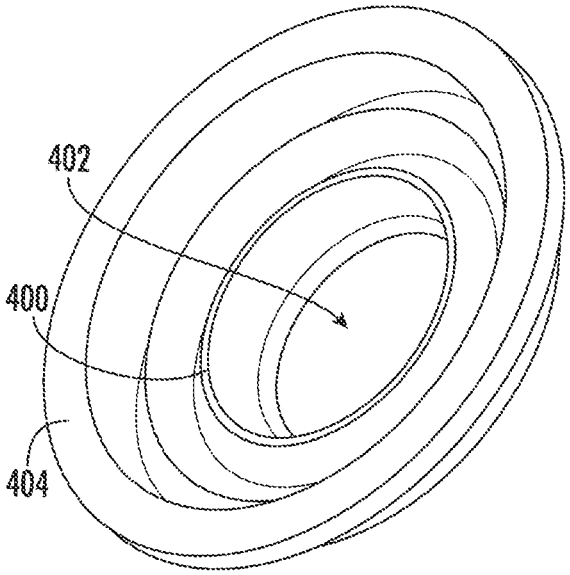
FIGS. 4A-4B are perspective views of a seal for a clean drain system according to one embodiment.
Figure 4B:
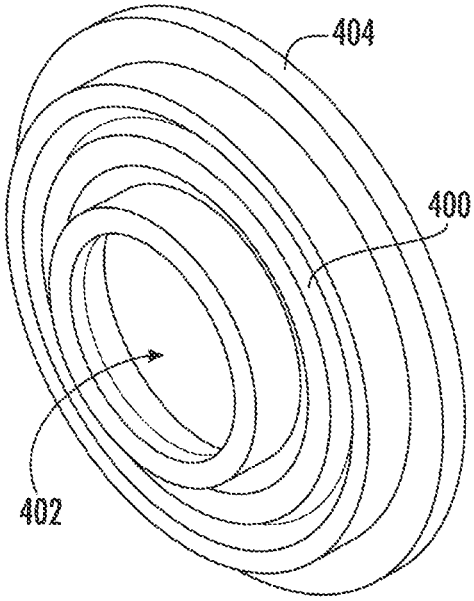
Figure 5:
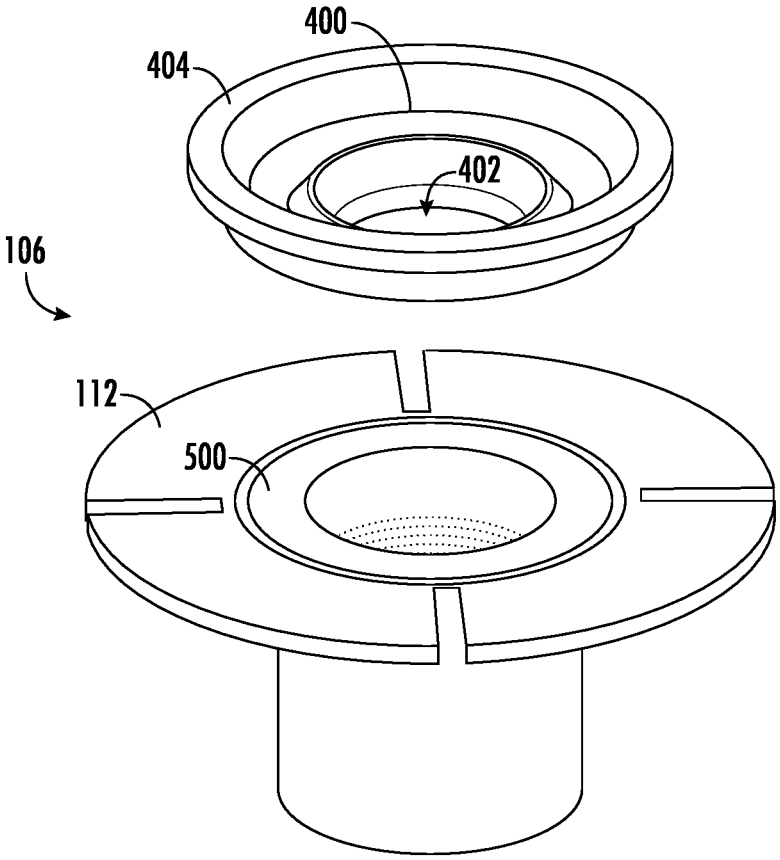
FIG. 5 is a perspective view of the seal of FIGS. 4A-4B as shown with a deployed flange.
Figure 6:
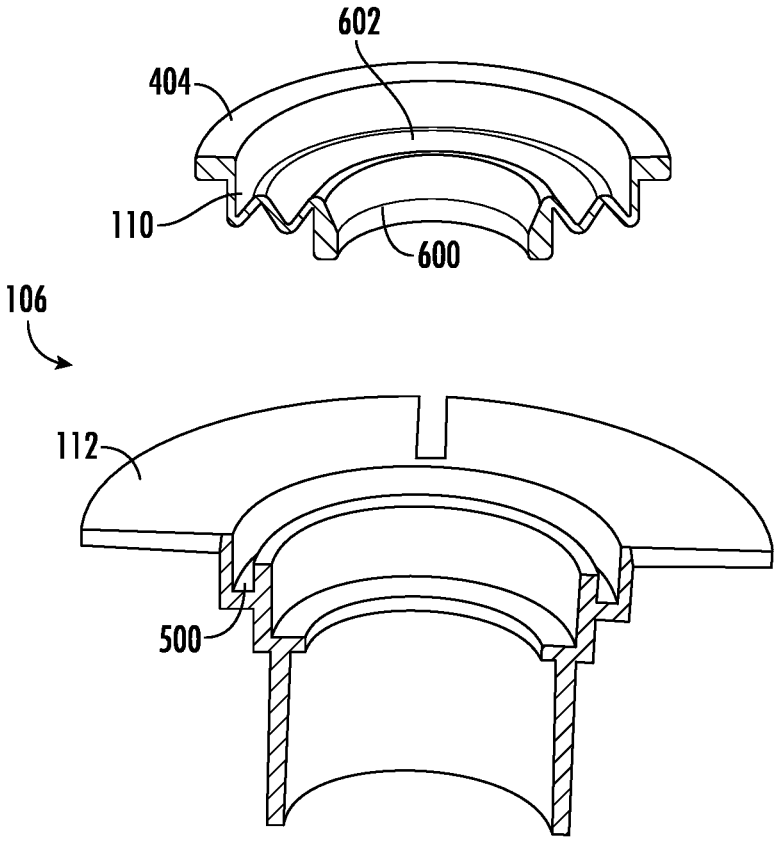
FIG. 6 is a cross-sectional view of the seal and the flange of FIG. 5.

FIG. 3 illustrates a downward perspective view of the collar 120 for a clean drain system 100 according to the embodiment of FIG. 1. The collar 120 is positioned around the tailpipe 118. The collar 120 may be comprised of brass. The collar 120 includes a connection tube 300 and a connection opening 302. The connection tube 300 is aligned with the connection opening 302 of the collar 120 such the overflow tube 104 (not shown) is fluidly coupled to the tailpipe 118. The collar 120 may also include a brass ring 304. The brass ring 304 may be positioned near a bottom of the collar 120. The brass ring 304 is configured to receive the tailpipe 118. The brass ring 304 may include a plurality of screws 306. For example, the brass ring 304 may include three screws 306. A tool may be used to press the tailpipe 118 into the brass ring 304. The tool then may also be used to tighten the plurality of screws 306 thereby compressing the brass ring 304 around the tailpipe 118. Now referring generally to FIG. 4-6, is the seal 110 and the seal flange 112 for a clean drain system 100 according to one exemplary embodiment. FIG. 4A and FIG. 4B are perspective views of a seal 110 for a clean drain system according to one embodiment. FIG. 4A is a top-down view of the seal 110 and FIG. 4B is a view of the bottom of the seal 110 according to one embodiment. According to the embodiment of FIG. 4A and FIG. 4B the seal 110 is corrugated (e.g., ribbed, etc.). The corrugated seal 110 includes a plurality of annular ridges 400 and a central opening 402. The plurality of annular ridges 400 are configured to deform when receiving a tailpipe (not shown). For example, the plurality of annular ridges 400 allow the central opening 402 to move along a horizontal plane. For example, the central opening 402 may shift (e.g., move left, move right, move diagonal, etc.) based on the position of the tailpipe. The deformation of the corrugated seal 110 allows for easy alignment of the tailpipe. For example, the seal 110 may deform to shift the central opening 402 along a horizontal plane to compensate for misalignment between the tailpipe 118 and the opening of the seal flange 112. For example, the seal 110 may deform up to about 0.5 of an inch. The seal 110 further includes an outer ridge 404. The outer ridge 404 is configured to secure the seal in place (e.g., to a flange, etc.).

FIG. 5 is an exploded view of the corrugated seal 110 and the seal flange 112. The seal flange 112 may be a single piece made of a rigid material (e.g., a metal, a metal alloy, etc.). The flange is removably coupled to the seal 110. The seal flange 112 may include a groove 500. The groove 500 is configured to receive the corrugated seal 110. The seal flange 112 is configured to secure the outer ridge 404 of the corrugated seal 110. For example, the outer ridge 404 may be stationary while the central opening 402 is movable along a horizontal plane by deforming the plurality of annular ridges 400.

Now referring specifically to FIG. 6 is a cross-sectional view of the seal 110 and the seal flange 112 of the embodiment of FIG. 5. AS shown in FIG. 6, the corrugated seal 110 includes at least a first ridge 600 and a second ridge 602. The first ridge 600 defines the central opening 402. The inner edge 604 of the first ridge 600 extends a distance downward. The inner edge is configured to receive the tailpipe (not shown). The groove of the flange is configured to receive the outer ridge 404. For example, the groove 500 and the outer ridge 404 may interlock.

Figure 7:
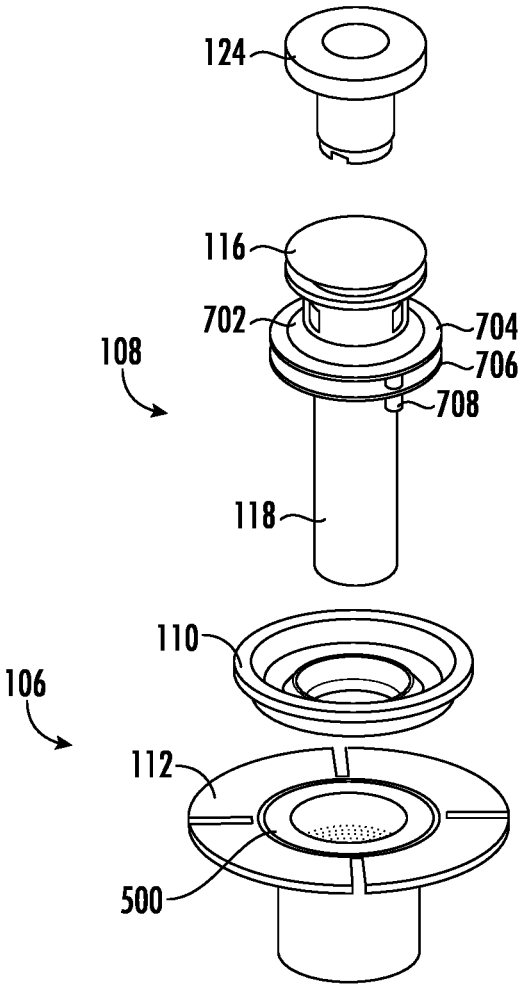
FIG. 7 is an exploded view of the seal and flange of FIG. 5 with a drain stopper placed in a tailpipe and a tool according to one exemplary embodiment.

FIG. 7 is an exploded view of the drain stopper system 108, seal 110, and seal flange 112 as shown in the embodiment of FIG. 1 According to the embodiment of FIG. 7 the drain stopper system 108 further includes a drain housing 700, a rubber seal 702, a first washer 704, a second washer 706, and a plurality of screws 708. The drain housing 700 extends downward around the tailpipe 118. The drain cover 116 is positioned within the drain housing 700. The drain housing 700 is positioned within the rubber seal 702, the first washer 704, and the second washer 706. The plurality of screws are positioned through the first washer 704 and the second washer 706. The first washer 704 and the second washer 706 are configured to secure the drain housing 700 to the tailpipe 118. The plurality of screws 708 is configured to secure the first washer 704 and the second washer 706 around the drain housing 700.

The central opening 402 is configured to receive the tailpipe 118. For example, if the tailpipe 118 is off set from the seal flange 112, the corrugated seal 110 can deform to couple the tailpipe 118 to the seal flange 112.

Figure 8:
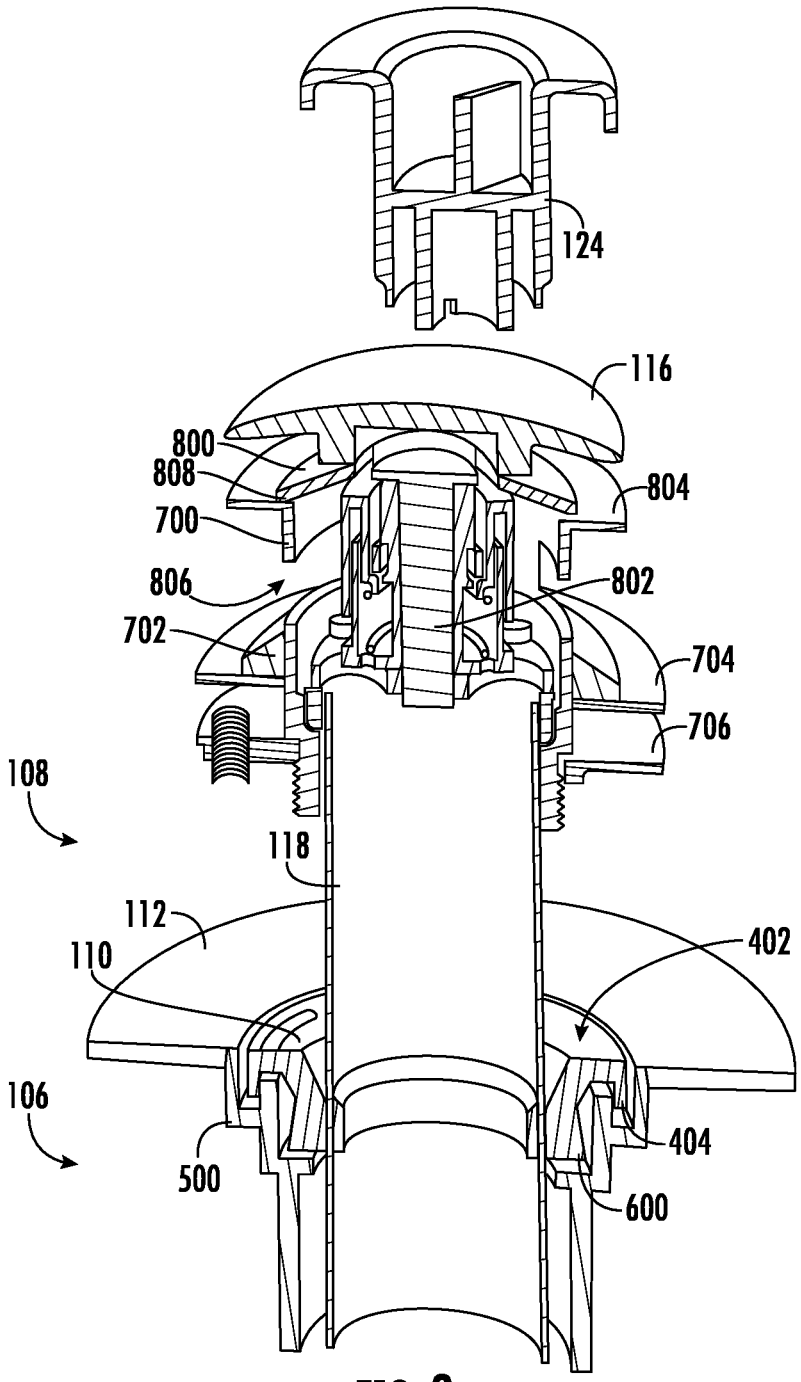
FIG. 8 is a cross-sectional view of the embodiment of FIG. 7 according to one embodiment.

Furthermore, FIG. 8 is a cross-sectional view of the drain stopper system 108 according to another exemplary embodiment as shown previously in FIG. 7. The drain stopper system 108 further includes a cover seal or a gasket 800, and a clicker system 802. When the drain cover 116 is lower, the gasket 800 is configured to seal a drain opening. For example, when the drain cover 116 is lowered along a vertical axis to a closed position, the gasket 800 seals the drain opening to prevent water from leaving the tub. The drain housing 700 includes an outer rim 804 and a plurality of rectangular slots 806. The outer rim 804 may be positioned within the tub opening such that the outer rim 804 rests within the tub opening and is coupled to the drain body 700. The drain body 700 extends downward over the tailpipe 118. The rectangular slots 806 are positioned opposite of each other on the drain housing 700. The outer rim 804 can be a brass ring. The drain stopper system 108 may further include an O-ring 808 (e.g., an annular ring, circular ring, etc.). The O-ring 808 is positioned underneath the outer rim 804. The clicker system 802 and a basket may be installed through the outer rim 804 and engage the drain body 700 (e.g., in a threaded or quarter-turn fastening arrangement).

Figure 9:
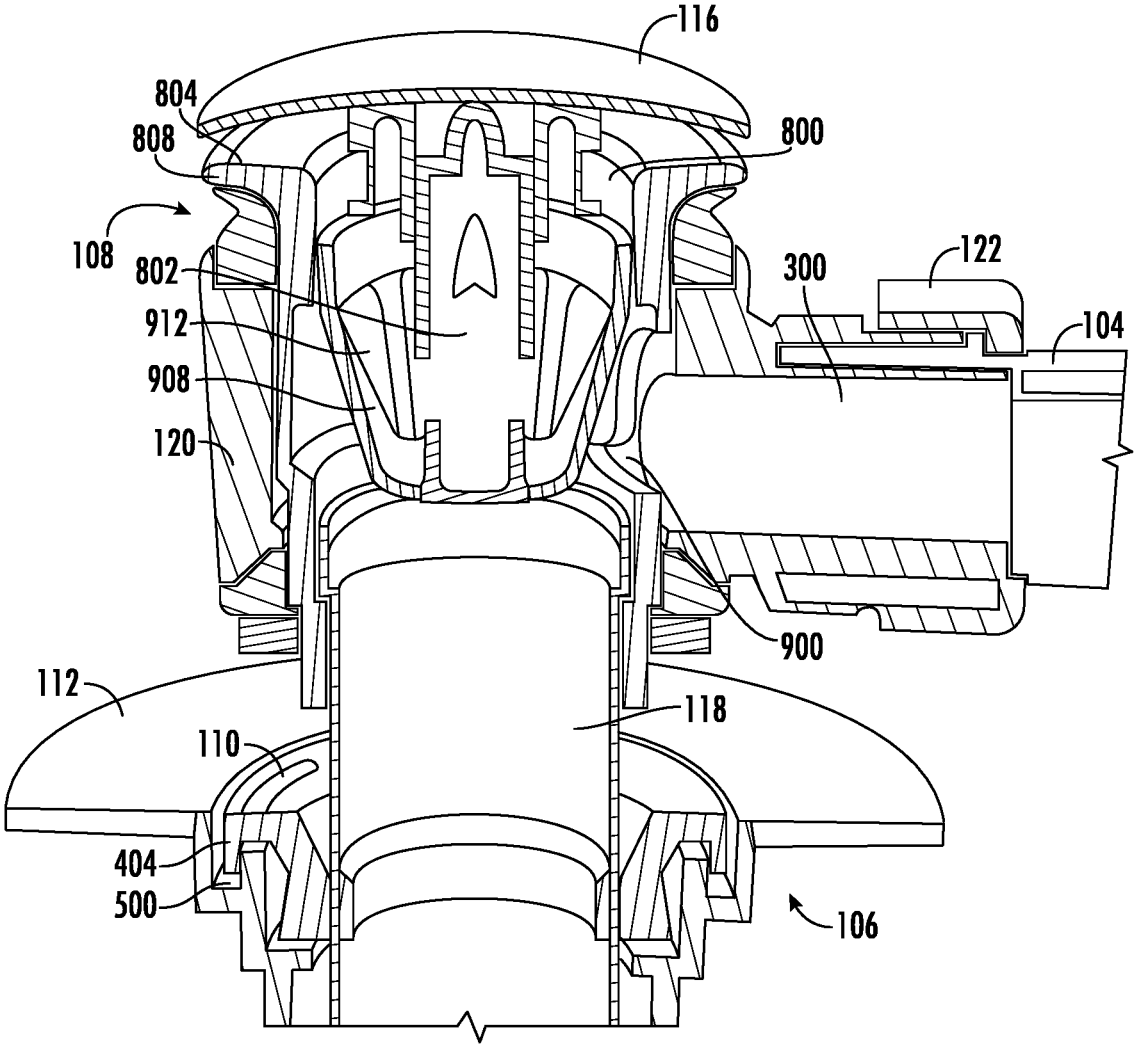
FIG. 9 is cross-sectional view of a drain stopper system and an alignment collar for a clean drain system according to another exemplary embodiment.

FIG. 9 is a cross-sectional view of the drain stopper system 108 and the alignment system 106 of a clean drain system 100. The drain stopper system 108 is coupled to the collar 120. For example, according to this embodiment, the collar is positioned around the drain stopper system 108. The drain stopper system 108 further includes the drain housing 700. The drain body 700 of the drain stopper system 108 is positioned within the collar 120. The nut 122 of the collar 120 can then be tightened around the drain body 700 to create a seal between the drain body 700 and the collar 120. The drain housing 700 includes a circular opening 900. The connection opening 302 is configured to receive excess water from the overflow tube 104. The drain cover 116 is configured to move vertically between an open and closed position within the drain housing 700. For example, the drain cover 116 can be moved upward vertically to an open position such that there is an opening 902 for water flow downward into the drain stopper system 108 and through the tailpipe 118. The drain cover 116 may also be moved vertically downward such to seal the drain opening 906 so that water cannot flow through the drain opening.

Figure 10:
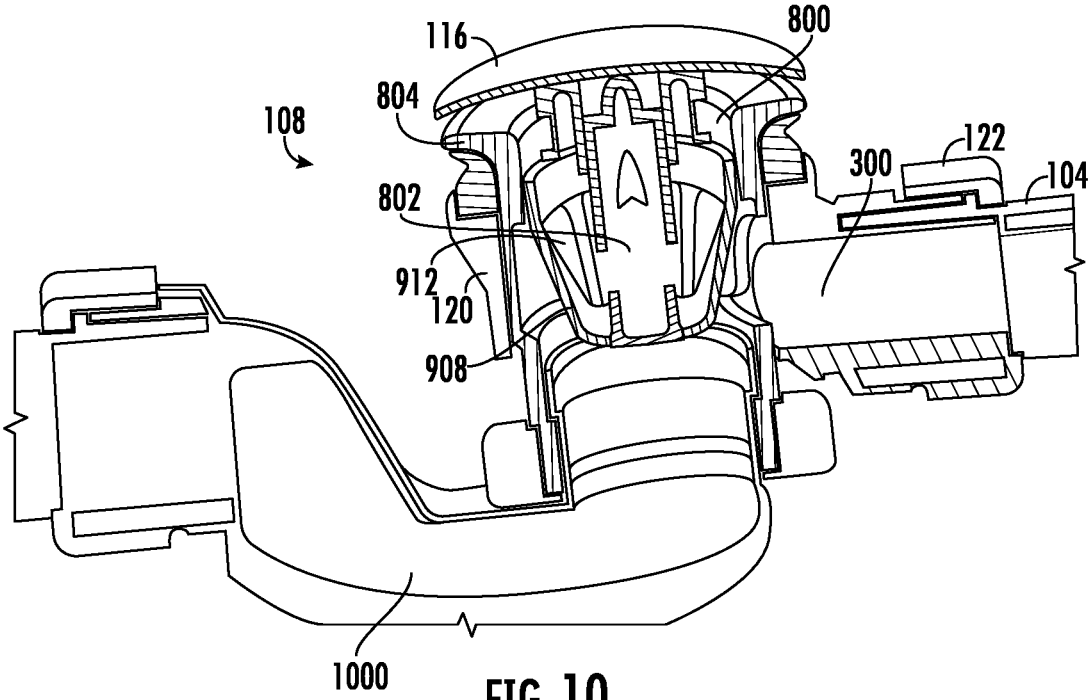
FIG. 10 is a cross-sectional view of yet another drain stopper system for a clean drain system according to another exemplary embodiment.

According to the embodiment of FIG. 10, the drain stopper system 108 may further include a side outlet 1000 and a side outlet 1002. For example, the side outlet 100 may be a flexible hose. The side outlet 1000 is configured to couple another drain conduit that may be positioned elsewhere within the building structure (e.g., misaligned, positioned a distance away, etc.) to the drain system 100 to allow water to flow out of the system. According to this embodiment, the side outlet 1002 is configured to direct the flow of water and debris away from the tub through a floorboard.

The drain stopper system 108 according to the embodiments of FIG. 9-10 further includes a basket 908. The basket 908 is positioned below the drain cover 226 and within the drain housing 700. The basket 908 is removable from the drain stopper system 108. For example, the basket 908 may be removed to clean the basket 908 of debris (e.g., hair, etc.) According to some embodiments, the basket 908 may be coupled to the drain cover 116. For example, the drain cover 116 may be coupled to the basket 908 such that the drain cover 116 and the basket 908 may be removable or replaceable. The basket 908 may also be threaded on and unthreaded off of the clicker system 802 to further clean the basket 908. Furthermore, the basket 908 may include a plurality of openings 912. The plurality of openings 912 are configured to trap debris (e.g., hair, dirt, etc.). For example, the basket 908 may be removed from the drain housing 700 to clear debris caught in the openings 912.

Furthermore, the drain stopper system 108 may be partially or fully removable from the clean drain system 100. For example, the drain cover 116 and the basket 908 may be removed (e.g., lifted vertically up out of the drain) from the drain opening while the drain housing 700 remains stationary within the drain opening. For example, the drain cover 116 and the basket 908 may be removed from the drain opening by unscrewing or unlocking the drain stopper system 108 from the clean drain system 100. This may be advantageous for cleaning the drain stopper system 108 or replacing the drain cover 116 of the drain stopper system 108. For example, hair or other debris (e.g., dirt, etc.) may get caught on the basket 908 and prevent proper water flow through the clean drain system 100. Therefore, by removing the drain stopper system 108, a user may manually clear the hair and other debris from the basket 908 to restore normal water flow through the clean drain system 100. A portion of the basket 908 may overlap with the circular opening 900 of the drain housing 700. For example, water flowing down through the overflow tube 104 may flow through an opening 912 of the basket 908 and down the tailpipe 118.

Figure 11:
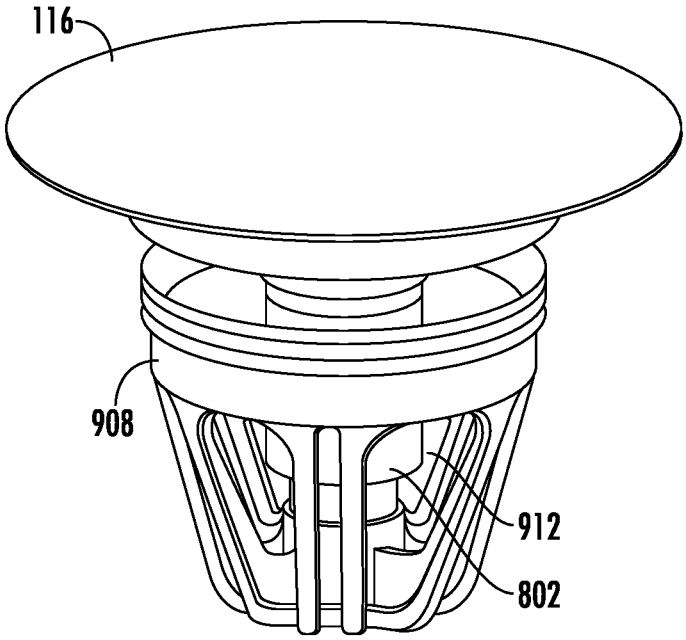
FIG. 11 is a perspective view of a drain stopper and basket for a clean drain system according to one embodiment.

FIG. 11 is perspective view of the drain cover 116 and the basket 908 of a drain stopper system 108 for a clean drain system 100 according to one exemplary embodiment. The drain cover 116 is coupled to the basket 908. According to this embodiment, the drain stopper system 108 may include, but is not limited to, a clicker system 802 as previously described. Other embodiments may include a pop-up system, a stationary cover with openings, or other systems that can open and close the drain. One end of the clicker system 802 is coupled to the drain cover 116 and another end of the clicker system 802 is coupled to the basket 908. The clicker system 802 is configured to expand and contract along a vertical axis to move the drain cover 116 to open and close the drain opening. For example, the clicker system 802 may include a spring (not shown) that is compressed when the drain cover 116 is in a closed positioned and is expanded when the drain cover 116 is in an open position.

Figure 12:
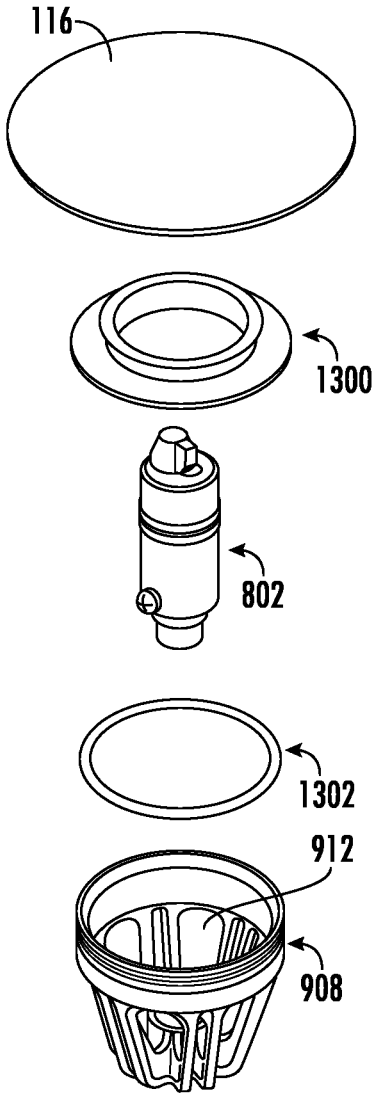
FIG. 12 is an expanded parts view of the drain stopper and hair strainer for a clean drain system according to the embodiment of FIG. 11.

FIG. 12 is an expanded parts view of the drain stopper system 108 as shown in the embodiment of FIG. 11. The drain stopper system includes the drain cover 116, the clicker system 802, and the basket 908. The drain stopper system further includes a rubber seal 1300 and a washer 1302. The rubber seal is coupled to the drain cover 116. The rubber seal 1300 is positioned around the clicker system 802. The washer 1302 is positioned below the rubber seal 1300. The washer 1302 is also coupled to the basket 908.

Figure 13A:
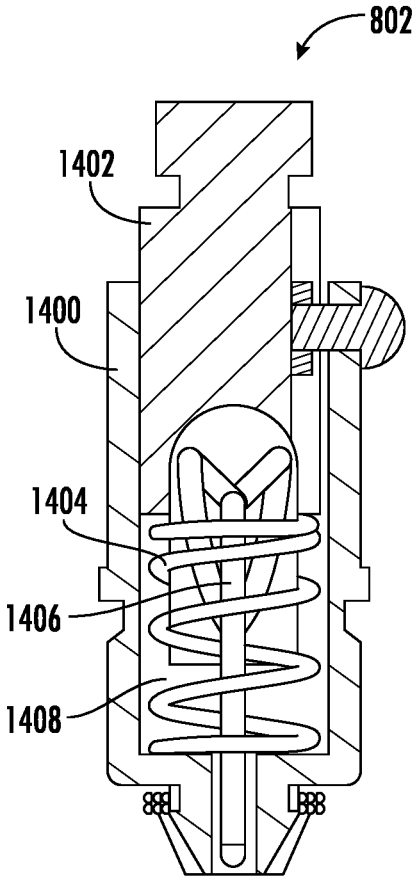
FIG. 13A-FIG. 13B are cross-sectional view of the clicker mechanism of the drain stopper of FIG. 10-FIG. 12.
Figure 13B:
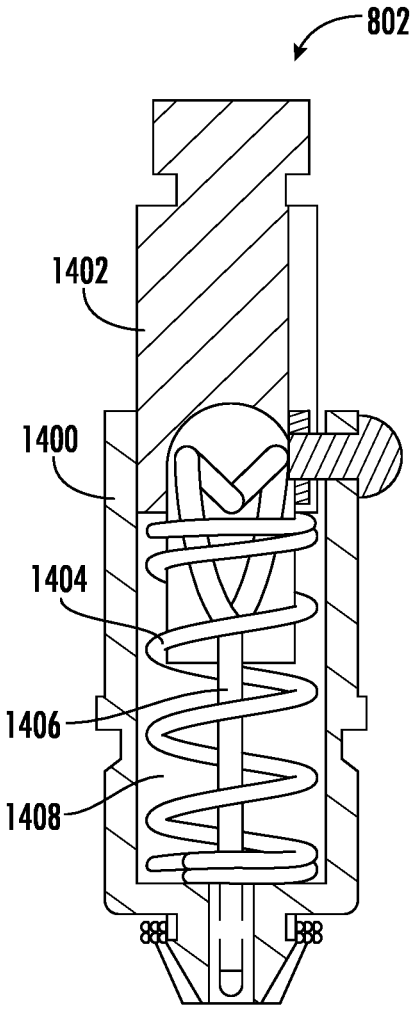

FIG. 13A and FIG. 13B are cross-sectional views of a clicker mechanism for a drain stopper system 108. FIG. 13A illustrates the clicker system 802 in a closed position. FIG. 13B illustrates the clicker mechanism in an open position. The clicker system 802 includes a clicker housing 1400, a plunger 1402, a spring 1404, and a spring rod 1406. The clicker housing 1400 includes an inner cavity 1408. The plunger 1402 is positioned in the inner cavity 1408. The spring 1404 is coupled to the spring rod 1406. The plunger 1402 is coupled to the spring rod 1406. The plunger 1402 is configured to secure (e.g., lock, couple, etc.) the drain cover (not shown) in an open or closed position. For example, if the user presses downward on the drain cover, the plunger 1402 presses down on the spring rod 1406. The spring rod 1406 compresses the spring 1404. For example, if the drain cover is in a closed positioned and the user exerts a downward force on the drain cover, the plunger 1402 will release from a locked position, thus releasing the spring 1404 allowing the spring to expand upward pushing the drain cover up to an open position.

Figure 14A:
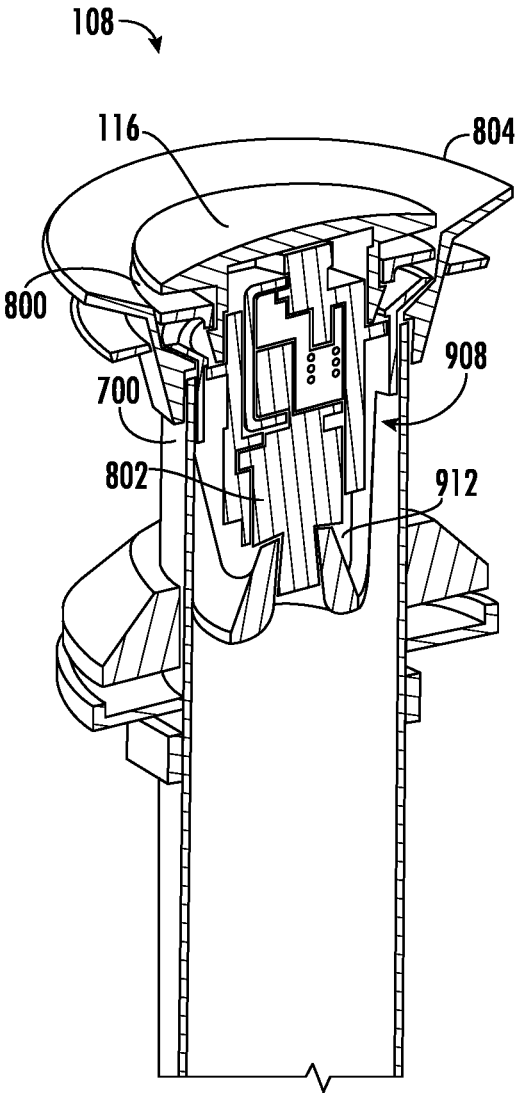
FIG. 14A-14B are cross-sectional views of a drain stopper system for a clean drain system according to another embodiment.
Figure 14B:
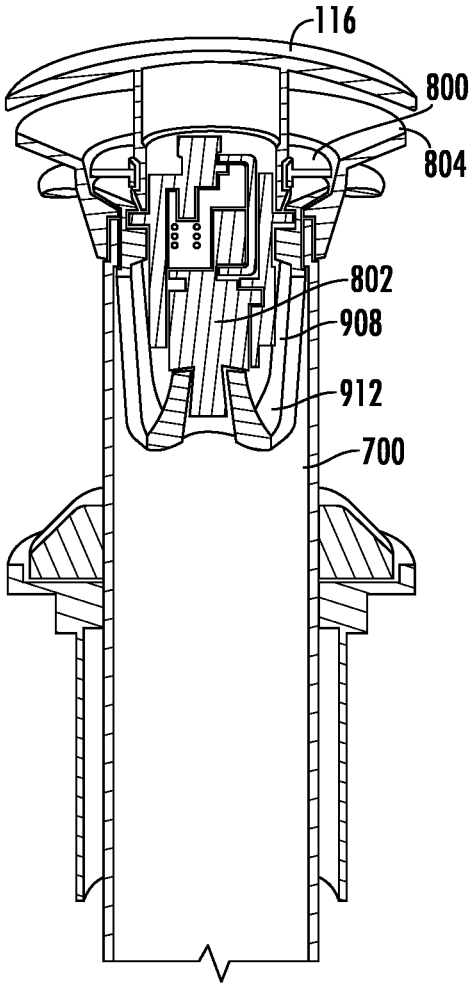

FIGS. 14A-14B are cross sectionals views of the drain stopper system 108 as shown in FIG. 9 for a clean drain system 100. According to this embodiment, the drain stopper system 108 further includes the basket 908 and the clicker system 802 as previously described. FIG. 14A illustrates the drain stopper system 108 in a closed positioned while FIG. 14B illustrates the drain stopper system 108 in an open position. According to the embodiment of FIG. 14, and FIG. 14B, the corrugated seal 110 may be rigid. In other embodiments, the corrugated seal 110 may be corrugated as previously described.

Figure 15:
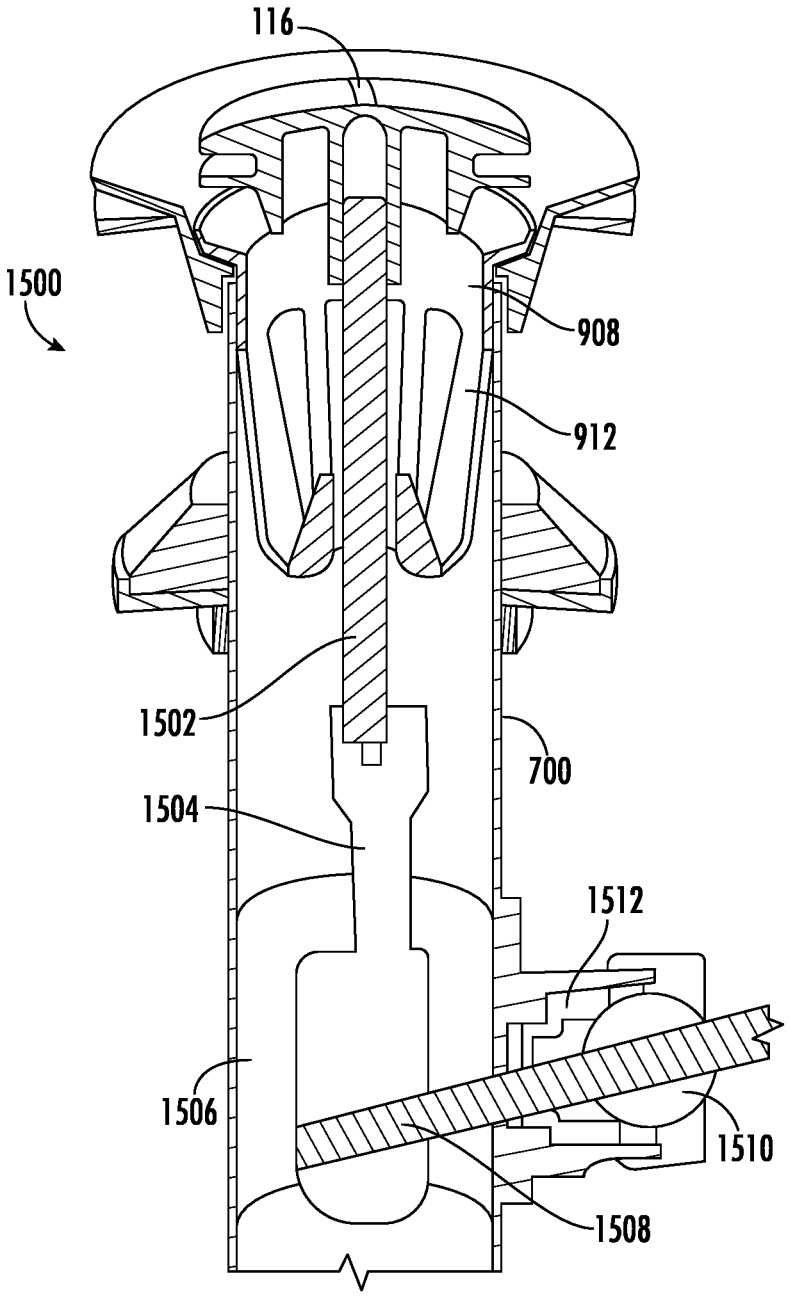
FIG. 15 is a cross-sectional view of a drain stopper system for a clean drain system according to another embodiment.

Furthermore, FIG. 15 is a cross-sectional view of a drain stopper system 108 for a clean drain system 100 according to yet another exemplary embodiment. The drain stopper system 108 includes the drain housing 700, the drain cover 116, and the basket 908. According to this embodiment, the drain stopper system further includes a pop-up system 1500. The pop-up system 1500 includes a drain cover rod 1502, a connector 1504, a lever collar 1506, a lever arm 1508, a gear 1510, and a pad 1512. A portion of the connector 1504 may be positioned within the lever collar 1506 and another portioned of the connector 1504 may be disposed within the drain housing 700. An end of the drain cover rod 1502 is coupled to the drain cover 116. For example, the drain cover 116 may be screwed or glued to the drain cover rod 1502. Instead, in some embodiments, the drain cover 116 and the drain cover rod 1502 may be one singular component.

Another end of the drain cover rod 1502 is coupled to the connector 1504. For example, the connector 1504 may include a square opening configured to receive the end of the drain cover rod 1502 and a pin positioned through the drain cover rod 1502 configured to secure the drain cover rod 1502 to the connector 1504. The connector 1504 is also coupled to the lever arm 1508. The gear 1510 is positioned within the lever collar 1506. The lever arm 1508 is positioned through the gear 1510 and within the lever collar 1506. The lever arm 1508 is configured to move a vertical distance defined by the gear 1510 within the lever collar 1506. The pad 1512 is also positioned within the lever collar 1506. The pad 1512 is configured to cushion the lever arm 1508 within the lever collar 1506. For example, when move the lever arm 1508 a vertical distance to open or close the drain opening, the lever arm 1508 may contact the lever collar 1506.

Furthermore, the lever arm 1508 may be attached to a switch (not shown). The switch may be configured such that the user can move the switch up or down to manually open or close the drain opening. For example, the lever arm 1508 may extend upward near a faucet within a tub.

Figure 16:
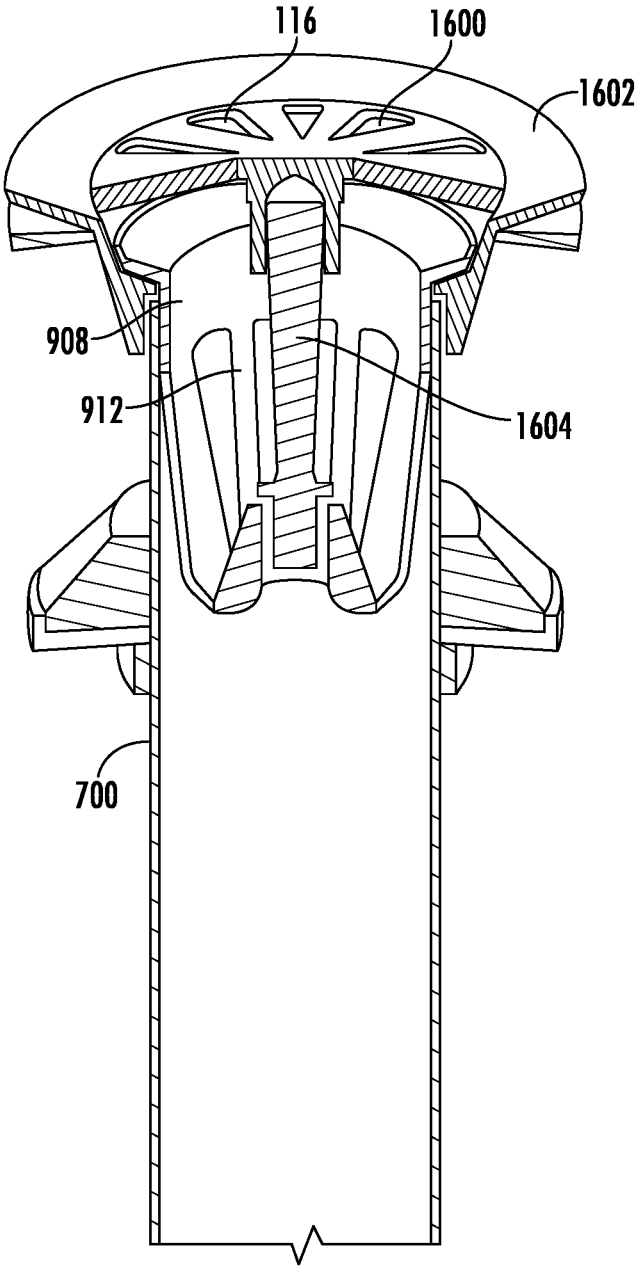
FIG. 16 is a cross-sectional view of a drain stopper system for a clean drain system according to yet another embodiment.

Now referring to FIG. 16, is another cross-sectional view of an exemplary embodiment of the drain stopper system 108 for a clean drain system 100. This embodiment of the drain stopper system includes the housing 700, the drain cover 116, and the basket 908. According to this embodiment, the drain cover 116 further includes a plurality of wedged openings 1600 (e.g., a grid design, etc.) and an angled outer rim 1602. The drain cover 116 is positioned such that drain cover 116 is flush within the drain opening.

Furthermore, the drain cover 116 is stationary within the drain opening. For example, according to this embodiment, the drain cover 116 does not move vertically between an open position and a closed position. Instead, in this embodiment, the drain cover 116 is fixed (e.g., coupled, secured, etc.) to the housing 700 and water can flow continuously through the plurality of wedged openings 1600. According to this embodiment, the drain stopper system also includes a rod 1604. An end of the rod 1604 is coupled to the drain cover 116 and another end of the rod 1604 is coupled to the basket 908. The rod 1604 is configured to support the drain cover 116. For example, if force (e.g., stepping on drain cover, etc.) is applied to the drain cover 116, the drain cover rod 1502 may support the drain cover 116 and prevent the drain cover 116 from deforming (e.g., breaking, caving in, cracking, etc.).

Figure 17C:
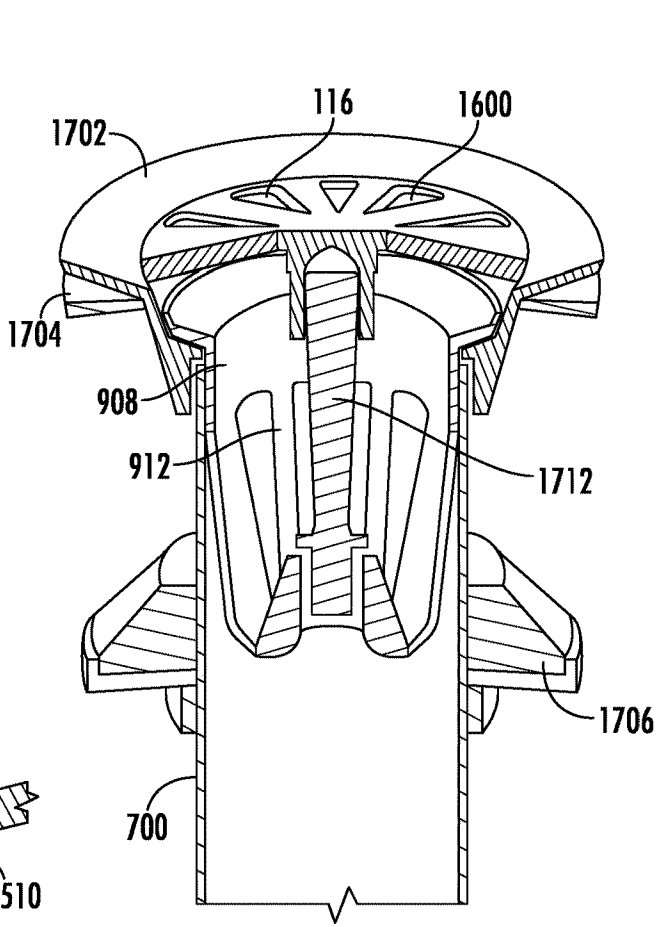
FIG. 17A, FIG. 17B, and FIG. 17C are cross-sectional views of the drain stopper systems of FIG. 14, FIG. 15, and FIG. 16 respectively, for a clean drain system according to another embodiment.
Figure 17B:
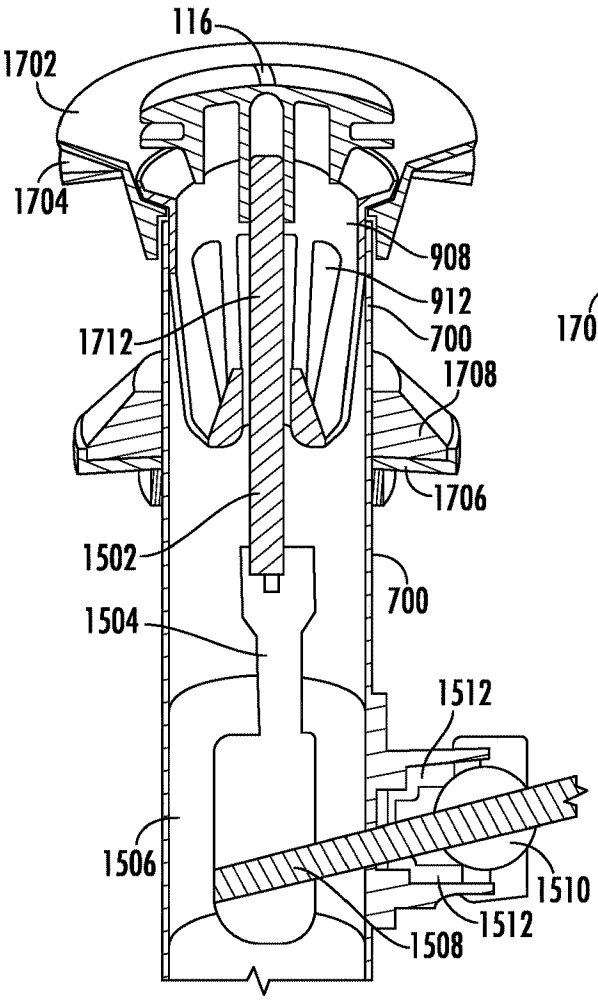
Figure 17A:
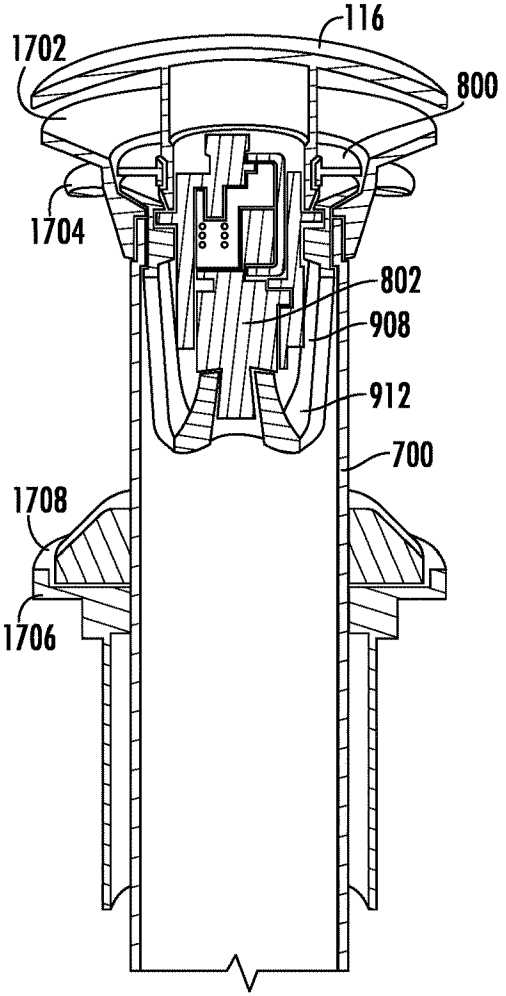
Figure 18:
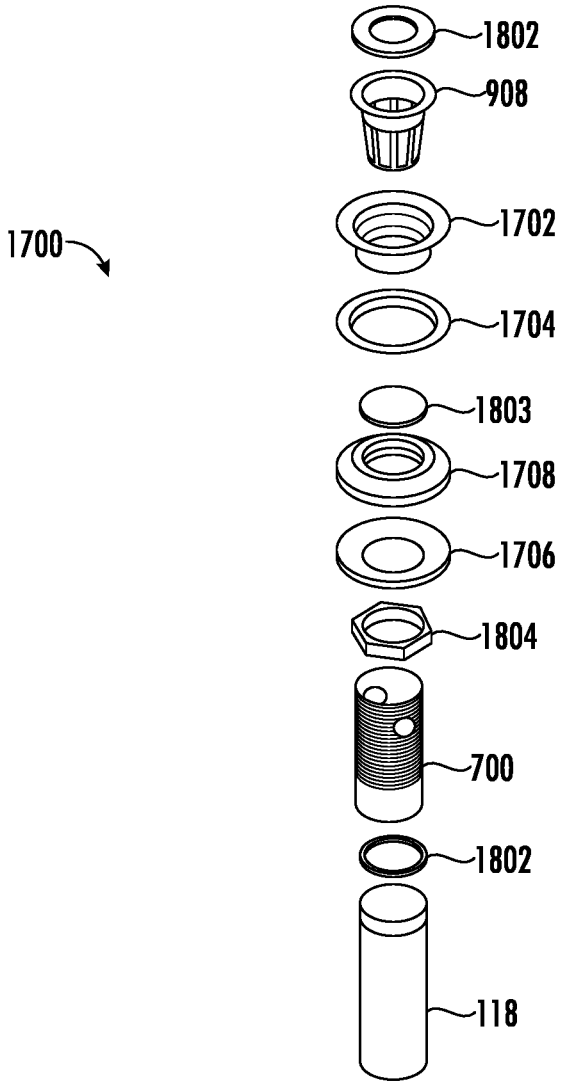
FIG. 18 is an exploded parts view of a portion of the drain stopper system according to one embodiment.

FIGS. 17A-17C illustrate various drain stopper systems 108 (e.g., an interchangeable drain system 1700, etc.) within an interchangeable drain housing 700. FIG. 17A is a cross-sectional view of the drain stopper system 108 including the clicker system 802 as previously described in FIGS. 11-14 deployed in the drain housing 700. FIG. 17B is a cross-sectional view of the drain stopper system 108 including the pop-up system 1500 as previously shown in FIG. 15 deployed in the interchangeable drain housing 700. FIG. 17C is a cross-sectional view of the drain stopper system 108 including the stationary drain cover 116 as previously described in FIG. 16 deployed in the interchangeable drain housing 700. The interchangeable drain housing 700 further includes a first flange 1702, a first seal 1704, a second flange 1706, and a second seal 1708. The first flange 1702 is positioned above the first seal 1704. The first seal 1704 is configured to create a snug fit between the first flange 1702 and the drain opening (not shown here) such that water and debris cannot pass between the first flange 1702 and the drain opening. The second flange 1706 and the second seal 1708 are positioned below the first seal 1704. The second seal 808 (e.g., an O-ring, etc.) is coupled to the second flange 1706. The second flange 1706 is configured to secure the second seal 1708. The second seal 1708 is configured to prevent leaking between connections of the tailpipe 1710 to the housing 700.

Furthermore, the embodiments shown in FIGS. 17A-17C include the basket 908. The basket 908 further includes an interior support 1712. The interior support 1712 is positioned in the center of the drain basket 908. The interior support 1712 is configured to receive at least one of the clicker system 802, the pop-up system 1500, or the drain cover rod 1604 as previously shown and described.

Also shown in the embodiment of FIG. 17B is an overflow opening 1714 within the interchangeable drain housing 700. The overflow opening may be including in any of the described embodiments. The overflow opening 1714 is configured to receive water from the overflow tube (not shown) as previously described.

Now referring to FIG. 18-FIG. 20A are expanded parts views of the interchangeable drain system 1700 as previously shown in FIGS. 17A-17B. The interchangeable drain housing 700 further includes a drain cover seal 1802, the drain basket 908, the first flange 1702, the first seal 1704, a first washer 1803, the second seal 1708 (e.g., a rubber seal, a gasket, etc.), the second flange 1706, a nut 1804, a kit 1810 (e.g., an overflow kit 1906*a*, a non-overflow kit 1906*b*, etc.), the tailpipe 118, and a tailpipe cover 1806.

Figure 19:
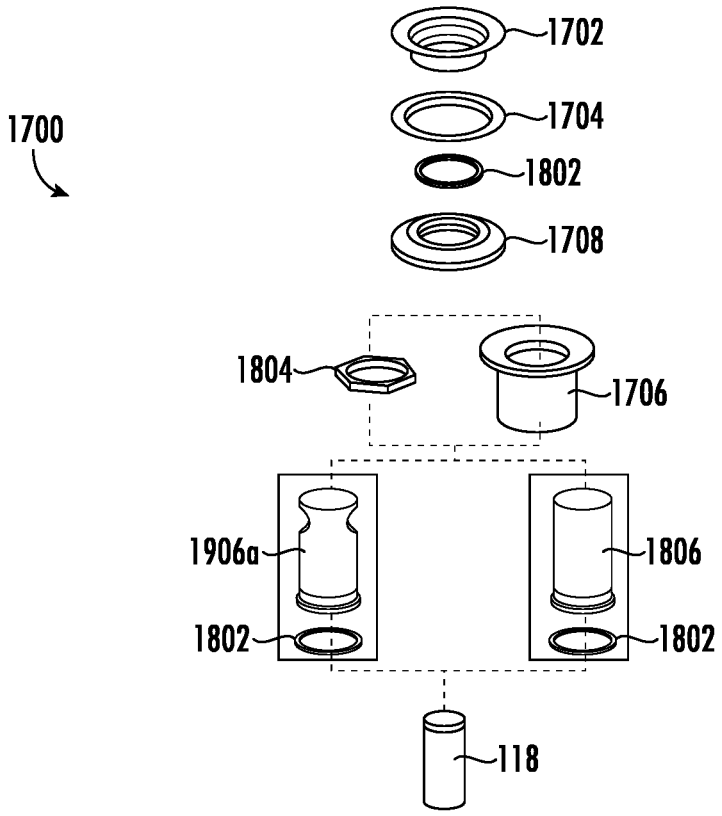
FIG. 19 is an exploded parts view the drain stopper system for a clean drain according to one embodiment.
Figure 20A:
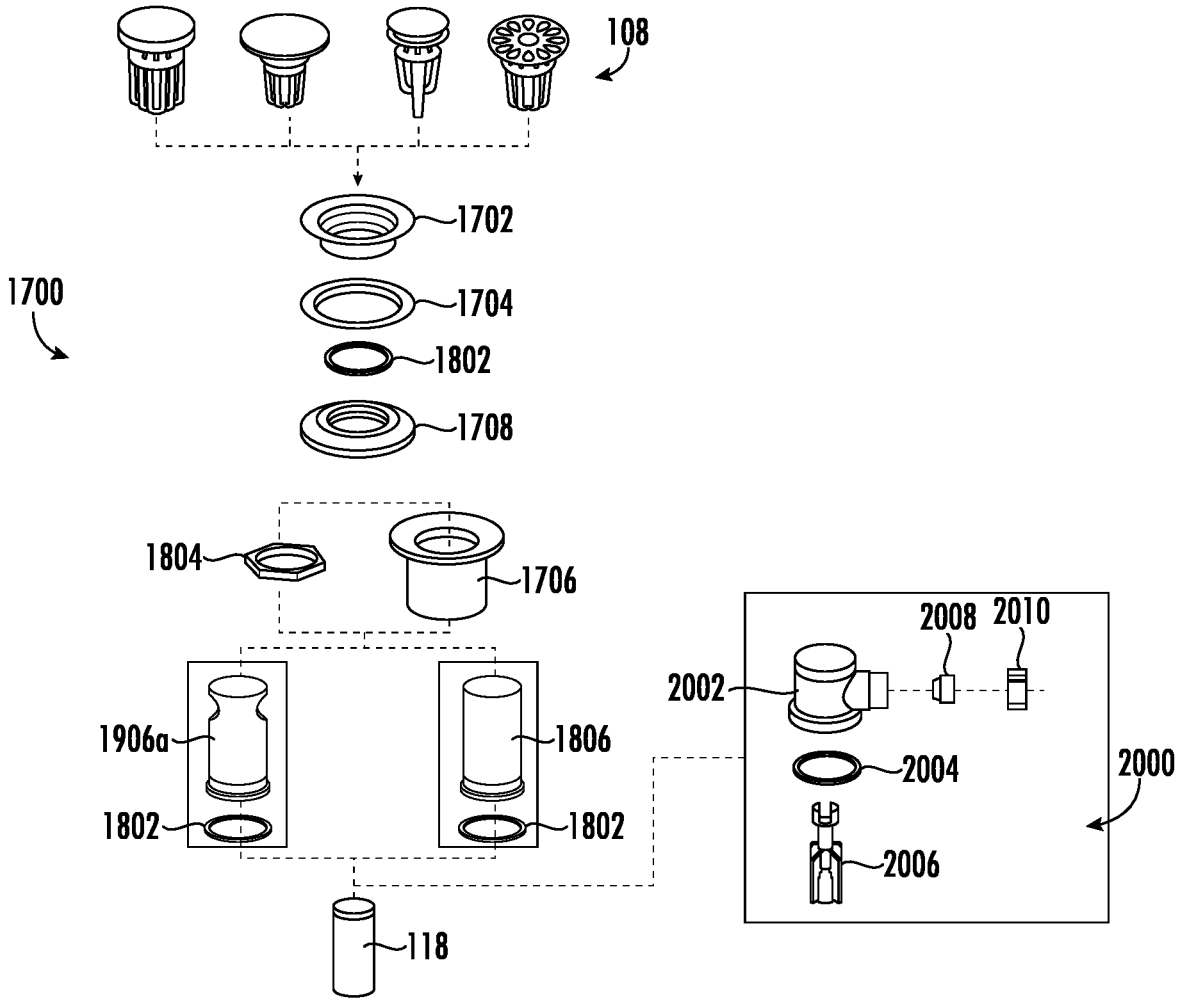
FIG. 20A is an expanded parts view of the components of the interchangeable drain stopper system as shown in FIGS. 17A-17C according to yet another embodiment.

Furthermore, FIG. 20A is an expanded parts view of the embodiment of FIG. 19 with an adapter kit 2000. The adapter kit 2000 includes a pop collar 2002, a pop seal 2004, a pop attachment 2006, a rod seal 2008, and a cap 2010. Furthermore, the adapter kit 2000 includes a pop rod 2012, and a rod opening 2014. The cap 2010 is coupled to the pop collar 2002. The rod seal 2008 is configured to seal the space between the pop collar 2002 and the cap 2010. Furthermore, the rod seal 2008 is configured to seal the space between the pop rod 2012 and the rod opening 2014. The pop collar 2002 can be coupled to the tailpipe cover 1806. The pop collar 2002 may be coupled to either an overflow kit 1906*a* or a non-overflow kit 1906*b*. Furthermore, the pop attachment 2006 is positioned inside the pop collar 2002 and extends vertically upward into the overflow kit 1906*a* or the non-overflow kit 1906*b*. The pop rod 2012 is configured to raise or lower the pop attachment 2006, the pop attachment 2006 coupled to the drain stopper system 108. For example, the pop rod 2012 may be configured to lower and raise the drain stopper system 108. For example, the pop rod 2012 may lower and raise the pop-up system 1500 as shown in FIG. 17B.

As shown in FIG. 20A, various embodiments of the drain stopper system 108 as previously described may be used with the interchangeable drain system 1700.

Figure 20B:
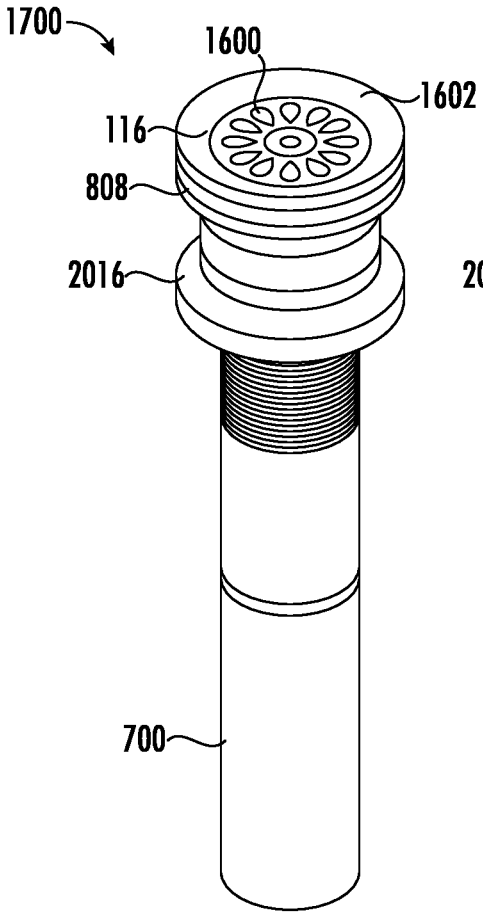
FIGS. 20B, and 20C are a perspective views of the interchangeable drain stopper system shown in FIG. 17A-17C according to another embodiment.
Figure 20C:
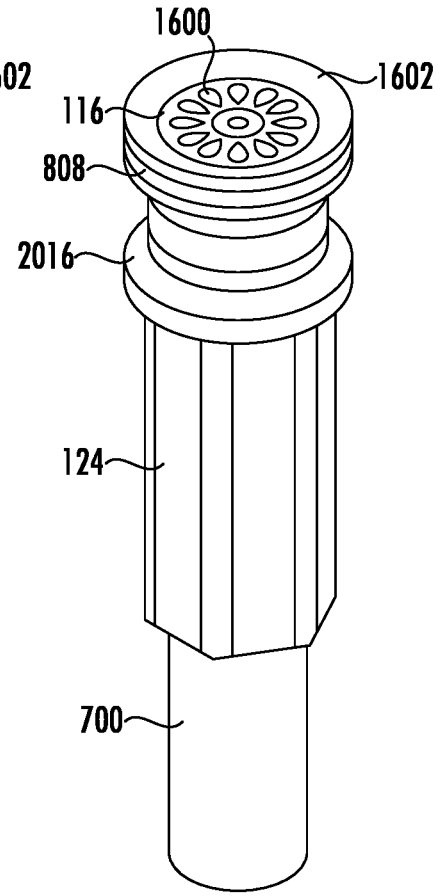
Figure 20D:
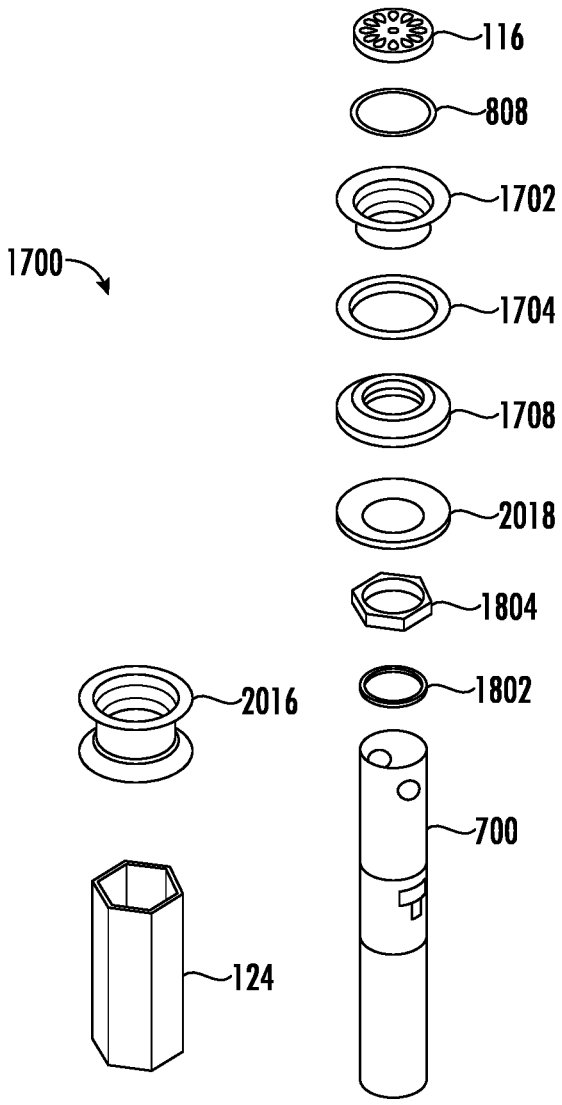
FIG. 20D is an expanded view of the interchangeable drain stopper system as shown in FIGS. 20B-20C according to one embodiment.

FIGS. 20B-20C are perspective views of various drain stopper systems 2000 (e.g., an interchangeable drain system 1700, etc.). FIG. 20D is an exploded parts view of the embodiment shown in FIG. 20B-20C. According to the embodiment, of FIGS. 20B-20C, the drain stopper system 108 includes the drain cover 116. As shown in FIGS. 20B-20C, the drain cover 116 includes the wedged openings 1600 and the angled outer rim 1602. In other embodiments, the cover 116 may include other shaped openings (e.g., annular, circular, slotted, etc.). The drain cover 116 is coupled to the first flange 1702. As previously described, the drain cover 116 is configured to prevent objects or debris (e.g., hair, etc.) from flowing through the drain opening.

The drain system 2000 includes a spacer kit 2016. The spacer kit 2016 is positioned underneath (e.g., below, etc.) the drain cover 116. The spacer kit 2016 is coupled to each of the first flange 1702 and the drain housing 700. The spacer kit 2016 may also be coupled directly to the tailpipe 18. The spacer 2016 is configured to increase (e.g., elongate, etc.) the connection between the drain opening and the tailpipe 118. The drain system 200 may further include a spacer seal, a spacer seal flange, and a nut, all of which aid in coupling and sealing the various components to the drain housing 700 or the tailpipe 118. The drain housing 700 may also include openings that the spacer kit 2016 may be positioned over. For example, the spacer kit 2016 may cover openings on the wall of the drain housing 700.

Figure 21:
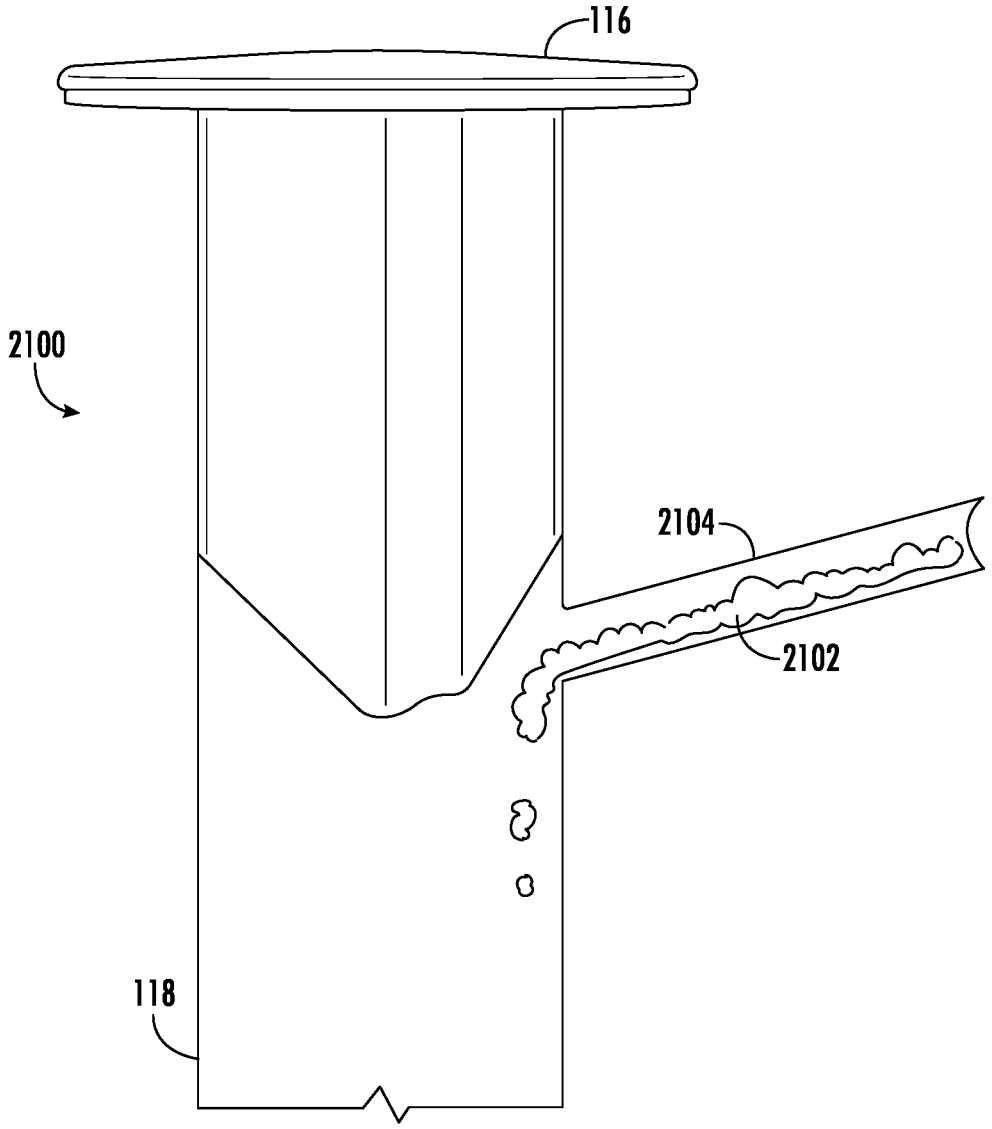
FIG. 21 is a perspective view of a drain stopper and inlet for chemical dosing for a clean drain system according to one exemplary embodiment.

Now referring to FIGS. 21-27, are depictions of various chemical dosing systems 2100 for a clean drain system 100. The chemical dosing system 2100 is configured to controllably release a dose of a chemical agent 2102 into the drain. According to some embodiments, the chemical dosing system 2100 is configured to deliver the chemical agent around the drain stopper and down the drainpipe to prevent clogging. For example, FIG. 21 depicts a perspective view of a chemical dosing system 2100 deployed in a clean drain system 100.

As shown in the embodiment of FIG. 21, the chemical dosing system 2100 includes an inlet tube 2104. The inlet tube 2104 is coupled to the tailpipe 118. In some embodiments, the inlet tube 2104 may dispense a chemical agent 2102 below the drain stopper system 108. Instead, in other embodiments, the inlet tube 2104 may be positioned higher such that the chemical agent 2102 surrounds the drain stopper system 108 and then flows down the tailpipe 118. The chemical agent 2102 may be a liquid or a solid (e.g., a powder, a tablet, etc.)

Figure 22:
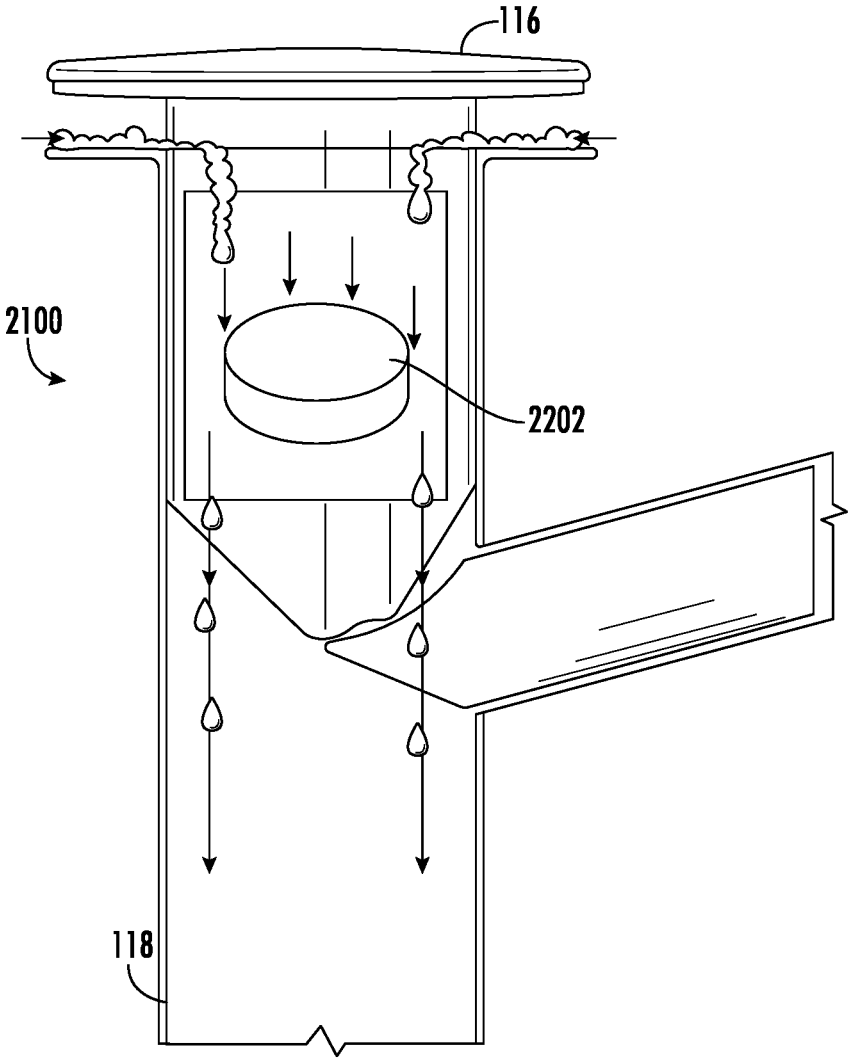
FIG. 22 is a perspective view of a drain stopper including chemical dosing for a clean drain system according to another exemplary embodiment.

Furthermore, FIG. 22 is a cutaway perspective view of yet another embodiment of the chemical dosing system 2100 deployed into a clean drain system 100. According to the embodiment of FIG. 22, the chemical tablet 2202 is a solid (e.g., a tablet, a powder, a capsule, a cake, etc.). The chemical tablet 2202 is positioned within the drain stopper system 108. For example, the drain stopper system may include a cavity or a mesh lining to secure the chemical tablet 2202 within the drain stopper system 108. When the drain stopper system 108 is in an open position, as shown in FIG. 22, water is allowed to flow through the drain opening. The water may flow through the cavity (not shown) where the chemical tablet 2202 is within the drain stopper system 108. For example, the water may flow over the chemical tablet 2202 such that small amounts of the tablet dissolve into the water and flow with the water down the drainpipe to prevent drain clogging around the drain stopper system 108 and further down the tailpipe 118.

Figure 23:
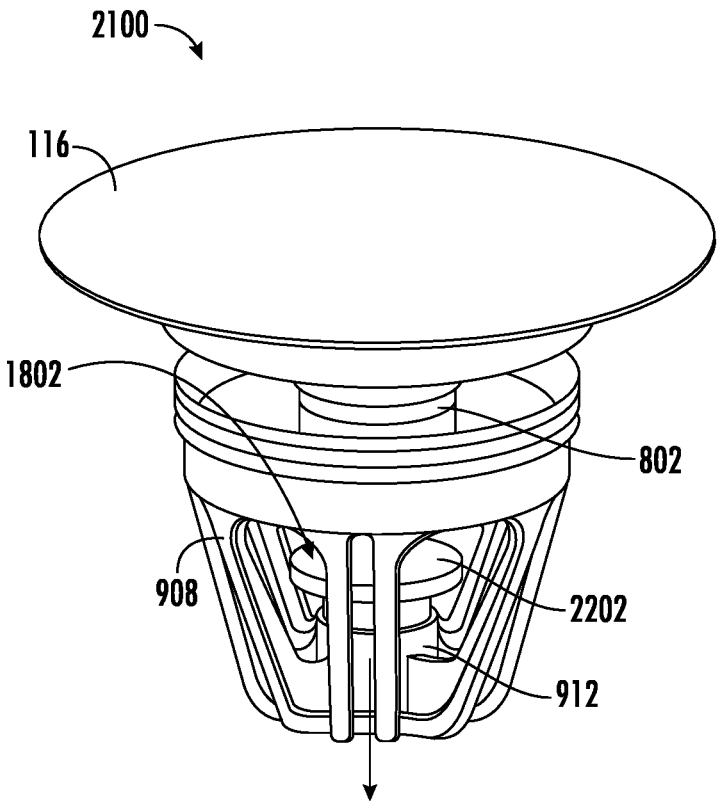
FIG. 23 is a perspective view of a drain stopper with chemical dosing for a clean drain system according to yet another embodiment.
Figure 24:
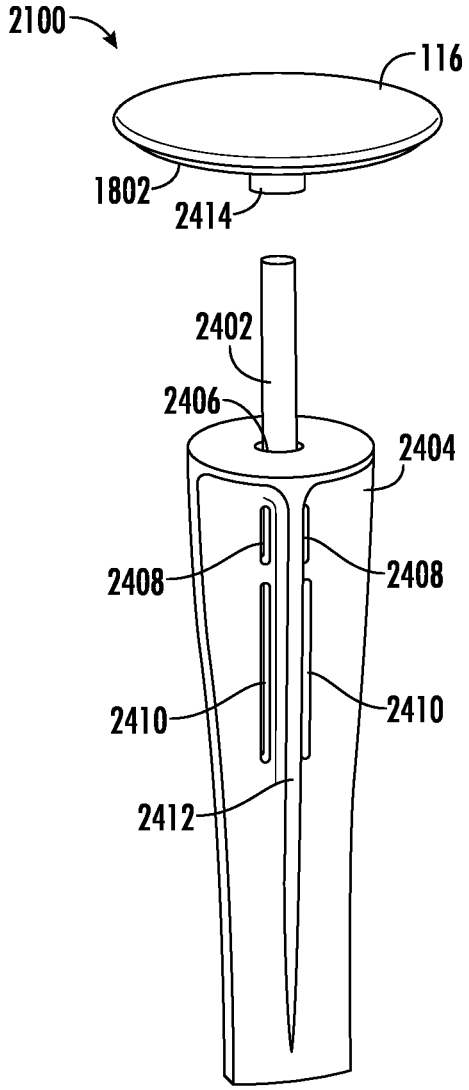
FIG. 24 is an exploded view of a drain stopper with chemical dosing for a clean drain system according to yet another embodiment.
Figure 25:
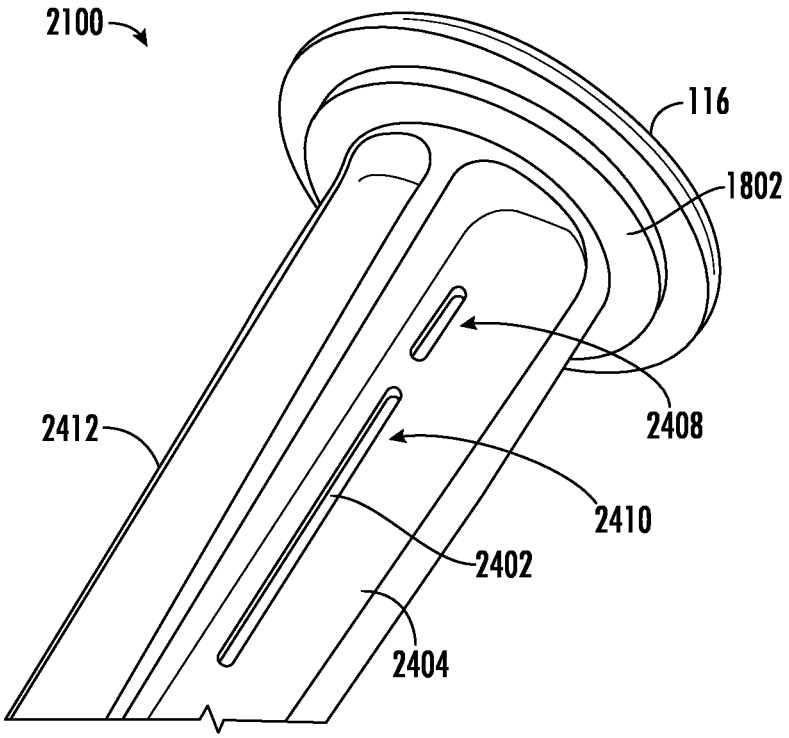
FIG. 25 is a side view of the drain stopper with chemical dosing for a clean drain system according to the embodiment of FIG. 24.

Further shown in the embodiment of FIG. 23 is the chemical dosing system 2100 including the chemical tablet 2202. The chemical tablet 2202 is placed inside of a basket 908. For example, the chemical tablet 2202 may be disposed within the basket 908 of the drain stopper system 108 as shown in the embodiment of FIGS. 8-13.

For example, the chemical tablet 2202 may be a cylindrical tablet as shown in FIG. 23. Instead, in other embodiments, the chemical tablet 2202 may be annular such that a rod or a clicker system may be disposed through the middle of the chemical tablet 2202 to secure the chemical tablet 2202 within the basket 908. For example, water may flow through the drain basket 908, over the chemical tablet 2202, and out the plurality of openings 912 of the basket 908. According to this embodiment, the chemical tablet 2202 may prevent the basket 908 from clogging and building up debris (e.g., hair, dirt, etc.). Furthermore, the chemical tablet 2202 may also prevent the tailpipe (not shown) or piping further below the tailpipe from clogging.

Now referring specifically to the embodiments of FIGS. 24-27, is another embodiment of the chemical dosing system 2100. According to this embodiment, the chemical dosing system 2100 includes the drain cover 116, the drain seal 1802, a chemical tablet rod 2402, and a stopper body 2404. The drain seal 1802 is positioned below the drain cover 116. The drain seal 1802 may have a lesser circumference than the drain cover 116. For example, the drain seal 1802 may not be visible when looking down at the drain cover 116.

The stopper body 2404 defines a chemical tablet basket 2406, a plurality of small windows 2408, and a plurality of large windows 2410. The chemical tablet basket 2406 is positioned at the top of the stopper body 2404 near the drain cover 116. The chemical tablet basket 2406 may house the chemical tablet rod 2402.

The plurality of small windows 2408 may be positioned above the plurality of large windows 2410. The plurality of small windows 2408 and the plurality of large windows 2410 allow drain water to flow into and through the chemical tablet basket 2406. For example, water may flow through the plurality of small windows 2408 and the plurality of large windows 2410 and into the chemical tablet basket 2406. Once inside the chemical tablet basket 2406, the water may interact with the chemical tablet rod 2402. For example, a portion of the chemical tablet rod 2402 may dissolve into the water.

Furthermore, the stopper body 2404 includes a plurality of supports 2412. The plurality of supports 2412 provide structure to the stopper body 2404 while allowing space for water to flow around the stopper body 2404 and down the drain.

The drain cover 116 further includes a cover connector 2414. The cover connector 2414 is coupled to the drain seal 1802. The cover connector 2414 may include a threaded portion (e.g., a screw). The cover connector 2414 is configured to secure the drain cover 116 to the stopper body 2404. The cover connector 2414 is further configured to seal the chemical tablet basket 2406. For example, the cover connector 2414 may be screwed into the chemical tablet basket 2406 to seal the top portion of the chemical tablet basket 2406 and couple the drain cover 116 to the stopper body 2404.

Furthermore, the drain cover 116 is removably coupled to the stopper body 2404. For example, the drain cover 26 may be removed (e.g., unscrewed, uncoupled, etc.) from the stopper body 2404. For example, the user may remove the drain cover 116 from the stopper body 2404 to place a new chemical tablet rod 2402 when the previous one has dissolved away.

Figure 26:
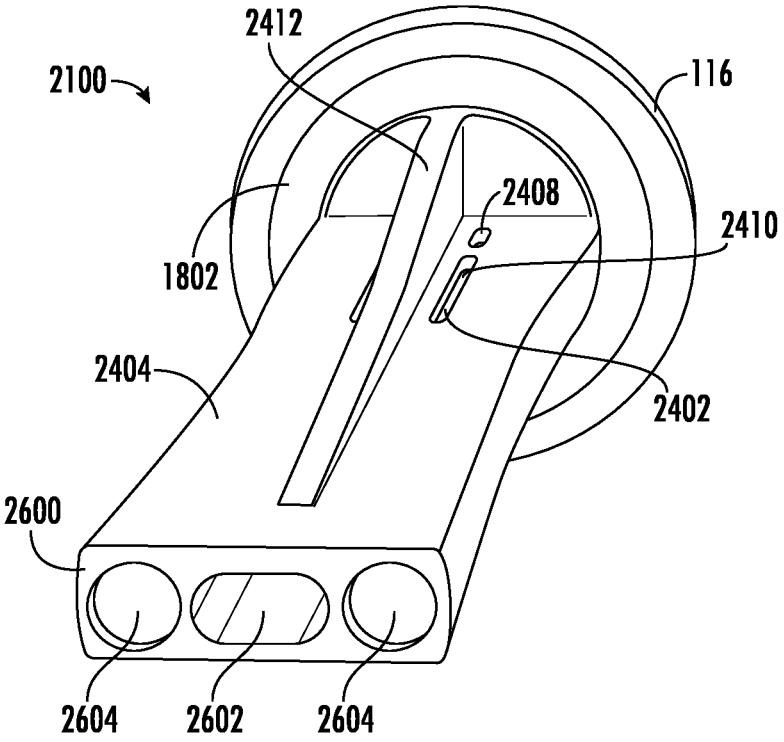
FIG. 26 is a bottom perspective view of the drain stopper with chemical dosing for a clean drain system according to the embodiment of FIG. 24.
Figure 27:
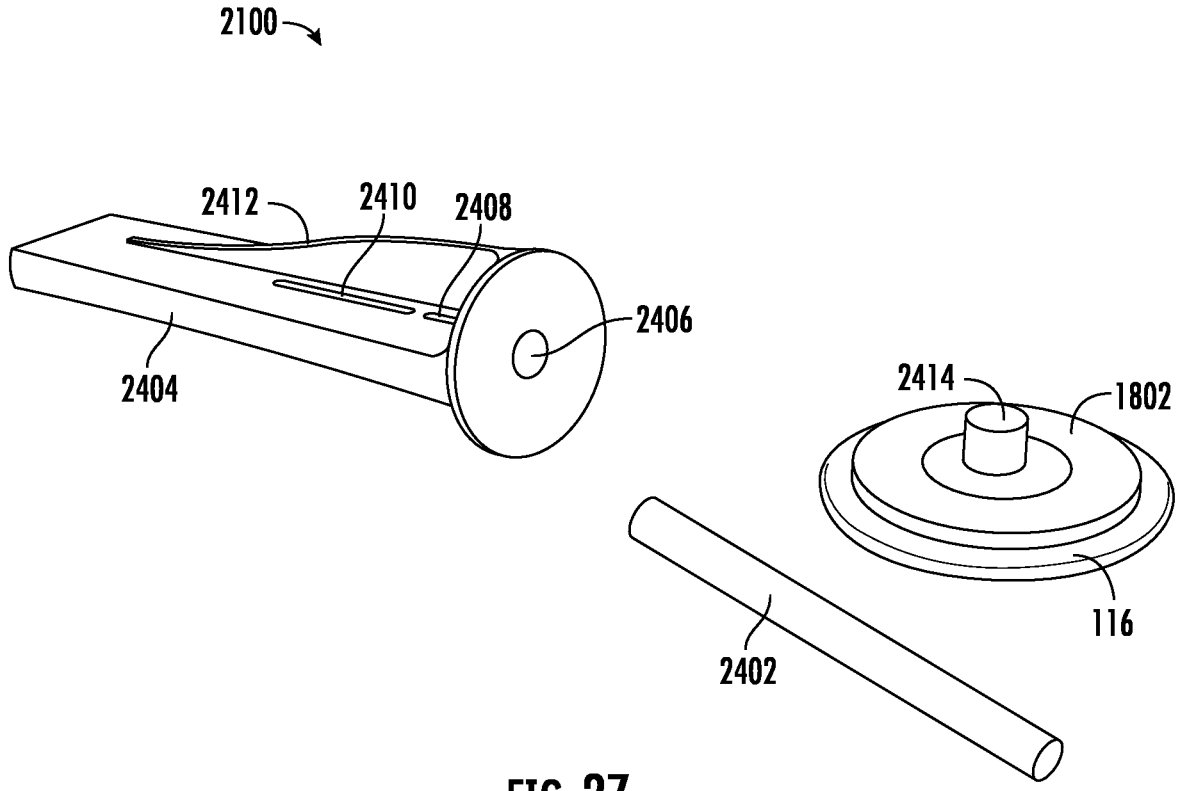
FIG. 27 is a parts view of the drain stopper with chemical dosing for a clean drain system according to the embodiment of FIG. 24.

FIG. 26 illustrates a bottom view of the stopper body 2404 of the chemical dosing system 2100. The stopper body 2404 includes a bottom surface 2600. The bottom surface 2600 includes a passage 2602 and a plurality of magnets 2604 (e.g., neodymium magnets, etc.). The passage 2602 may be positioned in the center of the bottom surface 2600. For example, the passage 2602 may extend up through the stopper body 2404. For example, the passage 2602 is in fluid communication with the chemical tablet basket 2406. For example, water that includes an amount of dissolved chemical (e.g., sanitized water, clean water, etc.) from the chemical tablet rod 2402 may flow downward through the stopper body 2404 via the passage 2602. The sanitized water may then exit the stopper body 2404 at the bottom surface 2600 and continue to flow through the drain. The sanitized water may also prevent clogging of the drain further down from the stopper body 2404.

The plurality of magnets 2604 are positioned around the passage 2602. For example, the stopper body 2404 may include a first magnet 2604 positioned to the left of the passage 2602 and a second magnetic positioned to the right of the passage 2602. The plurality of magnets 2604 are configured to lift to the stopper body 2404, including the drain cover 116, up and down along a vertical axis. For example, the plurality of magnets 2604 may interact with a controlling device (not shown) (e.g., another magnet, an electronic system, a battery powered system, etc.). For example, the plurality of magnets 2604 may attract or repel a controlling magnet. For example, if the plurality of magnets 2604 may repel the controlling magnet when the drain cover 116 and the stopper body 2404 are positioned in an open position. Instead, in a closed position, the plurality of magnets 2604 may be attracted to the controlling magnet to pull the drain cover 116 and the stopper body 2404 downward to seal the drain opening.

Now referring generally to FIGS. 28-33 is a magnetic drain stopper system 2800 for a clean drain system 100.

Figure 28:
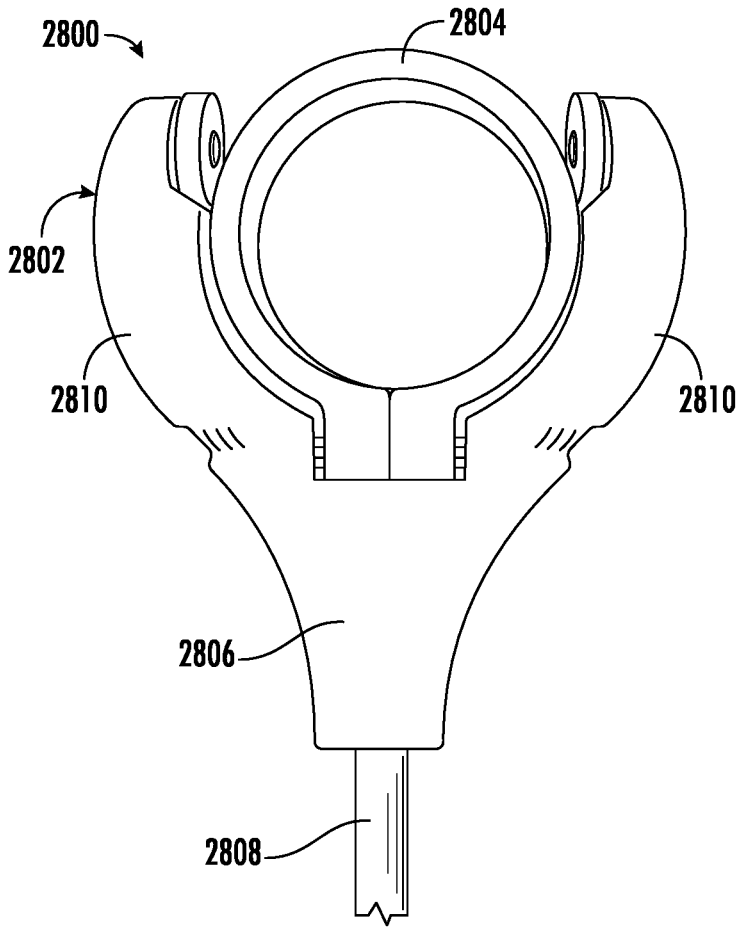
FIG. 28 is a top-down view of a magnetic stopper system according to one embodiment.
Figure 29:
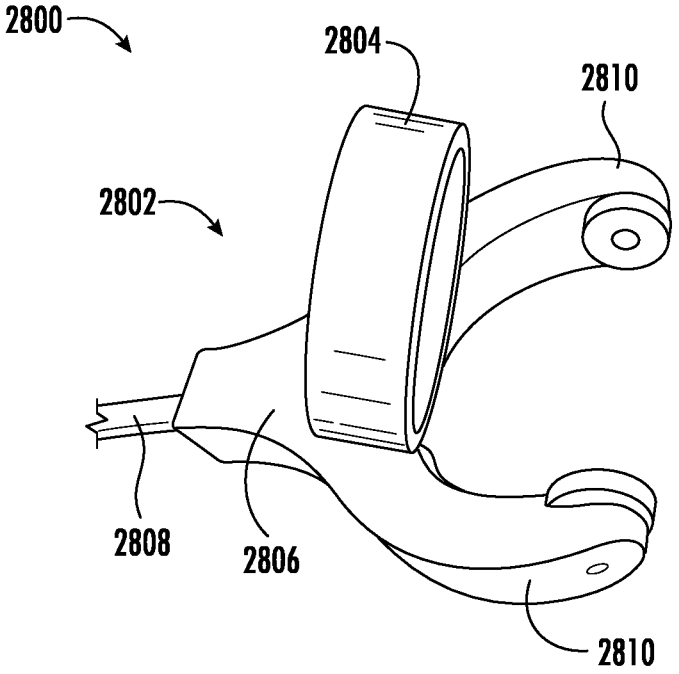
FIG. 29 is a perspective view of the magnetic stopper system of FIG. 28.
Figure 30:
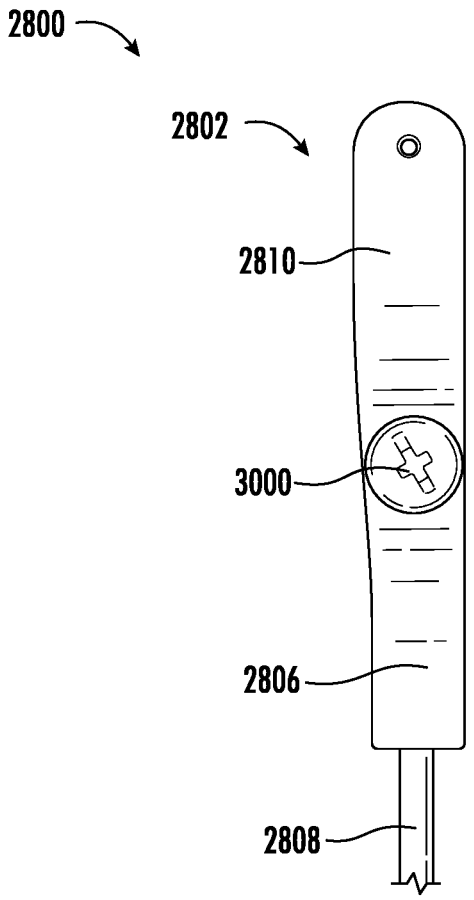
FIG. 30 a side view of the magnetic stopper system of FIG. 28.

Specifically referring to FIGS. 28-30 are perspective views of a lever system 2802 for a magnetic drain stopper system 2800. The lever system 2802 includes an annular ring 2804, an outer body 2806, and lever rod 2808. The outer body 2806 further includes arms 2810. The annular ring 2804 is coupled to the outer body 2806. The outer body 2806 is also coupled to the lever rod 2808.

As shown in FIG. 30, the annular ring 2804 is coupled to the outer body 2806 by a pin (e.g., a screw, rod, etc.) 3000. For example, the pin 3000 is a hinge for the annular ring 2804 to move relative to the arms 2810.

Figure 31B:
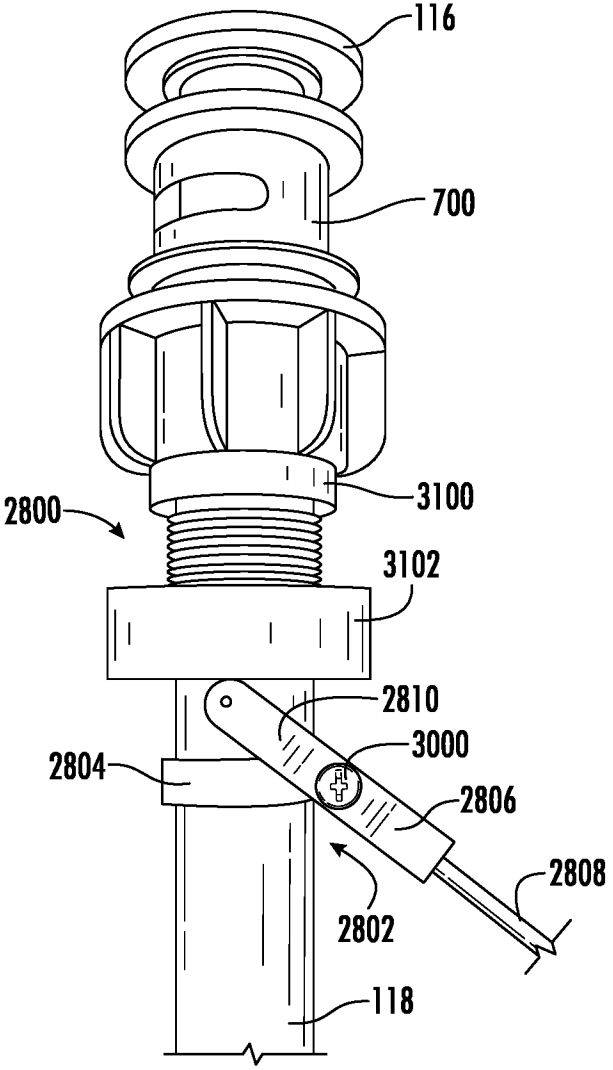
FIG. 31A-FIG. 31B are perspective view of a drain stopper system with a magnetic stopper system for a clean drain system according to one embodiment.
Figure 31A:
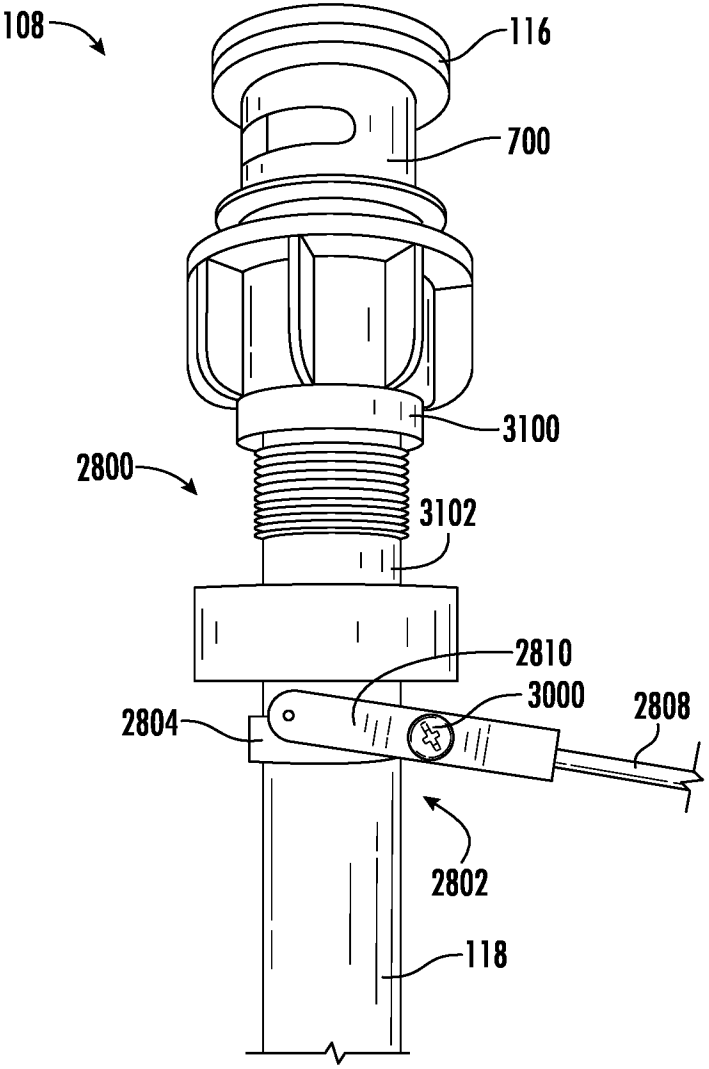

Now referring to FIGS. 31A-31B are perspective views of the lever system 2802 deployed in the magnetic drain stopper system 2800. FIG. 27A illustrates the magnetic drain stopper system 2800 in a closed position. FIG. 27B illustrates the magnetic drain stopper system 2800 on an open position. The magnetic drain stopper system 2800 includes the drain cover 116, the drain cover seal 1802, the drain housing 700, a housing magnet 3100, and a magnetic annular ring 3102. The tailpipe 118 is disposed within the annular ring 2804. The annular ring is secured to the tailpipe 118. The housing magnet 3100 is coupled to the drain housing 700. The magnetic annular ring 3102 is positioned on the tailpipe 118 above the annular ring 2804 and below the housing magnet 3100.

As shown in FIG. 31A, when the magnetic drain stopper system 2800 is in a closed position, the arms 2810 are flush (e.g., in line with, in the same horizontal plane, etc.) with the annular ring 2804. The housing magnet 3100 is positioned a first distance away from the magnetic annular ring 3102 such that the magnets are not drawn (e.g., attracted, pulling towards, etc.) towards each other.

As shown in FIG. 31B, the lever rod 2808 can be moved a distance downward. For example, the lever rod 2808 may be coupled to another rod and a switch. The user may be able to flip the switch to pull the lever rod 2808 downward. As the lever rod 2808 moves downward, the arms 2810 rotate upward to contact the magnetic annular ring 3102. The arms 2810 push the magnetic annular ring 3102 a distance upward toward the housing magnet 3100 causing the housing magnet 3100 to attract the magnetic annular ring 3102. The attraction between the housing magnet 3100 and the magnetic annular ring 3102 causes the drain housing 700 to move with the housing magnet 3100 downward towards the magnetic annular ring 3102 to open the drain.

Figure 32:
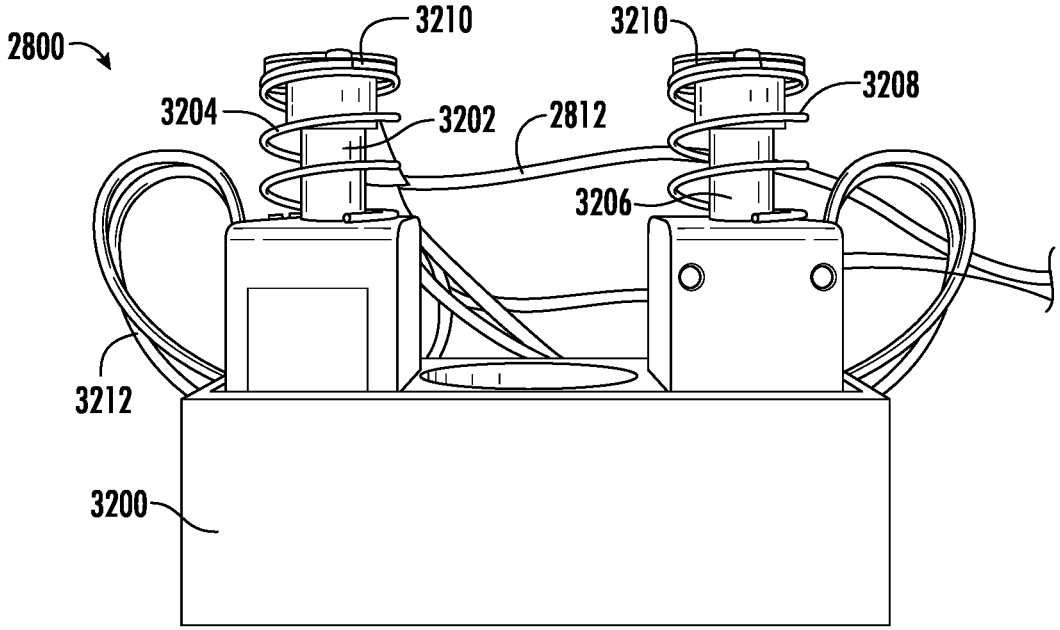
FIG. 32 is a front view of a magnetic stopper system for a clean drain system according to another exemplary embodiment.
Figure 33:
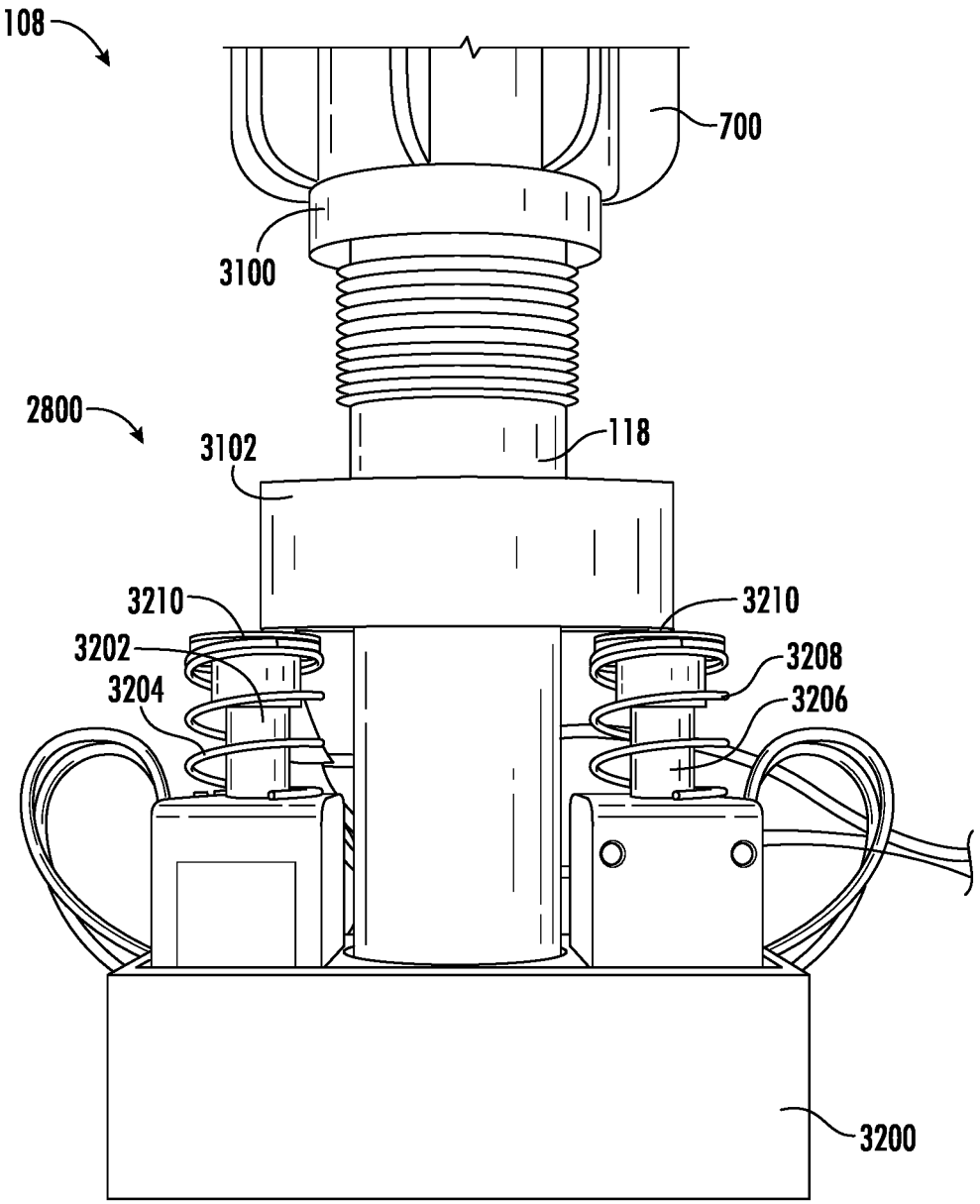
FIG. 33 is a front view of a drain stopper system deployed in the magnetic stopper system of the embodiment of FIG. 32.

Now referring generally to FIG. 32-33 is the magnetic drain stopper system 2800 for a clean drain system 100 according to another embodiment. The magnetic drain stopper system 2800 includes a base complex 3200, a first piston 3202, a first spring 3204, a second piston 3206, and a second spring 3208. The first piston 3202 and the second piston 3206 are coupled to the base complex 3200. The first spring 3204 surrounds the first piston 3202. For example, the first piston 3202 is positioned in the center of the first spring 3204. The second spring 3208 is surrounded by the second spring 3208. For example, the second spring 3208 is positioned in the center of the second spring 3208.

The first piston 3202 and the second piston 3206 include feet 3210. The feet 3210 are positioned on the end of the first piston 3202 and the second piston 3206. The feet 3210 contact the bottom of the magnetic annular ring 3102.

The magnetic drain stopper system 2800 further includes a plurality of wires 3212. The base complex 3200 includes a battery (not shown). The battery is coupled to the wires 3212. According to this embodiment, the battery is configured to power a solenoid (not shown). The solenoid is positioned in the base complex 3200. When the magnetic drain stopper system 2800 is activated, electrical current flows through the solenoid, activating the solenoid such that the magnetic annular ring 3102 is attracted to the solenoid. According to this embodiment, the solenoid only moves the first piston 3202 and the second piston 3206 in one direction (e.g., downward).

To deactivate the magnetic drain stopper system 2800, the battery is turned off and no electrical current flows through the solenoid. The first spring 3204 and the second spring 3208 are configured to return the first piston 3202 and the second piston 3206 to their resting (e.g., default, a first, etc.) position, thus returning the magnetic annular ring 3102 to its resting position.

In other embodiments, the solenoid may be a dual action solenoid. For example, the solenoid may be configured to pull the first piston 3202 and the second piston 3206, including the plurality of feet 3210, downward and return the first piston 3202 and the second piston 3206 and their corresponding feet 3210 back to their resting or default position.

In other embodiments, the base complex 3200 may include a plurality of solenoids. The solenoids may only require electrical current to actuate in one direction, while in other embodiments the solenoids may require electrical current to actuate in multiple directions.

In yet another embodiment, the wires 3212 are coupled to a motor (not shown). The battery is configured to power the motor to move the first piston 3202 and the second piston 3206 upwards a distance. For example, as the first piston 3202 and the second piston 3206 move a distance upward, the feet 3210 push the magnetic annular ring 3102 a distance upward toward the housing magnet 3100. As the magnetic annular ring 3102 moves closer to the housing magnet 3100, the housing magnet 3100 is attracted to the magnetic annular ring 3102. For example, the magnet housing is pulled a distance downward, with the drain housing 700, to open the drain and allow water to flow down the tailpipe 118.

Instead in other embodiments, the magnetic drain stopper system 2800 may include one or a plurality of solenoids, motors, actuators, pneumatic or hydraulic pistons or cylinders. Another embodiment may include a servo or step motor attached to an eccentric cam that could raise and lower the magnetic annular ring 3102 as it rotates through a cycle.

In some embodiments, the magnetic drain stopper system 2800 may include a single magnetic annular ring 3102. In other embodiments the magnetic drain stopper system 2800 may include a plurality of magnetic annular rings 3102. The plurality of magnetic annular rings 3102 may be of varying thickness, diameter, and overall shape (e.g., varying dimensions, varying sizes, etc.). For example, the number and shape of magnetic annular rings 3102 may depend on the drain stopper used with the magnetic drain stopper system 2800.

Furthermore, the magnetic drain stopper system 2800 may also be electronically controlled (e.g., electronic drain stopper system, magnetic electronic drain stopper system, electro-magnetic drain stopper system, etc.) 2802 may be configured to automatically control the drain stopper system 108. For example, the magnetic drain stopper system may further include a plurality of circuits, a plurality of sensors, and a plurality of controllers (not shown) in an electronic circuit creating electronic device. The electronic circuit creating electronic device may be positioned within the base complex 3200.

The electronic device may be powered by a battery or electrically coupled to a wall outlet (e.g., 120V outlet, etc.). The electronic device may be further coupled to a plurality of sensors (e.g., infrared (IR) sensors, etc.). The IR sensors may be positioned on the faucet. For example, the user may wave their hands in front of the faucet within a predetermined area (e.g., zone, etc.). The IR sensors may detect the motion and activate the magnetic drain stopper system 2800. For example, the electro-magnetic drain stopper system 2800 may be configured to close the drain stopper system 108 when the user waves a first time within the predetermined zone. For example, the drain stopper system 108 may held in a closed position.

Furthermore, when the user waves a second time within the predetermined zone, the electro-magnetic drain stopper system 2800 may be configured to open the drain stopper system 108 such that water may flow down the drain opening.

In other embodiments the electro-magnetic drain stopper system 2800 may be configured to close the drain stopper system 108 after a first wave and then open the drain stopper system after a predetermined period of time (e.g., 2 seconds, 5, seconds, 10 seconds, etc.). The predetermined period of time may be customized to user preference.

In yet another embodiment, the plurality of sensors may be configured to sense a critical level. For example, the plurality of sensors may be configured to detect water at or above the critical level. For example, if water is at or above the critical level, the plurality of sensors may be configured to activate the electro-magnetic drain stopper system 2800 to open the drain stopper system 108 to prevent water from overflowing. According to this embodiment, the plurality of sensors may be positioned on the faucet, near the faucet, below the faucet, in a tub, or in a sink basin. This embodiment may be included in a bathtub, a sink, a shower configuration, or any other water holding fixture.

Figure 34:
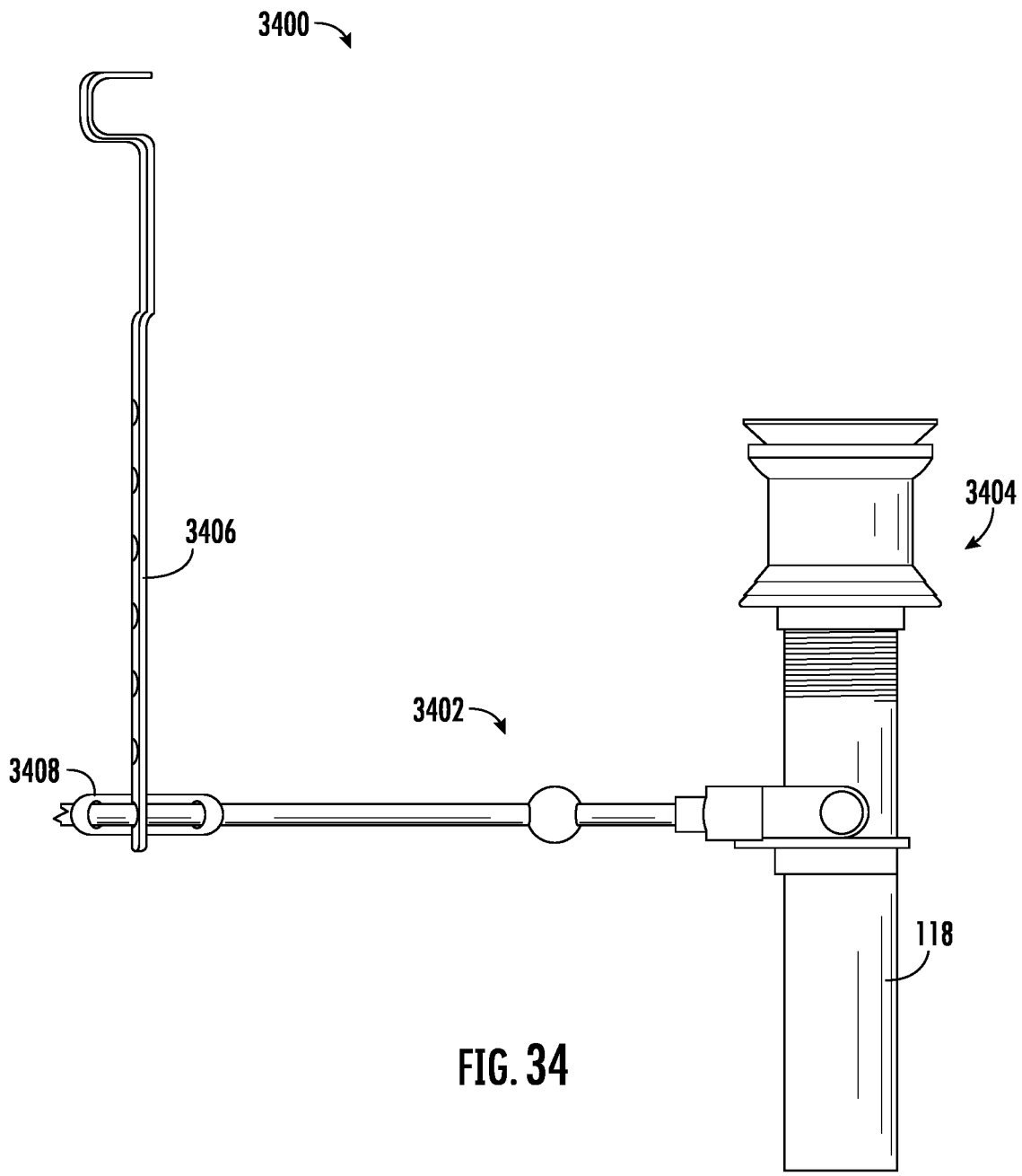
FIG. 34 is a side view of a drain stopper system with a magnetic stopper system for a clean drain system according to another embodiment.
Figure 35:
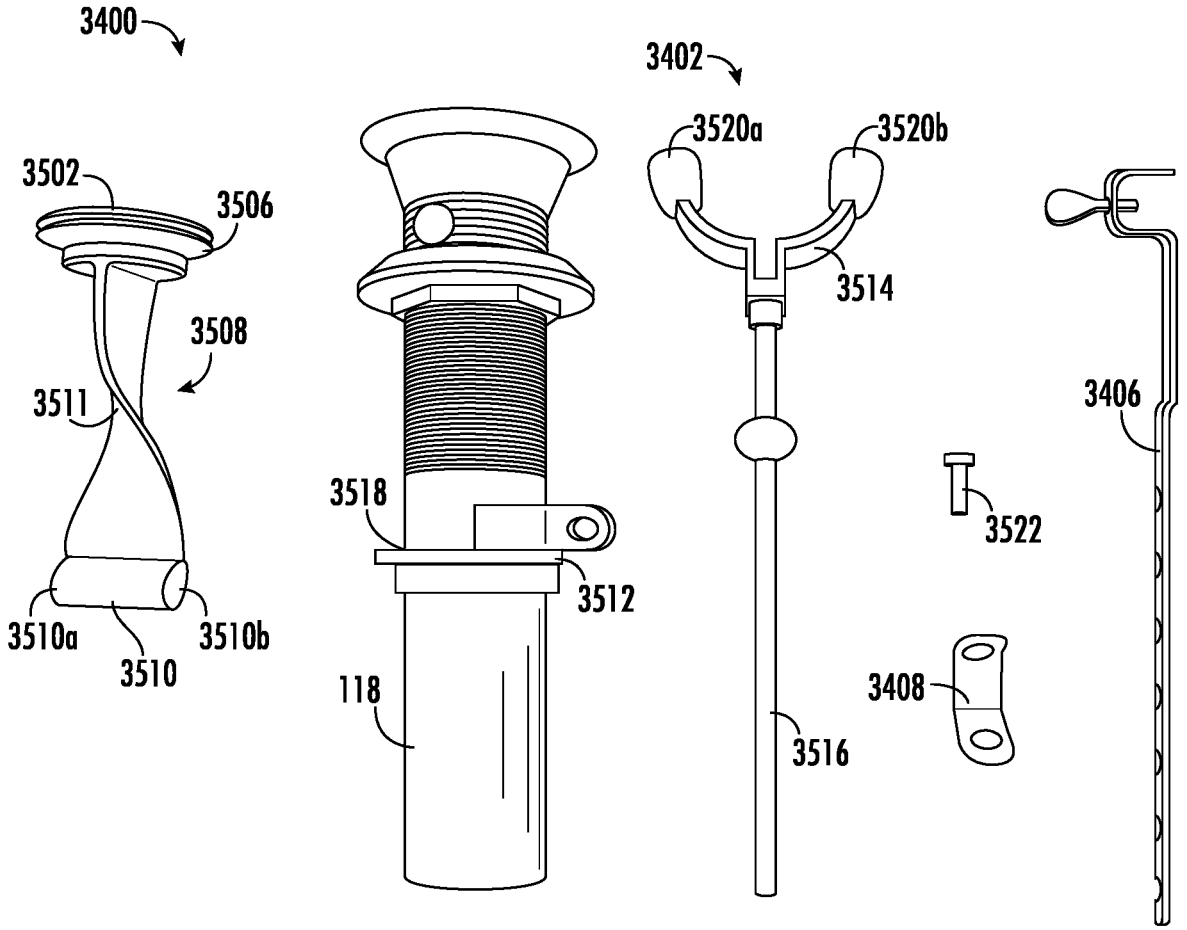
FIG. 35 is a parts view of the drain stopper system with the magnetic stopper system for a clean drain system according to the embodiment of FIG. 34.
Figure 36:
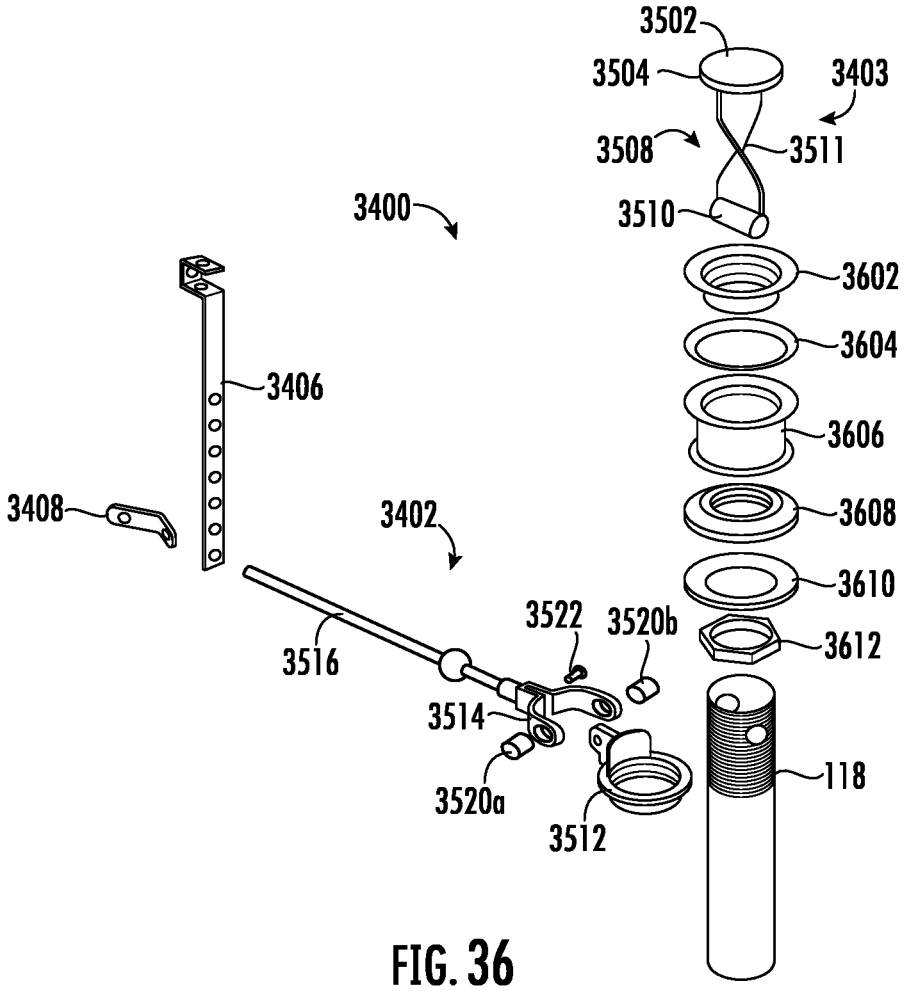
FIG. 36 is an exploded view of the drain stopper system with a magnetic stopper system for a clean drain system according to the embodiment of FIG. 34.

Now referring to FIGS. 34-36 is the magnetic drain stopper system 3400 according to another embodiment. According to this embodiment, the magnetic drain stopper system 3400 includes the lever system 3402, and a magnetic drain stopper 3404. The magnetic drain stopper 3404 is positioned in the tailpipe 118. The magnetic drain stopper 3404 is configured to selectively opening and close a drain opening.

The lever system 3402 is positioned around at least a portion of the tailpipe 118. The lever system 3402 is configured to selectively move the drain stopper 3404 down into the drain opening to prevent the flow of water down the drain opening.

The lever system 3402 of the magnetic drain stopper system 3400 is then coupled to an existing pop-up linkage 3406. For example, the lever system 3402 may be positioned through a first end of a bracket 3408, the existing pop-up linkage 3406 and then through a second end of the bracket 3408.

As shown in FIG. 35-36, the magnetic drain stopper 3404 includes a drain cover 3502, a drain seal 3506, a stopper body 3508, and at least one magnet 3510. Each of the drain cover 3502 and the drain seal 3506 are coupled to an end of the stopper body 3508. The drain cover 3502 is positioned above the drain seal 3506. The drain cover 3502 is configured to fit flush within the drain opening when in a closed position. The drain seal 3506 is configured to seal the drain cover 3502 to the drain opening to prevent the flow of water or debris down the drain.

According to this embodiment, the stopper body 3508 includes a tapered portion 3511. The tapered portion 3511 allows water to flow down through the drain between the stopper body 3508 and an interior surface of the tailpipe 118.

The at least one magnet 3510 is coupled to an end of the stopper body 3508 opposite the drain cover 3502. The at least one magnet 3510 may be bar-like, or cylindrical in shape. For example, the at least one magnet 3510 may be run (e.g., be positioned, etc.) substantially perpendicular to the stopper body 3508. In other embodiments, the at least one magnet 3510 may include a first magnet 3510*a* and a second magnet 3510*b*. The first magnet 3510*a* and the second magnet 1510*b* are positioned on the end of the stopper body 3508 opposite each other. The at least one magnet 3510 is configured to engage with another magnet within the magnetic drain stopper system 3400. When the at least one magnet 3510 is engaged with another magnet, the drain stopper 3404 is moved (e.g., pulled, etc.) downward such that the drain cover 3502 is positioned within the drain opening preventing the flow of water down the drain.

Also shown in FIG. 35-36, is the lever system 3402. The lever system 3402 includes a tailpipe attachment 3512, a magnetic attachment 3514, and a lever arm 3516. The tailpipe attachment 3512 is coupled to each of the tailpipe 118 and the magnetic attachment 3514. The tailpipe attachment 3512 is positioned around at least a portion of the circumference of the tailpipe 118. For example, in this embodiment, the tailpipe attachment 3512 includes an opening 3518 such that the tailpipe attachment can be snapped (e.g., pressed on, etc.) the tailpipe 118. The tailpipe attachment 3512 is configured to secure the lever system 3402 to the tailpipe 118.

The magnetic attachment 3514 is positioned around the tailpipe attachment 3512. For example, the magnetic attachment 3514 surrounds the tailpipe attachment 3512 and therefore also surrounds a portion of the tailpipe 118. The magnetic attachment 3514 is secured to the tailpipe attachment 3512 by at least one screw 3522. The magnetic attachment 3514 is configured to house a first magnet 3520*a* and a second magnet 3520*b*. The second magnet 3520*b* is positioned opposite the first magnet 3520*a*. The first magnet 3520*a* and the second magnet 3520*b* are positioned on opposite sides of the tailpipe 118. The first magnet 3520*a* and the second magnet 3520*b* are configured to engage with the at least one magnet 3510 of the drain stopper 3404 through the tailpipe 118.

The lever arm 3516 may vary in length depending on the arrangement of the drain opening and the existing pop-up linkage 3406. One end of the lever arm 3516 is coupled to the magnetic attachment 3514. Another end of the lever arm 3516 is coupled to the existing pop-up linkage 3406. The lever arm 3516 is configured to pivot the magnetic attachment 3514 about the at least one screw 3522. For example, the magnetic attachment 3514 can pivot upwards out of the tailpipe attachment 3412 to engage with the at least one magnet 3510 of the drain stopper 3404. For example, the tailpipe attachment 3512 may prevent the first magnet 3520*a* and the second magnet 3520*b* of the magnetic attachment 3514 from engaging with the at least one magnet 3510 of the drain stopper 3404.

FIG. 36 is an expanded view of the magnetic drain stopper system 3400. The magnetic drain stopper system further includes a flange 3602 and a flange seal 3604 positioned in the drain opening. The magnetic drain stopper system 3400 may further include a spacer 3606. In some embodiments, the magnetic drain stopper system 3400 does not include the spacer 3606. The spacer 3606 is configured to increase (e.g., elongate, etc.) the connection between the drain opening and the tailpipe 118. The magnetic drain stopper system may further include a spacer seal 3608, a spacer seal flange 3610, and a nut 3612, all of which aid in coupling and sealing the various components to the tailpipe 118.

Figure 37:
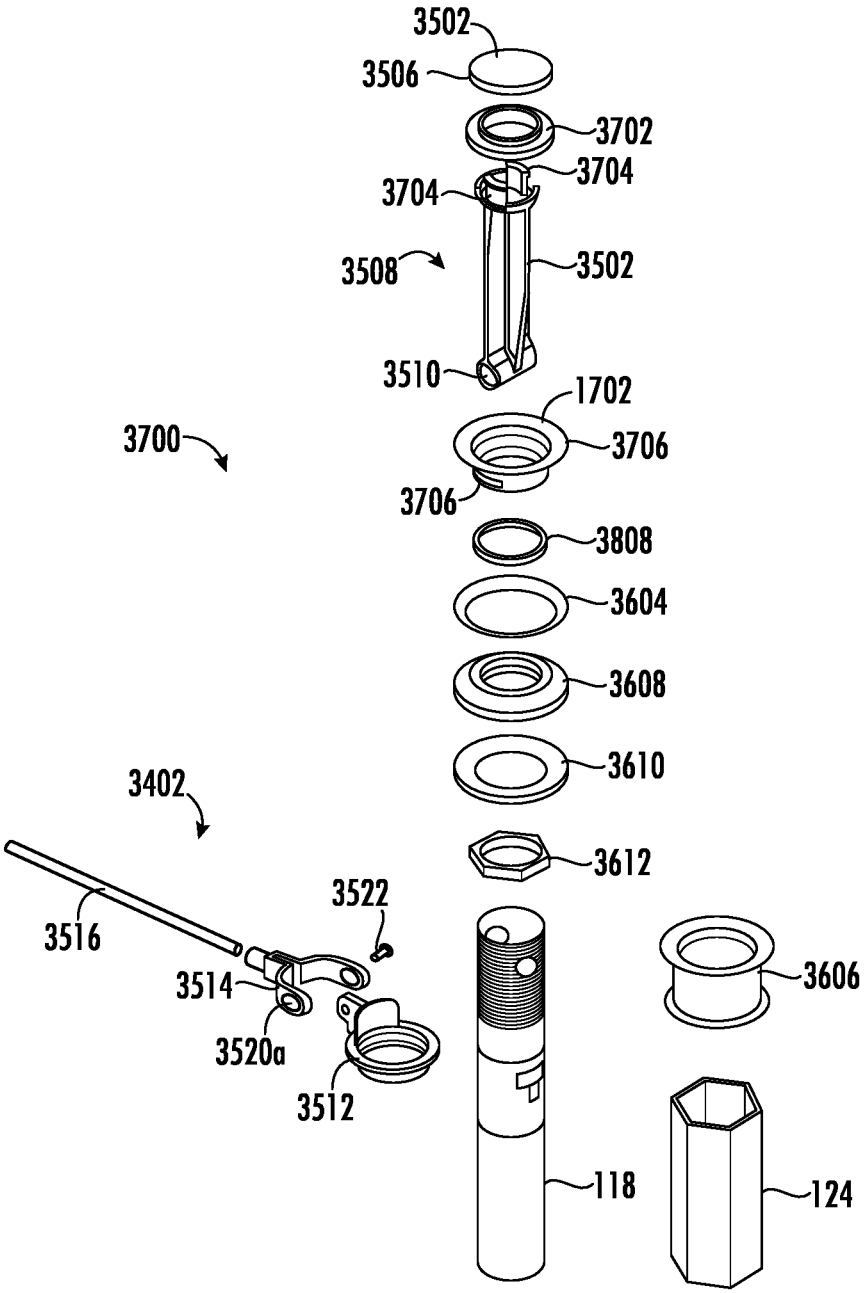
FIG. 37 is an exploded view of the drain stopper system with a magnetic stopper system for a clean drain system of FIG. 34 according to another embodiment.

FIGS. 37-39C illustrate the magnetic drain stopper system 3700 according to another embodiment. The magnetic drain stopper system 3700 may include various similar features to the magnetic drain stopper system 3400. FIG. 37 is an expanded view of the magnetic drain stopper system 3700 according to another embodiment. The magnetic drain system 3700 is similar to the embodiment of the magnetic drain stopper system 3400 as previously described.

As shown in FIG. 37, the drain stopper system 3700 includes a stopper seal 3702. The stopper seal 3702 is positioned directly beneath the drain cover 3502 and above the drain stopper body 3508. For example, the stopper seal 3702 is positioned between the drain cover 3502 and an upper edge of the drain stopper body 3508. The stopper seal 3702 is configured to prevent the flow of fluid and debris through the drain opening when the drain cover is in a closed position (e.g., a sealed position, etc.).

According to this embodiment, the drain stopper body 3508 includes at least one tab 3704. As shown in FIG. 37, the stopper body 3508 includes two tabs 3704 positioned opposite each other on the upper edge of the drain body 3508. Further, the first flange 1702 includes at least one flange opening 3706. As shown in FIG. 37, the first flange 1702 includes two flange openings 3706 opposite each other. The flange openings 3706 are configured to receive the tabs 3704. For example, the tabs 3704 are positioned within the flange openings 3706 to couple the stopper body 3508 to the first flange 1702.

Figure 38:
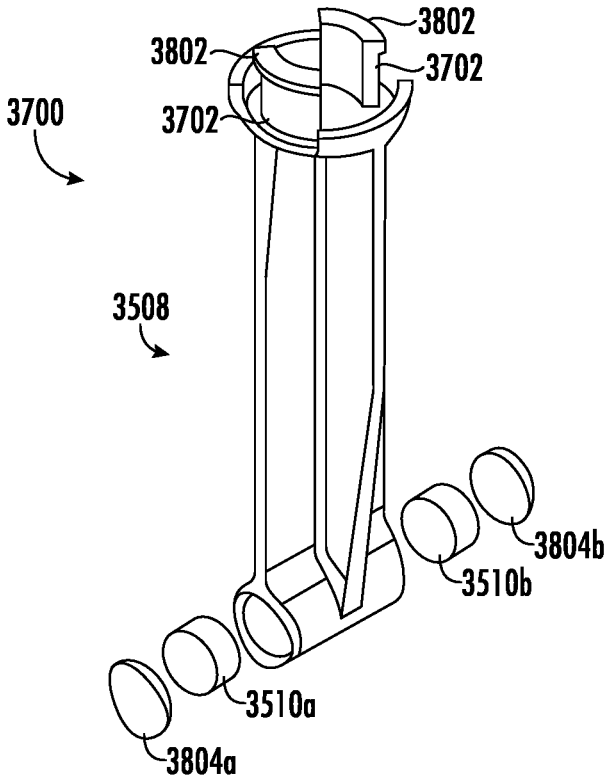
FIG. 38 is an exploded view of the magnetic drain stopper body according to the embodiment of FIG. 38.

FIG. 38 is a perspective view of the drain stopper body with a portion of the drain stopper body 3508 expanded. As previously described the drain stopper body 3508 includes tabs 3704 positioned on an upper edge of the drain stopper body 3508. The tabs 3704 include protrusions 3802. The protrusions 3802 engage with the flange openings 3706. For example, the protrusions 3802 may rest on an edge of the flange openings 3706 preventing the drain stopper body from moving downwards in the drain housing towards the tailpipe.

The drain stopper body 3508 also includes the at least one magnet 3510. According to this embodiment, the drain stopper body 3508 includes a first magnet 3510*a* and a second magnet 3510*b*. The second magnet 3510*b* is positioned opposite the first magnet 3510*a*. The magnets 3510 are configured to engage with the corresponding magnetic attachment 3514.

The drain stopper body 3508 further includes a plurality of magnet covers 3804. For example, the drain stopper body 3508 includes a first magnet cover 3804*a* positioned over the first magnet 3510*a* and a second magnet cover 3804*b* positioned over the second magnet 3510*b*.

Figure 39A:
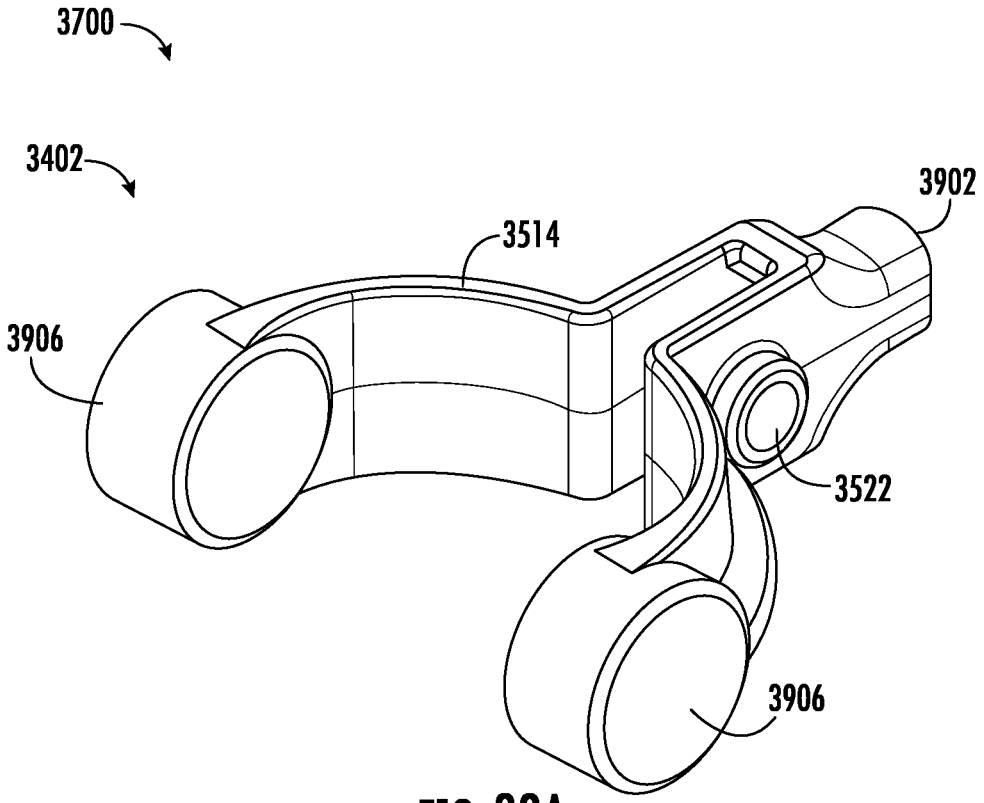
FIG. 39A is a perspective view of a portion of the lever system of the magnetic stopper system according to the embodiment of FIG. 37.
Figure 39B:
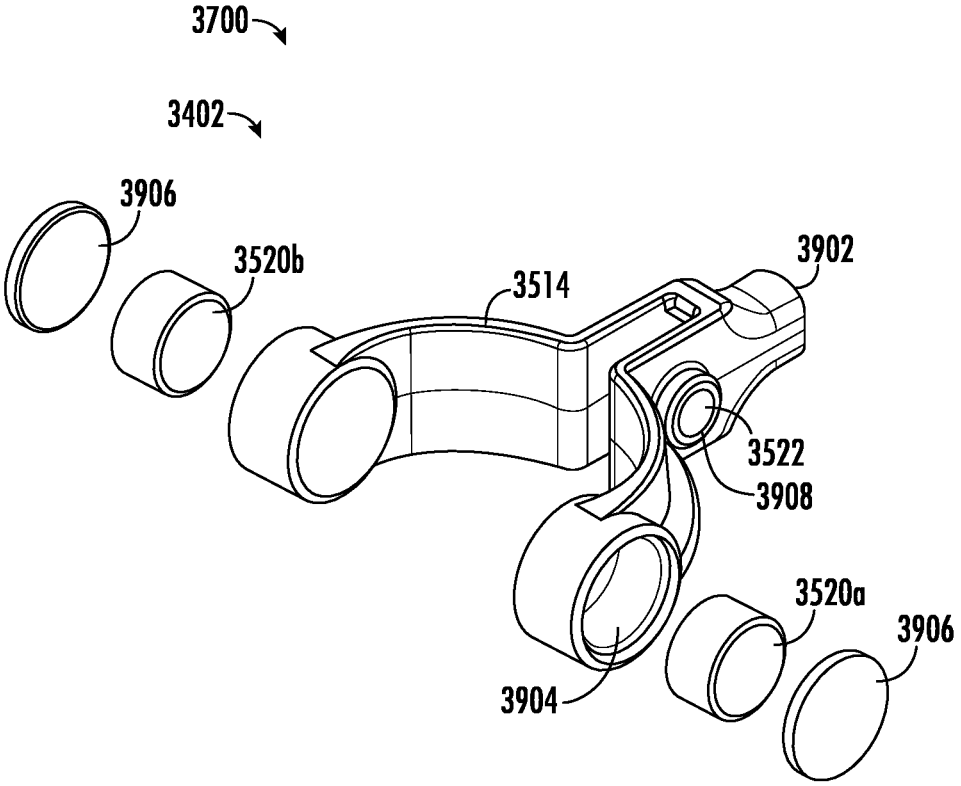
FIG. 39B is an exploded view of a portion of the lever system of the magnetic stopper system according to the embodiment of FIG. 37.
Figure 39C:
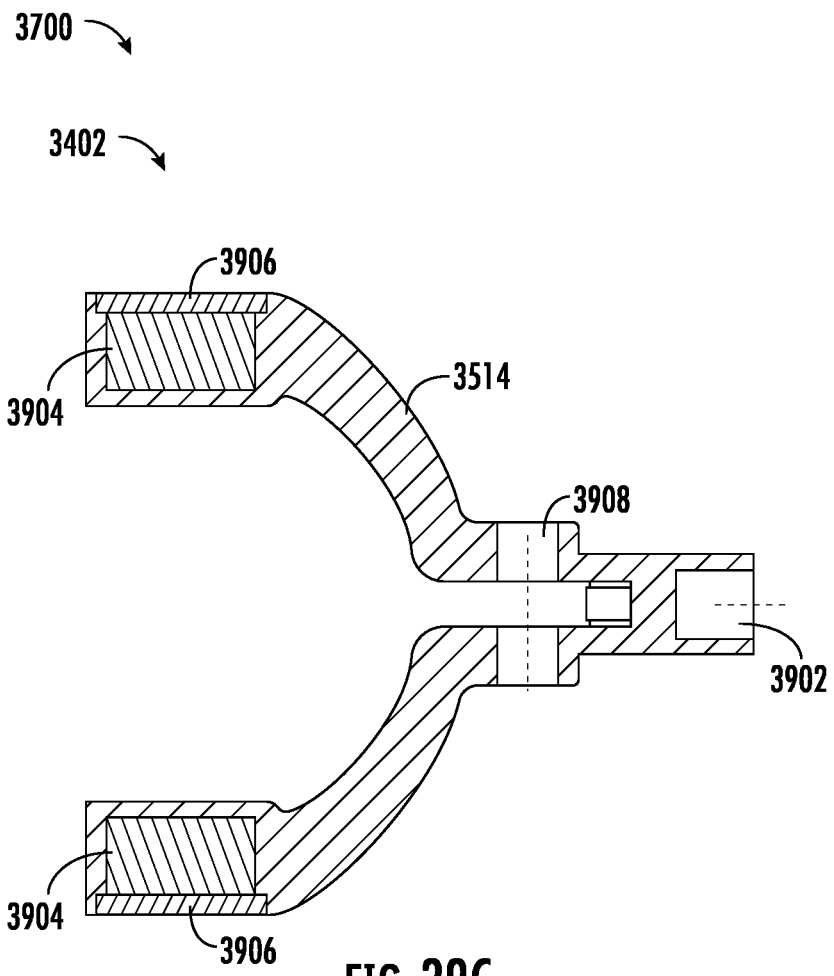
FIG. 39C is a cross-sectional view of a portion of the lever system of the magnetic stopper system according to the embodiment of FIG. 37.

FIGS. 39A-39C illustrate a portion of the lever system 3402 of the magnetic drain stopper system 3700 according to another embodiment. FIG. 39A is a perspective view of a portion of the lever system of the magnetic stopper system according to the embodiment of FIG. 37. FIG. 39B is an exploded view of a portion of the lever system of the magnetic stopper system according to the embodiment of FIG. 37. FIG. 39C is a cross-sectional view of a portion of the lever system of the magnetic stopper system according to the embodiment of FIG. 37.

As shown in FIGS. 39A-39C, the lever system 3402 includes the magnetic attachment 3514. The magnetic attachment 3514 includes a lever arm opening 3902. The lever arm opening 3902 is configured to receive the lever arm 3516 (not shown). The magnetic attachment 3514 further includes a plurality of recesses 3904. For example, the plurality of recesses 3904 are configured to receive the magnets 3520. For example, a first recess 3904 receives the first magnet 3520*a* and a second recess 3904 receives the second magnet 3520*b*. The magnetic attachment 3514 also includes a plurality of magnet covers 3906. The plurality of magnet covers 3906 are configured to cover (e.g., seal, protect, etc.) the magnets 3520 within the recesses 3904. For example, a first magnet cover 3906 engages with the first recess 3904 to hold the first magnet 3520*a* in the first recess 3904 and a second magnet cover 3906 engages with the second recess 3904 to hold the first magnet 3520*a* in the second recess 3904. The magnetic attachment 3514 also includes an opening 3908 configured to receive the screw 3522.

Figure 40:
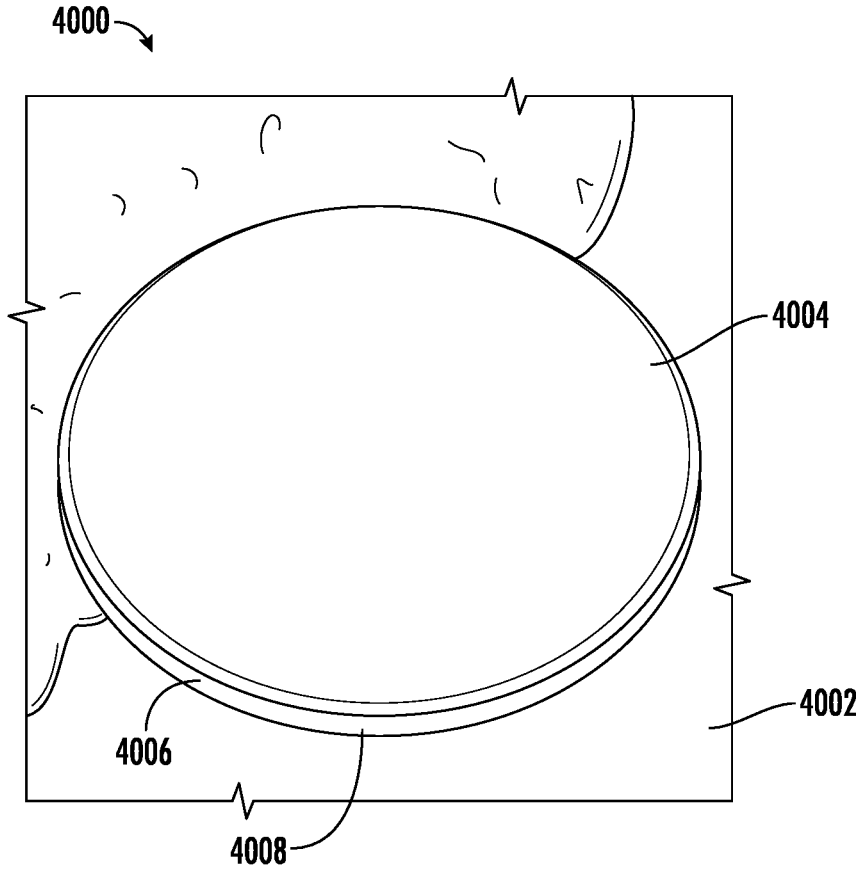
FIG. 40 is a perspective view of a drain cover system according to one embodiment.

FIGS. 40-44B illustrate the drain stopper system 4000 according to yet another embodiment. FIG. 40 is a perspective view of a drain stopper system 4000 positioned within a lavatory drain 4002. In other embodiments, the drain stopper system 4000 may be positioned in a tub or any suitable drain opening. As shown in FIG. 40, the drain stopper system 4000 includes the drain cover 4004 and a drain seal 4006. The drain seal 4006 is positioned underneath the drain cover 4004. The drain seal 4006 is configured to prevent flow from passing through the drain opening 4008 when the drain stopper system 4000 is in a closed position (e.g., a second position, etc.). As shown in FIG. 40, the drain cover 4002 may be a flat and smooth cover.

Figure 41:
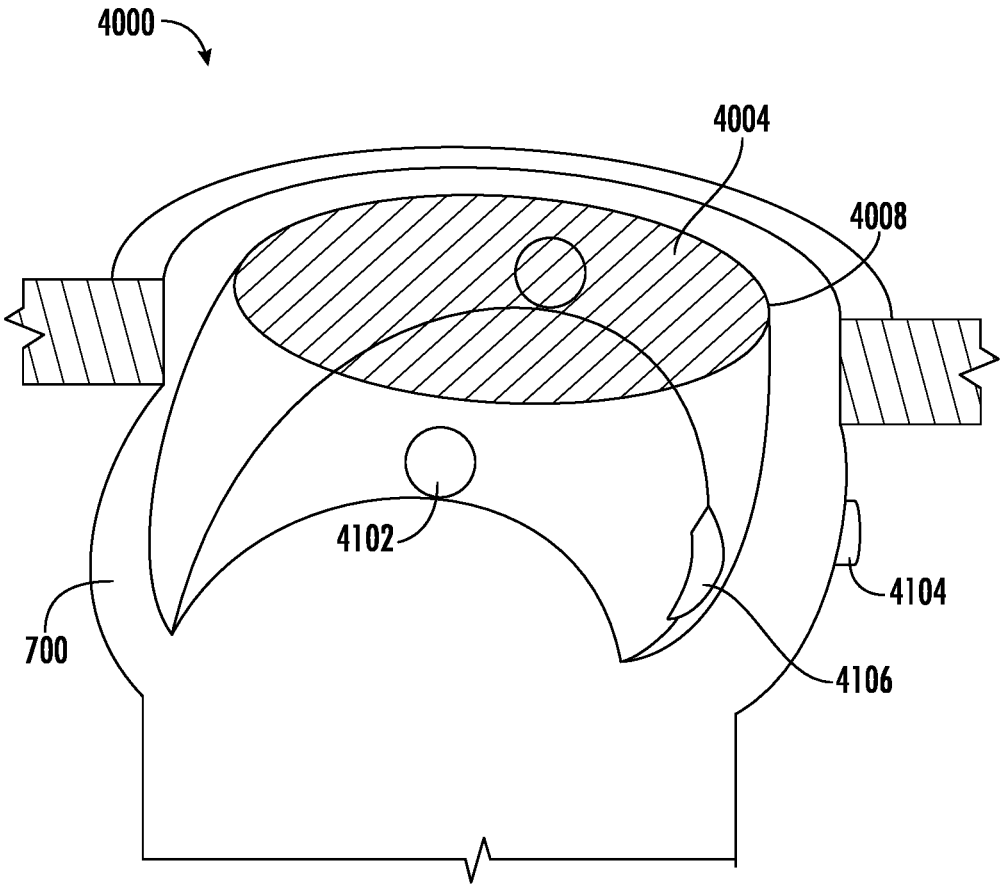
FIG. 41 is a cross-sectional view of the drain cover system according to the embodiment of FIG. 40.
Figure 42:
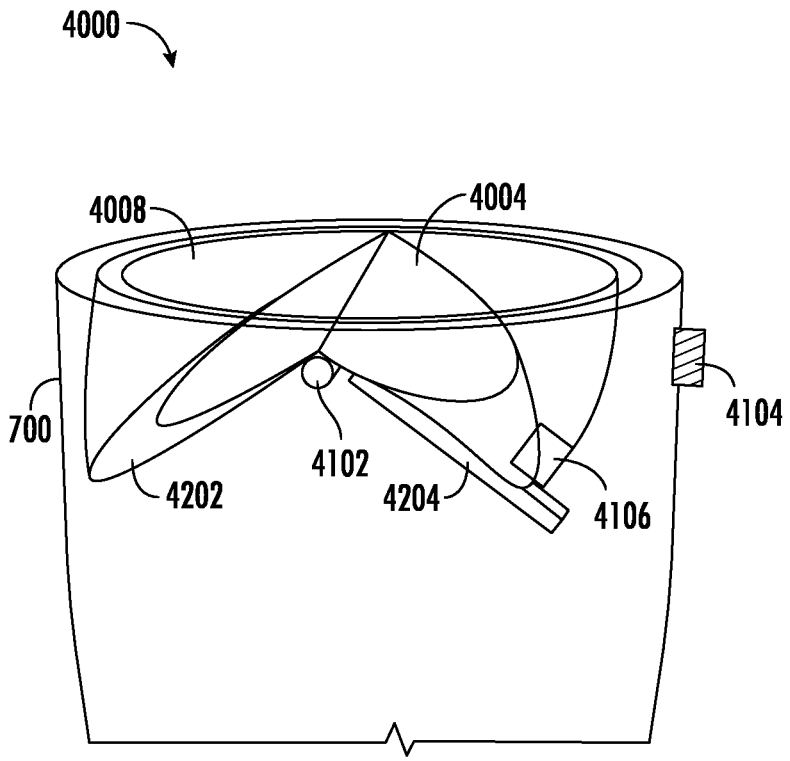
FIG. 42 is another cross-sectional view of the drain cover system according to the embodiment of FIG. 40.
Figure 43:
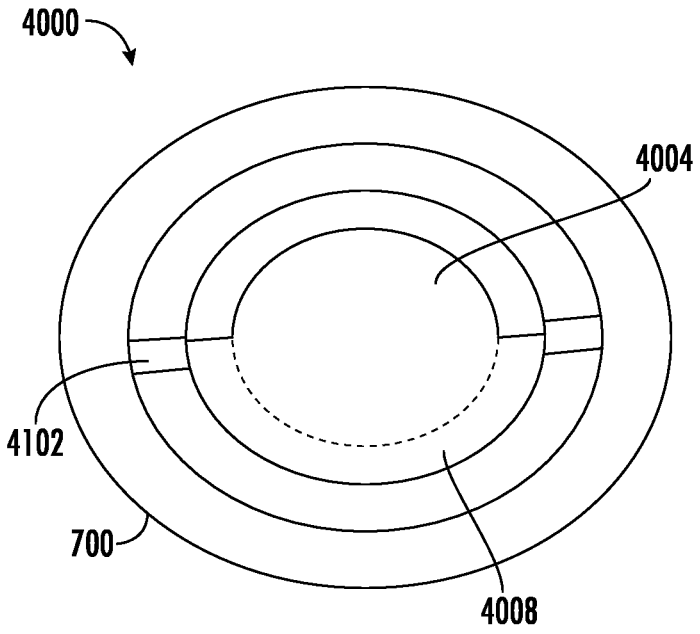
FIG. 43 is a top-down view of the drain cover system according to the embodiment of FIG. 40.
Figure 44A:
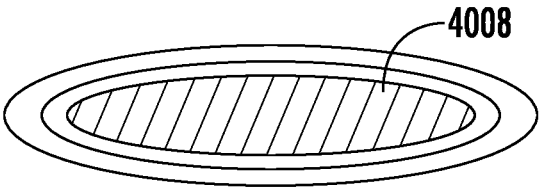
FIG. 44A is a perspective view of the drain cover system in an open position according to the embodiment of FIG. 40.
Figure 44B:
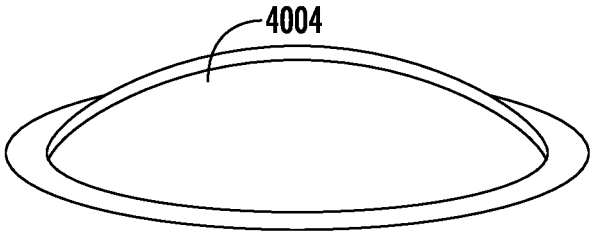
FIG. 44B is a perspective view of the drain cover system in a closed position according to the embodiment of FIG. 40.

FIGS. 41-42 are cross-sectional views of the drain stopper system 4000. FIG. 41 is a cross-sectional view of the drain stopper system 4000 in a closed position (e.g., a first position, etc.). The drain cover 4004 includes a hinge 4102. Each end of the hinge 4102 is coupled to the drain housing 700. The hinge 4102 is configured to facilitate movement of the drain cover 4004.

The drain stopper system 4000 also includes a plurality of housing magnets 4104. According to this embodiment, the housing magnets 4104 are coupled to drain housing 700. The drain stopper system 4000 also includes a plurality of cover magnets 4106. The cover magnets 4106 are coupled to the drain cover 4004. The cover magnets 4106 are configured to engage with the housing magnets 4104.

As shown in FIG. 42, the drain cover 4002 includes a first side 4202 and a second side 4204. For example, the hinge 4102 defines (e.g., separates, etc.) the first side 4202 from the second side 4204. As shown in FIG. 42, each of the first side 4202 and the second side 4204 rotates about the hinge 4102. Each of the first side 4202 and the second side 4204 may include a cover magnet 4106. For example, the cover magnets 4106 are magnetically attracted to the housing magnets 4104. When the cover magnets 4106 are engages with the housing magnets 4104, the drain cover 4004 is in a closed position. When the cover magnets 4106 are not engaged with (e.g., positioned a distance away from, etc.) the drain magnets 4104, the drain cover 4004 is in an open position in which the first side 4202 and the second side 4204 rotate about the hinge 4102 a distance away from the housing magnets 4104.

FIGS. 45-50 illustrate the drain stopper system 4500 including the magnetic drain stopper system 3400 according to yet another embodiment. According to this embodiment, the magnetic drain system 3400 includes the tailpipe attachment 3512. The tailpipe attachment 3512 includes a latch clamp 4502. The latch clamp 4502 is configured to secure the tailpipe attachment 3512 to the tailpipe 118. For example, the latch clamp 4502 is configured to loosen the tailpipe attachment 3512 such that the tailpipe attachment 3512 can be placed on the tailpipe 118 or adjusted vertically on the tailpipe 118. Further, the latch clamp 4502 is configured to secure the tailpipe attachment 3512 to the tailpipe 118. For example, the latch clamp 4502 tightens the tailpipe attachment 3512 to the tailpipe 118 such that the tailpipe attachment 3512 cannot move vertically along the tailpipe 118.

The magnetic drain stopper system 3400 also includes a hinge 4504. The hinge 4504 is configured to allow the latch clamp 4502 to pivot from open position to a closed position. For example, the hinge 4504 allows the latch clamp 4502 to move from an open position to a closed position to secure the tailpipe attachment 3512 to the tailpipe.

Figure 46:
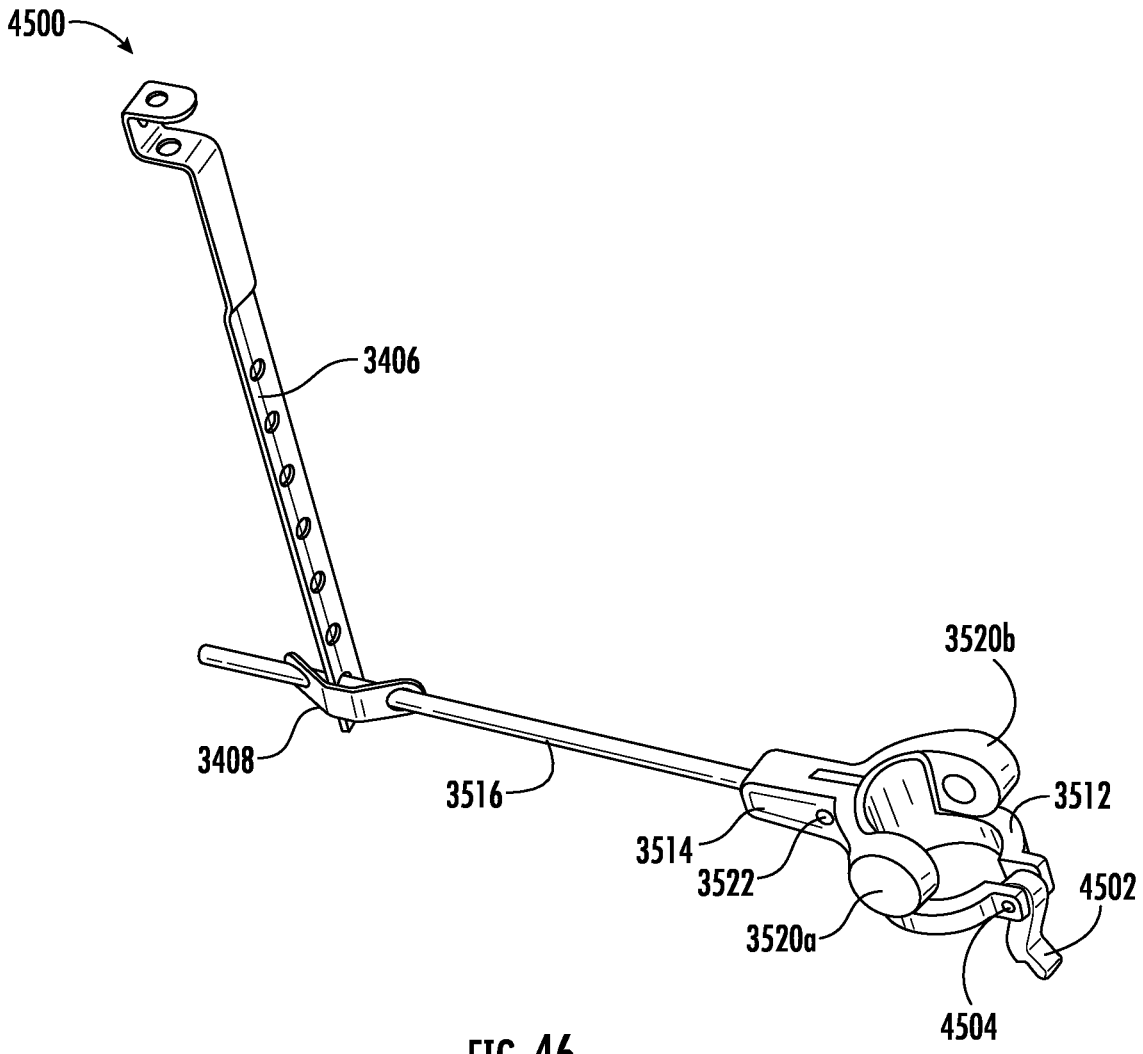
FIG. 46 is a perspective view of a portion of the drain stopper system with the magnetic stopper system according to the embodiment of FIG. 45.

As shown in FIG. 46, the tailpipe attachment 3512 including the latch clamp 4502 form an annular opening 4506. The annular opening 4506 receives the tailpipe 118. The latch clamp 4502 is configured to loosen the tailpipe attachment 3512 such that the annular opening 4506 is slightly enlarged. Additionally, when the latch clamp 4502 is closed, the annular opening 4506 is slightly narrower (e.g., has a slightly smaller circumference, smaller diameter, etc.) such that the tailpipe attachment 3512 does not move vertically along the tailpipe 118.

Figure 45:
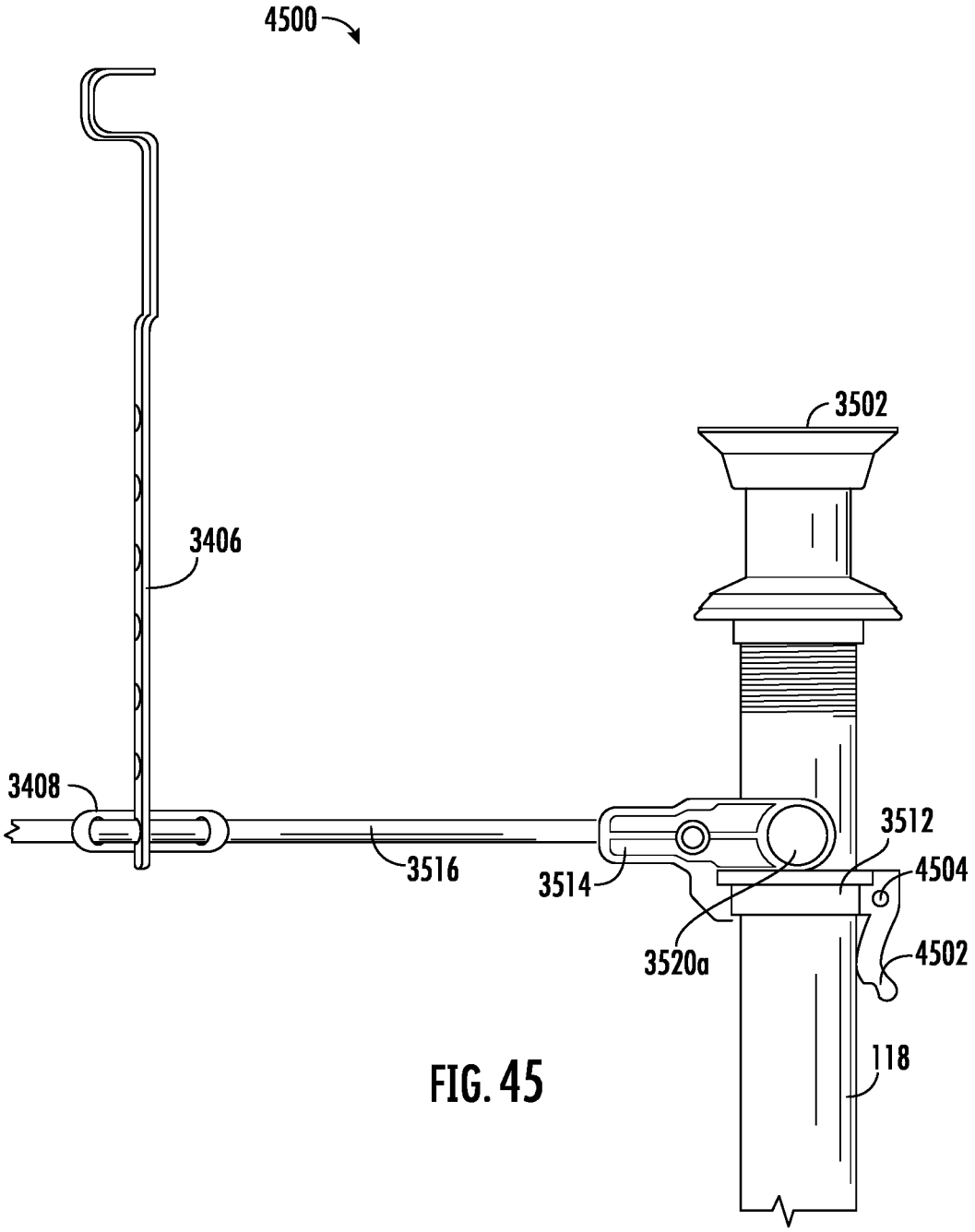
FIG. 45 is a side view of the drain stopper system with a magnetic stopper system for a clean drain system according to another embodiment.
Figure 47:
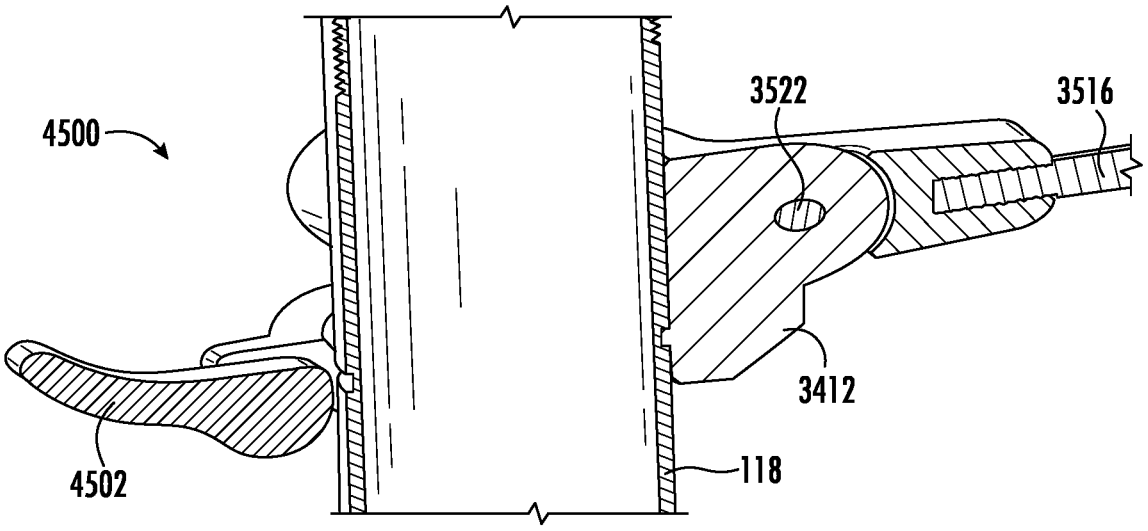
FIG. 47 is a cross-sectional view of a portion of the drain stopper system with the magnetic stopper system according to the embodiment of FIG. 45.
Figure 48:
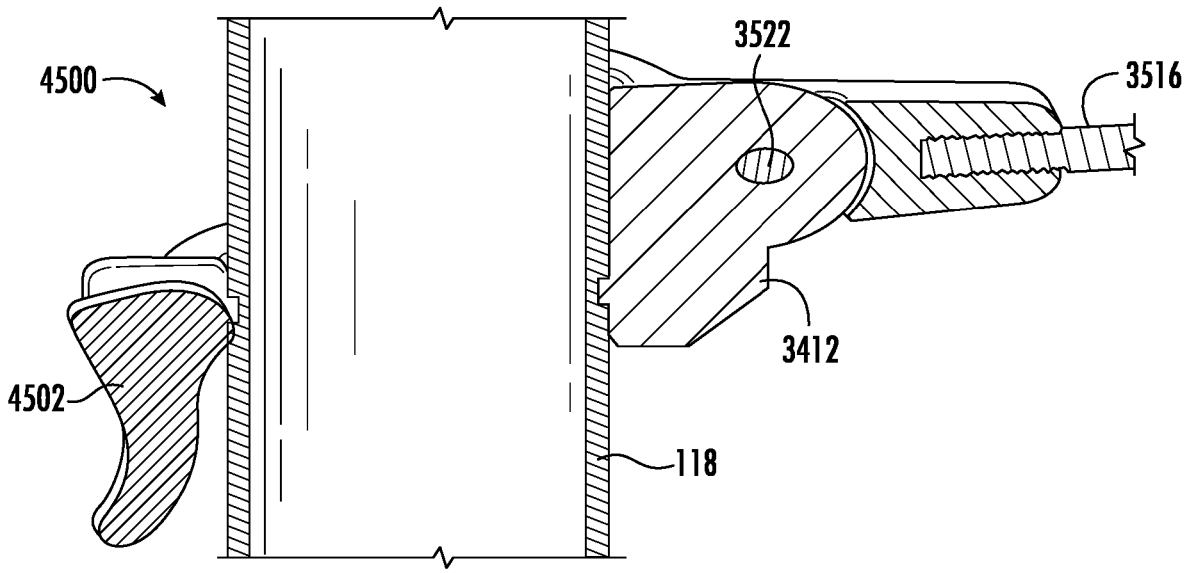
FIG. 48 is another cross-sectional view of a portion of the drain stopper system with the magnetic stopper system according to the embodiment of FIG. 45.

FIG. 47 is a cross-sectional view of a portion of the drain stopper system with the magnetic stopper system according to the embodiment of FIG. 45. As shown in FIG. 47, the latch clamp 4502 is positioned in an open position. For example, when the latch clamp 4502 is in an open position, the tailpipe attachment 3512 may be moved vertically along the tailpipe 118. Further, FIG. 48 is another cross-sectional view of a portion of the drain stopper system with the magnetic stopper system according to the embodiment of FIG. 45. As shown in FIG. 48, the latch clamp 4502 is in a closed position. For example, when the latch clamp 4502 is in a closed position, the latch clamp 4502 tightens, preventing the tailpipe attachment 3512 from moving along the tailpipe 118.

Figure 49:
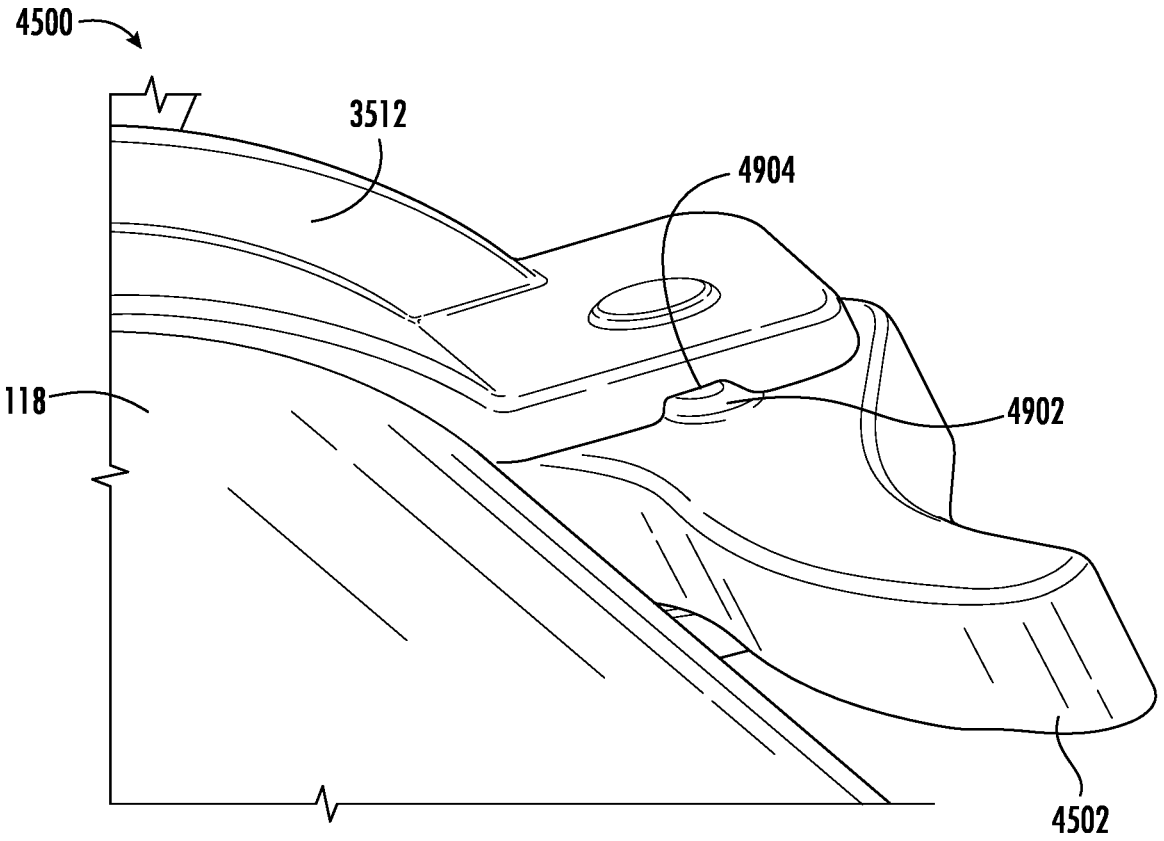
FIG. 49 is a bottom perspective view of a portion of the drain stopper system with the magnetic stopper system according to the embodiment of FIG. 45.
Figure 50:
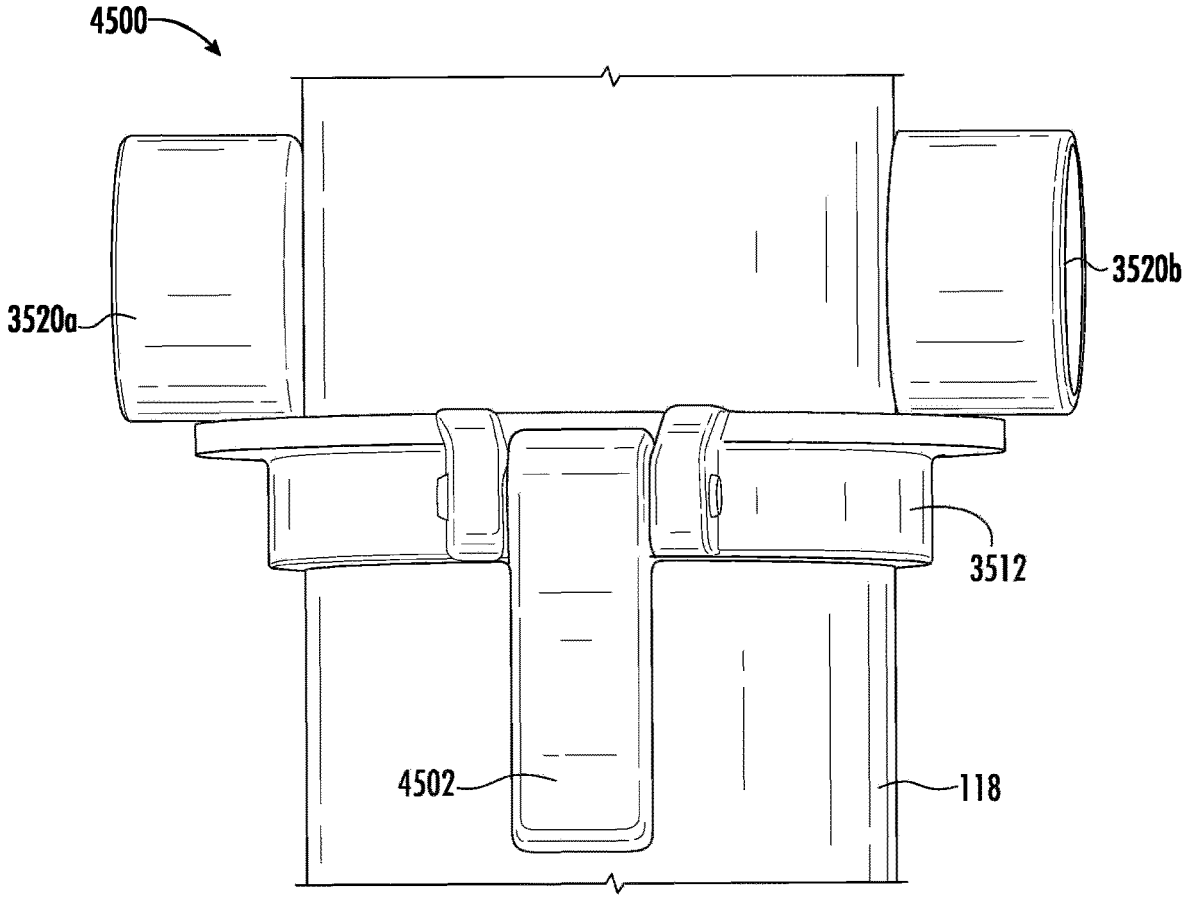
FIG. 50 is a front view of a portion of the drain stopper system with the magnetic stopper system according to the embodiment of FIG. 45.

FIG. 49 is a bottom perspective view of a portion of the drain stopper system with the magnetic stopper system according to the embodiment of FIG. 45. As shown in FIG. 49, the latch clamp 4502 includes at least one protrusion (e.g., a detent, a bump, a ridge, etc.) 4902. For example, the latch clamp 4502 may include two protrusions 4902 positioned on opposite side of the latch clamp 4502. The tailpipe attachment 3512 further includes at least one recess 4904. For example, the tailpipe attachment 3512 may include two recesses 4904 positioned on opposite sides of the tailpipe attachment 3512 aligned with the two protrusions 4902. The recess 4904 is configured to receive the protrusion 4902 when the latch clamp 4502 is in a closed position. Further, when the latch clamp 4502 is in an open position, the protrusions 4902 engage with the tailpipe attachment 3512 to widen (e.g., spread, etc.) the tailpipe attachment. For example, when the protrusions 4902 engage with the latch clamp 4502 the annular opening 4506 widens such that the tailpipe attachment 3512 can move along the tailpipe 118.

The terms "coupled," "connected," and the like, as used herein, mean the joining of two members directly or indirectly to one another. Such joining may be stationary (e.g., permanent) or moveable (e.g., removable or releasable). Such joining may be achieved with the two members, or the two members and any additional intermediate members being integrally formed as a single unitary body with one another or with the two members or the two members and any additional intermediate members being attached to one another.

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of 'A' and 'B'" can include only 'A', only 'B', as well as both 'A' and 'B'. Such references used in conjunction with "comprising" or other open terminology can include additional items.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the debris-reducing drain insert as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements.

Other substitutions, modifications, changes, and omissions may also be made in the design, operating conditions, and arrangement of the various exemplary embodiments without departing from the scope of the present invention. For example, any element (e.g., cutting blade, cutting plate, cover, impeller, support structure etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A drain system, comprising:
- a tailpipe, defining a drain opening;
- a drain housing positionable within the tailpipe; and
- a magnetic stopper system comprising:
  - a drain cover positionable within the drain opening, the drain cover operable between a first position and a second position,
  - a gasket positioned below the drain cover, the gasket engageable with the drain opening in the second position to prevent water from flowing down the drain opening, and
  - a tailpipe attachment comprising a latch clamp configured to selectively adjust a circumference of the tailpipe attachment.

2. The drain system of claim 1, wherein the magnetic stopper system further comprises:
- a drain stopper comprising:
  - a drain stopper body removably coupled to the drain cover at a first end, the drain stopper body comprising at least one stopper magnet positioned on a second end opposite the first end; and
- a lever system comprising:
  - a lever rod, and
  - a magnetic attachment coupled to the lever rod, the magnetic attachment comprising at least one magnet engageable with the at least one stopper magnet.

3. The drain system of claim 2, wherein the tailpipe attachment coupling the lever system to the tailpipe.

4. The drain system of claim 2, wherein the magnetic attachment is configured such that it moves a distance from a first lever position to a second lever position in contact with the tailpipe attachment, wherein when the magnetic attachment is in the first lever position the drain cover is in the first position and when the magnetic attachment is in the second lever position the drain cover is in a second position so that it prevents flow down the drain opening.

5. The drain system of claim 2, wherein the at least one stopper magnet of the drain stopper body comprises a first stopper magnet and a second stopper magnet, the second stopper magnet positioned opposite the first stopper magnet, and the magnetic attachment comprises a first magnet and a second magnet configured such that they engage with the first stopper magnet and the second stopper magnet respectively.

6. The drain system of claim 2, wherein the tailpipe attachment defines one or more recesses, and the latch clamp defines one or more protrusions each configured to be received by one of the one or more recesses.

7. The drain system of claim 6, wherein the lever system is in a closed position when the one or more protrusions are engaged with the one or more recesses.

8. The drain system of claim 2, wherein the magnetic attachment is pivotably coupled to the tailpipe attachment.

9. The drain system of claim 1, wherein the magnetic stopper system further comprises:

a first cover magnet and a second cover magnet; and a first housing magnet and a second housing magnet configured such that they engage with the first cover magnet and the second cover magnet respectively;

wherein the drain cover comprises a hinge defining a first side and a second side of the drain cover configured such that the first side and second side of the drain cover rotate about the hinge.

10. The drain system of claim 9, wherein when the first cover magnet and the second cover magnet are engaged with the first housing magnet and the second housing magnet, flow is prevented from passing through the drain opening.

11. A magnetic stopper system comprising:

a drain stopper comprising at least one stopper magnet positioned on an end of the drain stopper; and a lever system comprising:

a lever rod, a magnetic attachment coupled to the lever rod, the magnetic attachment comprising at least one magnet engageable with the at least one stopper magnet, and a tailpipe attachment comprising a latch clamp configured to selectively adjust a circumference of the tailpipe attachment.

12. The magnetic stopper system of claim 11, wherein the magnetic attachment is pivotably coupled to the tailpipe attachment.

* * * * *